US008456365B2

(12) United States Patent
Pros et al.

(10) Patent No.: US 8,456,365 B2
(45) Date of Patent: Jun. 4, 2013

(54) MULTI-BAND MONOPOLE ANTENNAS FOR MOBILE COMMUNICATIONS DEVICES

(75) Inventors: Jaume Anguera Pros, Vinaros (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 664 days.

(21) Appl. No.: 12/228,487

(22) Filed: Aug. 13, 2008

(65) Prior Publication Data

US 2009/0033561 A1 Feb. 5, 2009

Related U.S. Application Data

(63) Continuation of application No. 10/584,442, filed as application No. PCT/EP2005/000880 on Jan. 28, 2005, now Pat. No. 7,423,592, and a continuation-in-part of application No. PCT/EP02/14706, filed on Dec. 22, 2002.

(60) Provisional application No. 60/540,450, filed on Jan. 30, 2004.

(51) Int. Cl.

| | |
|---|---|
| ***H01Q 1/38*** | (2006.01) |
| ***H01Q 1/36*** | (2006.01) |
| ***H01Q 1/24*** | (2006.01) |

(52) U.S. Cl.
USPC ..... 343/700 MS; 343/895; 343/702

(58) Field of Classification Search
USPC ..... 343/700 MS, 702, 895, 833, 834
See application file for complete search history.

(56) References Cited

U.S. PATENT DOCUMENTS

| | | | |
|---|---|---|---|
| 3,079,602 | A | 2/1963 | Duhamel |
| 3,689,929 | A | 9/1972 | Moody |
| 4,038,662 | A | 7/1977 | Turner |
| 4,123,756 | A | 10/1978 | Nagata et al. |
| 4,318,109 | A | 3/1982 | Weathers |
| 4,356,492 | A | 10/1982 | Kaloi |
| 4,389,651 | A | 6/1983 | Tomasky |

(Continued)

FOREIGN PATENT DOCUMENTS

| | | |
|---|---|---|
| CN | 2224466 | 4/1996 |
| EP | 0749176 | 12/1996 |

(Continued)

OTHER PUBLICATIONS

Antenna Installation on Super Constellation Airborne Early Warning and Control Aircraft, Allerton Conference, 1954.

(Continued)

*Primary Examiner* — Hoang V Nguyen
(74) *Attorney, Agent, or Firm* — Winstead PC

(57) ABSTRACT

Antennas for use in mobile communication devices are disclosed. The antennas disclosed can include a substrate with a base, a top, a front side and a back side; a first conductor can be located on the first side of the antenna substrate; and a second conductor can be located on the second side of the antenna substrate. The conductors can have single or multiple branches. If a conductor is a single branch it can, for example, be a spiral conductor or a conducting plate. If a conductor has multiple branches, each branch can be set up to receive a different frequency band. A conductor with multiple branches can have a linear branch and a space-filling or grid dimension branch. A conducting plate can act as a parasitic reflector plane to tune or partially tune the resonant frequency of another conductor. The first and second conductors can be electrically connected.

45 Claims, 17 Drawing Sheets

U.S. PATENT DOCUMENTS 4,536,725 A 8/1985 Hubler
4,571,595 A 2/1986 Phillips
4,578,654 A 3/1986 Tait
4,608,572 A 8/1986 Blakney
4,827,271 A 5/1989 Berneking
4,843,468 A 6/1989 Drewery
4,860,019 A 8/1989 Jiang
4,907,011 A 3/1990 Kuo
5,014,346 A 5/1991 Phillips
5,075,691 A 12/1991 Garay
5,248,988 A 9/1993 Makino
5,307,075 A 4/1994 Huynh
5,337,065 A 8/1994 Bonnet et al.
5,355,318 A 10/1994 Dionnet
5,363,114 A 11/1994 Shoemaker
5,410,322 A 4/1995 Sonoda
5,453,752 A 9/1995 Wang
5,457,469 A 10/1995 Diamond
5,557,293 A 9/1996 McCoy
5,572,223 A 11/1996 Phillips et al.
5,608,417 A 3/1997 De Vall
5,809,433 A 9/1998 Thompson
5,841,402 A 11/1998 Dias
5,870,066 A 2/1999 Asakura et al.
5,872,546 A 2/1999 Ihara
5,898,404 A 4/1999 Jou
5,918,183 A 6/1999 Janky
5,926,139 A 7/1999 Korisch
5,929,825 A 7/1999 Niu et al.
5,933,330 A 8/1999 Beutler et al.
5,936,587 A 8/1999 Gudilev
5,943,020 A 8/1999 Liebendoerfer et al.
5,963,871 A 10/1999 Zhinong et al.
5,966,098 A 10/1999 Qi
5,986,609 A 11/1999 Spall
5,986,610 A 11/1999 Miron
5,990,838 A 11/1999 Burns
5,990,849 A 11/1999 Salvail et al.
5,995,052 A 11/1999 Sadler
6,011,518 A 1/2000 Yamagishi et al.
6,011,699 A 1/2000 Murray
6,031,505 A 2/2000 Qi
6,087,990 A 7/2000 Thill et al.
6,094,179 A 7/2000 Davidson
6,097,339 A 8/2000 Filipovic
6,104,349 A 8/2000 Cohen
6,111,545 A 8/2000 Saari et al.
6,112,102 A 8/2000 Zhinong et al.
6,122,533 A 9/2000 Zhang
6,130,651 A 10/2000 Yanagisawa et al.
6,140,966 A 10/2000 Pankinaho
6,140,975 A 10/2000 Cohen
6,141,540 A 10/2000 Richards
6,147,655 A 11/2000 Roesner
6,160,513 A 12/2000 Davidson
6,166,694 A 12/2000 Ying et al.
6,181,281 B1 1/2001 Desclos
6,195,048 B1 2/2001 Chiba
6,198,442 B1 3/2001 Rutkowski
6,201,501 B1 3/2001 Arkko
6,204,826 B1 3/2001 Rutkowski
6,211,826 B1 4/2001 Aoki
6,215,474 B1 4/2001 Shah
6,236,366 B1 5/2001 Yamamoto
6,239,765 B1 5/2001 Johnson
6,243,592 B1 6/2001 Nakada et al.
6,259,407 B1 7/2001 Tran
6,266,023 B1 7/2001 Nagy
6,266,538 B1 7/2001 Waldron
6,271,794 B1 8/2001 Geeraert et al.
6,275,198 B1 8/2001 Kenoun et al.
6,281,846 B1 8/2001 Puente
6,285,327 B1 9/2001 See
6,288,680 B1 9/2001 Tsuru
6,300,914 B1 10/2001 Yang
6,307,511 B1 10/2001 Ying et al.
6,317,084 B1 11/2001 Chen
6,329,951 B1 12/2001 Wen
6,329,962 B2 12/2001 Ying et al.
6,337,663 B1 1/2002 Chi-Ming et al.
6,337,667 B1 1/2002 Ayala et al.
6,343,208 B1 1/2002 Ying
6,352,434 B1 3/2002 Emmert
6,353,443 B1 3/2002 Ying
6,366,243 B1 4/2002 Isohatala
6,384,790 B2 5/2002 Dishart et al.
6,408,190 B1 6/2002 Ying
6,417,816 B2 7/2002 Sadler
6,445,352 B1 9/2002 Cohen
6,452,553 B1 9/2002 Cohen
6,452,556 B1 9/2002 Ha
6,459,413 B1 10/2002 Tseng et al.
6,476,769 B1 11/2002 Lehtola
6,483,462 B2 11/2002 Weinberger
6,549,789 B1 4/2003 Kfoury
6,614,400 B2 9/2003 Egorov
6,664,930 B2 12/2003 Wen et al.
6,674,405 B2 1/2004 Wang
6,693,604 B2 2/2004 Washiro
6,697,022 B2 2/2004 Ponce De Leon
6,741,215 B2 5/2004 Grant et al.
6,762,723 B2 7/2004 Nallo et al.
6,781,548 B2 8/2004 Wen et al.
6,801,164 B2 10/2004 Bit-Babik
6,822,611 B1 11/2004 Kontogeorgakis et al.
6,831,606 B2 12/2004 Sajadinia
6,839,040 B2 1/2005 Huber
6,853,352 B2 2/2005 Nevermann
6,864,854 B2 3/2005 Dai et al.
6,882,320 B2 4/2005 Park et al.
6,897,830 B2 5/2005 Bae et al.
6,903,688 B2 6/2005 Edvardsson
6,950,071 B2 9/2005 Wen
6,963,310 B2 11/2005 Horita et al.
6,995,720 B2 2/2006 Shikata
7,015,868 B2 3/2006 Puente
7,057,560 B2 6/2006 Erkocevic
7,068,230 B2 6/2006 Qi et al.
7,069,043 B2 6/2006 Sawamura
7,081,857 B2 7/2006 Kinnunen et al.
7,095,372 B2 8/2006 Soler
7,123,208 B2 10/2006 Puente
7,126,537 B2 10/2006 Cohen
7,148,850 B2 12/2006 Puente
7,202,821 B2 4/2007 Fujikawa
7,202,822 B2 4/2007 Baliarda
7,205,954 B2 4/2007 Yamagajo
7,289,072 B2 10/2007 Sakurai
7,312,762 B2 12/2007 Puente
7,342,553 B2 3/2008 Soler
7,394,432 B2 7/2008 Baliarda
7,397,431 B2 7/2008 Baliarda
7,403,164 B2 7/2008 Sanz et al.
7,411,556 B2 8/2008 Sanz et al.
7,423,592 B2 9/2008 Pros et al.
7,446,708 B1 11/2008 Nguyen et al.
7,463,199 B2 12/2008 Soler
7,511,675 B2 3/2009 Puente
7,528,782 B2 5/2009 Baliarda
7,675,470 B2 3/2010 Sanz et al.
8,253,633 B2 8/2012 Sanz et al.
8,259,016 B2 9/2012 Sanz et al.
2001/0002823 A1 6/2001 Ying
2001/0044320 A1 11/2001 Ono
2001/0050636 A1 12/2001 Weinberger
2001/0050637 A1 12/2001 Aoyama et al.
2002/0000940 A1 1/2002 Moren et al.
2002/0044090 A1 4/2002 Bahr et al.
2002/0080088 A1 6/2002 Boyle
2002/0140615 A1 10/2002 Carles et al.
2002/0149527 A1 10/2002 Wen
2002/0175866 A1 11/2002 Gram
2002/0190904 A1 12/2002 Cohen
2003/0137459 A1 7/2003 Kim et al.
2003/0184482 A1 10/2003 Bettin
2003/0210187 A1 11/2003 Wong et al.
2004/0004574 A1 1/2004 Wen

| | | | |
|---|---|---|---|
| 2004/0009755 | A1 | 1/2004 | Yoshida |
| 2004/0027295 | A1 | 2/2004 | Huber et al. |
| 2004/0090372 | A1 | 5/2004 | Di Nallo et al. |
| 2004/0095289 | A1 | 5/2004 | Bae et al. |
| 2004/0106428 | A1 | 6/2004 | Shoji |
| 2004/0140938 | A1 | 7/2004 | Kadambi |
| 2004/0147297 | A1 | 7/2004 | Mikkola |
| 2004/0203529 | A1 | 10/2004 | Hong et al. |
| 2004/0212545 | A1 | 10/2004 | Li |
| 2005/0237244 | A1 | 10/2005 | Annabi et al. |
| 2005/0239519 | A1 | 10/2005 | Saitou et al. |
| 2005/0259031 | A1 | 11/2005 | Sanz et al. |
| 2006/0028380 | A1 | 2/2006 | Harano |
| 2006/0033668 | A1 | 2/2006 | Ryu |
| 2006/0135090 | A1 | 6/2006 | Annamaa |
| 2006/0170610 | A1 | 8/2006 | Rabinovich et al. |
| 2006/0176225 | A1 | 8/2006 | Annamaa |
| 2007/0024508 | A1 | 2/2007 | Lee |
| 2007/0046548 | A1 | 3/2007 | Pros et al. |
| 2007/0103371 | A1 | 5/2007 | Kim et al. |
| 2007/0152887 | A1 | 7/2007 | Castany et al. |
| 2007/0152894 | A1 | 7/2007 | Sanz et al. |
| 2007/0152984 | A1 | 7/2007 | Ording et al. |
| 2007/0194997 | A1 | 8/2007 | Nakanishi et al. |
| 2009/0109101 | A1 | 4/2009 | Baliarda |
| 2009/0140942 | A1 | 6/2009 | Mikkola |
| 2009/0231215 | A1 | 9/2009 | Taura |
| 2009/0248112 | A1 | 10/2009 | Mumbru |

FOREIGN PATENT DOCUMENTS

| | | | |
|---|---|---|---|
| EP | 0766343 | | 4/1997 |
| EP | 0590671 | B1 | 12/1997 |
| EP | 0 884 796 | | 12/1998 |
| EP | 0938158 | A2 | 2/1999 |
| EP | 0902472 | | 3/1999 |
| EP | 0938158 | | 8/1999 |
| EP | 0969375 | A2 | 1/2000 |
| EP | 0 986 130 | | 3/2000 |
| EP | 1011167 | A1 | 6/2000 |
| EP | 1 091 445 | | 4/2001 |
| EP | 1 198 027 | | 4/2002 |
| EP | 0 777 293 | | 7/2002 |
| EP | 1 237 224 | | 9/2002 |
| EP | 1367671 | | 12/2003 |
| EP | 1367671 | A2 | 12/2003 |
| EP | 1258054 | | 8/2005 |
| ES | 2112163 | | 5/1995 |
| ES | 2112163 | | 11/1998 |
| ES | 2142280 | | 11/2000 |
| GB | 2317994 | | 4/1998 |
| GB | 2 361 584 | | 10/2001 |
| JP | 62-262502 | | 11/1987 |
| JP | 03156847 | | 1/1993 |
| JP | 05007109 | | 1/1993 |
| JP | 5-308223 | | 11/1993 |
| JP | 60-85530 | | 3/1994 |
| JP | H6-252629 | | 9/1994 |
| JP | 9-246852 | | 9/1997 |
| JP | 10-117108 | | 5/1998 |
| JP | 10-200327 | | 7/1998 |
| JP | 10247808 | | 9/1998 |
| JP | 10-303637 | | 11/1998 |
| JP | 11-004113 | | 1/1999 |
| JP | 11-27042 | | 1/1999 |
| JP | 11-220319 | | 8/1999 |
| JP | 2001-217632 | | 8/2001 |
| JP | 2001-251128 | | 9/2001 |
| JP | 2001332924 | | 11/2001 |
| JP | 2002050919 | | 2/2002 |
| JP | 2003-347835 | | 12/2003 |
| JP | 11-136015 | | 4/2005 |
| JP | H10-163748 | | 5/2010 |
| WO | 88/09065 | | 11/1988 |
| WO | 96297755 | | 9/1996 |
| WO | WO-96/38881 | | 12/1996 |
| WO | 97/06578 | | 2/1997 |
| WO | 9706578 | | 2/1997 |
| WO | 9735360 | | 9/1997 |
| WO | 98/05088 | | 2/1998 |
| WO | 98/20578 | | 5/1998 |
| WO | 9903166 | | 1/1999 |
| WO | 99/27608 | | 6/1999 |
| WO | 9927608 | | 6/1999 |
| WO | WO-99/56345 | | 11/1999 |
| WO | 99/65102 | | 12/1999 |
| WO | 99/67851 | A1 | 12/1999 |
| WO | 00/03451 | A1 | 1/2000 |
| WO | 0003451 | A1 | 1/2000 |
| WO | 00/36700 | | 6/2000 |
| WO | WO-00/77884 | | 12/2000 |
| WO | 0108257 | | 2/2001 |
| WO | WO-01/11721 | | 2/2001 |
| WO | 01/17063 | | 3/2001 |
| WO | 0122528 | | 3/2001 |
| WO | WO-01/26182 | | 4/2001 |
| WO | 01/31747 | A1 | 5/2001 |
| WO | 0133665 | | 5/2001 |
| WO | WO-01/48861 | | 7/2001 |
| WO | WO-01/54225 | | 7/2001 |
| WO | 01/56111 | | 8/2001 |
| WO | 0235652 | A1 | 5/2002 |
| WO | WO-02/35646 | | 5/2002 |
| WO | WO-0235652 | | 5/2002 |
| WO | 02078123 | A1 | 10/2002 |
| WO | 03034538 | A1 | 4/2003 |
| WO | 03034544 | A1 | 4/2003 |
| WO | 2004001894 | A1 | 12/2003 |
| WO | WO-2004/025778 | | 3/2004 |
| WO | 2004042868 | A | 5/2004 |
| WO | 2004/057701 | A1 | 7/2004 |
| WO | 2005076409 | A1 | 8/2005 |
| WO | WO-2005076409 | | 8/2005 |

OTHER PUBLICATIONS

Blackband, W. T., Coaxial Transmission Lines and Components, in A. W. Rudge, K. Milne, A. D. Olver, and P. Knight (eds.), The Handbook of Antenna Design, vols. 1 and 2, London, Peter Peregrinus Ltd., 1986.

Counter, V. A., Flush, Re-entrant, Impedance Phased, Circularly Polarized Cavity Antenna for Missiles. The Second Symposium on the USAF Antenna Research and Development Program, Oct. 19-23, 1952.

Counter and Margerum. Flush Dielectric Disc Antenna for Radar, AllertonConference, 1952.

FCC Form 731 filed Apr. 1, 1999.

GSM Technical Specification and related materials, ETSI, 1996.

Photos of Hagenuk Global Hand (at least as early as 1996).

Photos of Motorola Advisor Elite (1997).

Photos of Motorola Advisor Gold (1996).

Photos of Motorola Bravo Plus (1995).

Photos of Motorola P935 product (1997).

Photos of Motorla Page Writer 2000x (1997).

Photos of Nokia 3360 (1999 or earlier).

Photos of RIM950 product (at least as early as 1998).

Office Action for European patent application 00909089.5, Feb. 7, 2003.

Response to Office Action dated on Feb. 7, 2003 for European patent application 00909089.5; Aug. 14, 2003.

Summons to Attend Oral Proceedings for European patent 00909089.5, Oct. 28, 2004.

Written Submissions for European patent 00909089.5, Dec. 12, 2004.

Minutes of oral proceedings (including annexes) for European patent 00909089.5, Jan. 28, 2005.

Response to Office Action dated on Nov. 5, 2004 for the Chinese patent application 00818542.5, Mar. 31, 2005.

Office Action for US patent application 7312762, Oct. 5, 2006.

Response to Office Action dated on Dec. 27, 2006 for US patent application 7312762, Jan. 4, 2007.

Addison, Paul S. Fractals and Chaos : An Illustrated Course, Institute of Physics Publishing, Bristol and Philadelphia; IOP Publishing 1997, pp. 30, 31 & 33.

Balanis, Constantine A. Antenna Theory, John Wiley & Sons, Inc., 1982.

Berizzi, Fabrizio et al., Fractal Analysis of the Signal Scattered from the Sea Surface, IEEE Transactions on Antennas and Propagation, vol. 47, No. 2, Feb. 1999, pp. 324-338.
Boshoff, Hendrik F'v. A Fast Box Counting Algorithm for Determining the Fractal Dimension of Sampled Continuous Functions, 1992 IEEE, pp. 43-48.
Carver, Keith R. et al., Microstrip Antenna Technology IEEE Transactions on Antennas and Propagation, vol. AP-29, No. 1, Jan. 1981, pp. 2-23.
Chen, Susan S. et al., On the Calculation of Fractal Features from Images. IEEE Transactions on Pattern Analysis and Machine Intelligence, vol. 15, No. 10, Oct. 1993, pp. 1087-1090.
Falconer, Kenneth, Fractal Geometry : Mathematical Foundations and Applications. 2nd edition, John Wiley & Sons. Ltd., 2003.
Feng, Jie et al., Fractional Box-Counting Approach to Fractal Dimension Estimation, IEEE 1996; Proceedings of ICPR'96, pp. 854-858.
Garg, Ramesh et al., Microstrip Antenna Design Handbook, 2001, Artech House, Inc.
Hansen, RC Fundamental limitation in antennas, Proceedings of the IEEE, Feb. 1981.
Munson, R. E. Microstrip Antennas in Johnson, Richard C. (Editor), Antenna Engineering Handbook, McGraw Hill Inc., 1993.
Kobayashi, S. et al., Estimation of 3D Fractal Dimension of Real Electrical Tree Patterns. IEEE 1994; Proceedings of the 4th International Conference on Properties and Applications of Dielectric Materials, Jul. 3-8, 1994, Brisbane, Australia, pp. 359-362.
Kraus, John O. Antennas, 1988, McGraw-Hili, Inc., preface and list of contents.
Neary David: Fractal methods in Image Analysis and Coding, Thesis, Dublin City University—School of Electronic Engineering, Dublin 9, Ireland, Sep. 20, 2000, (Internet: http://www.redbrick.dcu.ie/~bolsh/thesis/).
Ng, Vincent et al., Diagnosis of Melanoma with Fractal Dimensions IEEE TENCON; 1993/ Beijing, pp. 514-517.
Peitgen, Heinz-Otto et al., Chaos and Fractals—New Frontiers of Science , 1992,pp. 212-216, 387-388.
Penn, Alan I. at al., Fractal Dimension of Low-Resolution Medical Images. 18th Annual International Conference of the IEEE Engineering in Medicine and Biology Society, Amsterdam 1996; 4.5.3: Image Pattern Analysis. pp. 1163-1165.
Pozar, David M. et al., Microstrip Antennas—The Analysis and Design of Microstrip Antennas and Arrays, 1995, Institute of Electrical and Electronic Engineers, Inc, p. ix and 3.
Puente, J. Ajnguera, J. Romeu, C. Borja, M. Navarro and J. Soler, Fractal-Shaped Antennas and their Application to GSM 900/1800, AP2000 Millenium Conference on Antennas and Propagation, Davos, Apr. 2000.
Rouvier, S. et al. Fractal Análisis of Bidimensional Profiles and Application to Electromagnetic Scattering from Soils. 1996 IEEE, pp. 2167-2169.
Russell D.A.; Hanson J.D.; Ott E.: Dimension of strange attractors. Physical Review Lettes vol. 45, No. 14, Oct. 6, 1980, USA, pp. 1175-1178.
Sarkar, Nirupam et al., An Efficient Differential Box-Counting Approach to Computer Fractal Dimension of Image. IEEE Transactions on Systems, Man and Cybernetics, vol. 24, No. 1, Jan. 1994, pp. 115-120.
So P.; Barreto E.B.; Hunt B.R.: Box-counting dimension without boxes: Computing D0 from average expansion rates, Physical Review E vol. 60, No. 1, Jul. 1999, USA, pp. 378-385.
Software to compute box-counting dimension (Internet: http://www.sewanee.edu/physics/PHYSICS123/BOX%20COUNTING%20DIMENSION.html).
Tang, Y, et al., The Application of Fractal Analysis to Feature Extraction, IEEE, 1999, pp. 875-879.
C. Puente et al., "Small But Long Koch Fractal Monopole", Electronics Letters, Jan. 8, 1998, vol. 34, No. 1, pp. 9-10.
Carles Puente Baliarda et al., "The Koch Monopole: A Small Fractal Antenna", IEEE Transactions on Antennas and Propagation, vol. 48, No. 11, Nov. 2000, pp. 1773-1781.
Nathan Cohen, "Fractal Antenna Applications in Wireless Telecommunications", IEEE, 1997, pp. 43-49.
C. Puente et al., "Multiband Properties of a Fractal Tree Antenna Generated by Electrochemical Deposition", Electronics Letters, Dec. 5, 1996, vol. 32, No. 25, pp. 2298-2299.
Sim, "An Internal Triple-band antenna for PCS/IMT-2000/Bluetooth Applications", IEEE Antennas and Wireless Propagation Letters, 2004, vol. 3.
Cohen, N. Fractal antenna applications in wireless telecommunications, Professional Program Proceedings, Electronics Industries Forum of New England, May 1997.
Handbook of antennas in wireless communications, CRC Press, 2002.
Wong, Planar antennas for wireless communications, Wiley Interscience, 2003.
Wong, Planar antennas for wireless communications, John Wiley & Sons, 2003.
Sim, An internal triple-band antenna for PCS/IMT-2000/Bluetooth applications, IEEE Antennas and Wireless Propagation Letters, 2004, vol. 3.
Puente, Fractal antennas, Universitat Politècnica de Catalunya, 1997.
Puente, Multiband fractal antennas and arrays, Fractals engineering—from theory to industrial applications, 1994.
Nakano et al. Realization of dual-frequency and wide-band VSWR performances using normal-mode helical and inverted-F antennas, IEEE Transactions on Antennas and Propagation, 1998, vol. 46, No. 6.
Morishita et al., Design concept of antennas for small mobile terminals and the future perspective, IEEE Antennas and Propagation Magazine, 2002.
Dou et al, Small broadband stacked planar monopole, Willey Interscience, 2000.
Strugatsky, Multimode multiband antenna. tactical communications: Technology in transition. Proceedings of the tactical communications conference, 1992.
Szkipala, Fracta antennas, TEAT, 2001.
Teng , P. L. ; Wong , K. L. , Planar monopole folded into a compact structure for very-low-profile multiband mobile-phone antenna, Microwave and optical technology letters, Apr. 5, 2002.
*Downunder Wireless LLC, Plaintiff*, v. *HTC Corp; LG Electronics; Motorola Inc.; Nokia Corp.; Pantech Wireless Inc.; Personal Communications Devices LLC; Sharp Electronics Corp; and Sony Ericsson Mobile Communications (USA) Inc., Defendants*. Civil action No. 2:09-cv-206. Jury trial requested. Filed Jun. 29, 2009.
Shnitkin, "Analysis of Log-Periodic Folded Dipole Array" (Sep. 1992).
Sinclair, "Theory of Models of Electromagnetic Systems," Proceedings of the IRE, Nov. 1948.
Snow, W. L., et al. "Ku-Band Planar Spiral Antenna," The Nineteenth Symposium on The USAF Antenna Research and Development Program, Oct. 14-16, 1969.
Snow, W. L., "UHF Crossed-Slot Antenna and Applications," The Thirteenth Symposium on The USAF Antenna Research and Development Program, Oct. 14-18, 1963.
Soler, J., Romeu, J., "Dual-band Sierpinski fractal monopole antenna," IEEE Antennas and Propagation Society International Symposium, 2000, vol. 3, pp. 1712-1715.
Song, C.T.P., Hall, P.T., Ghafouri-Shiraz, H. and Wake, D., "Fractal Stacked Monopole With Very Wide Bandwidth," Electronics Letters, 35, 12, Jun. 10, 1999.
Stang, Abstracts of the 12th Annual Symposium (Oct. 16-19, 1962).
Stang, Paul F., "Balanced Flush Mounted Log-Periodic Antenna for Aerospace Vehicles," Twelfth Annual Symposium on USAF Antenna Research and Development, vol. 1; Oct. 16-19, 1962.
Stutzman, "Antenna Theory and Design," 2nd ed., 1998.
Taga, Tokio and Tsunekawa, Kouichi, "Performance Analysis of a Built-In Planar Inverted F Antenna for 800 MHz Band Portable Radio Units," IEEE Journal on Selected Areas in Communications, vol. SAC-5, No. 5, Jun. 1987.
Tanner, Robert L., et al., "Electronic Counter Measure Antennas for a Modern Electronic Reconnaissance Aircraft," The Fourth Symposium on The USAF Antenna Research and Development Program, Oct. 17-21, 1954.

Teeter, W. L. and Bushore, K. R., "A Variable-Ratio Microwave Power Divider and Multiplexer," IRE Transactions on Microwave Theory and Techniques, 5, 4, Oct. 1957.
Teng, Pey-Ling and Wong, Kin-Lu, "Planar Monopole Folded Into A Compact Structure For Very Low-Profile Multiband Mobile-Phone Antenna," Microwave and Optical Technology Letters, vol. 33, No. 1. (Apr. 5, 2002).
Terman, F. E., Radio Engineering, New York, McGraw-Hill Book Company, 1947.
The Glen L. Martin Company, "Antennas for USAF B-57 Series Bombers" The Second Symposium on the USAF Antenna Research and Development Program, Oct. 19-23, 1952.
Turner and Richard, "Development of an Electrically Small Broadband Antenna," presented at the Eightennth Symposium on The USAF Antenna Research and Development Program, Oct. 15-17, 1968.
Turner, "Broadband Passive Electrically Small Antennas for TV Application," presented at the Proceedings of the 1977 Antenna Applications Sympsoium on Apr. 27-29, 1977 at Robert Allerton Park at the University of Illinois.
Virga, "Low-Profile Enhanced Bandwidth PIFA Antennas for Wireless Communications Packaging," IEEE Transactions on Microwave Theory and Techniques, vol. 45, No. 10 (Oct. 1997).
Volakis, J., Antenna Engineering Handbook, pp. 39-7 to 39-15 (4th ed. 2007).
Walker, G.J. and James, J.R., "Fractal Volume Antennas," Electronics Letters, 34, 16, Aug. 6, 1998.
Wall, H. et al. "Communications Antennas for Mercury Space Capsule," The Eleventh Symposium on the USAF Antenna Research and Development Program, Oct. 16-20, 1961.
Watanbe, T., Furutani, K., Nakajima, N. and Mandai, H., "Antenna Switch Duplexer for Dualband Phone (GSM/DCS) Using LTCC Multilayer Technology," IEEE MTT-S International Microwave Symposium Digest, 1, Jun. 13-19, 1999.
Weeks, W. L., Antenna Engineering, New York, McGraw-Hill Book Company, 1968.
Weeks, W. L., Electromagnetic Theory for Engineering Applications, New York John Wiley & Sons, 1964.
Wegner, E. D., B-70 Antenna System, Thirteenth Annual Symposium on USAF Antenna Research and Development, 1963.
Wheeler, H.A., "The Radian Sphere Around a Small Antenna," IEEE Proc., vol. 47, pp. 1325-1331 (Aug. 1959).
Wheeler, H. A., "Fundamental Limitation of Small Antennas," Proceedings of the I.R.E. (Dec. 1947).
Wheeler, H.A., "Small Antennas," The Twenty-Third Symposium on The USAF Antenna Research and Development Program, Oct. 10-12, 1973.
Wong, K.-L. and Yang, K.-P., "Modified planar inverted F antenna," Electronics Letters, 34, 1, Jan. 8, 1998.
Wong, Kin-Lu and Sze, Jia-Yi, "Dual-Frequency Slotted Rectangular Microstrip Antenna," Electronics Letters, vol. 34, No. 14, Jul. 9, 1998.
Wong et al., "Broadband Microstrip Antennas With Integrated Reactive Loading," Microwave Conference, 1999 Asia Pacific, Nov. 1999, vol. 2, pp. 352-354.
McDowell, E. P., "High Speed Aircraft Antenna Problems and Some Specif Solutions for MX-1554," The Second Symposium on the USAF Antenna Research and Development Program, Oct. 19-23, 1952.
McDowell, E. P., "Flush Mounted X-Band Beacon Antennas for Aircraft," The Third Symposium on The USAF Antenna Research and Development Program, Oct. 18-22, 1953.
Parker, "Convoluted array elements and reduced size unit cells for frequency selective surfaces," IEE Proceedings—H Antennas and Microwave Propagation, vol. 138, No. 1, Feb. 1991, p. 19-22.
Yang and Wang, "Compact Dual-Frequency Operation of Rectangular Microstrip Antennas," IEEE, pp. 1652-1655 (1999).
Adcock, M. D., "New Type Feed for High Speed Conical Scanning," The Second Symposium of the USAF Antenna Research and Development Program, Oct. 19-23, 1952.
Andersen, J. B., "Low- and Medium-Gain Microwave Antennas," in A. W. Rudge, K. Milne, A. D. Olver, and P. Knight (eds.), The Handbook of Antenna Design, vols. 1 and 2, London, Peter Peregrinus Ltd., 1986.
Azadegan and Sarabandi, Design and Miniature Slot Antennas, IEEE Antennas and Propagation Society International Symposium, 2001 Digest, vol. 4 pp. 565-568 (Jul. 8, 2001).
Balanis, "Antenna Theory: Analysis and Design," John Wiley & Sons: 1997.
Barrick, William, "A Helical Resonator Antenna Diplexer," The Tenth Sympsoium on The USAF Antenna Research and Development Program, Oct. 3-7, 1960.
Batson, D. et al., "VHF Unfurlable Turnstile Antennas," The Nineteenth Symposium on The USAF Antenna Research and Development Program, Oct. 14-16, 1969.
Besthorn, J.W., "1.0-to 21.0-GHz Log-Periodic Dipole Antenna," presented at the Eighteenth Annual Symposium on The USAF Antenna Research and Development Program, Oct. 15-17, 1968.
Blackband, W. T., "Coaxial Transmission Lines and Components," in A. W. Rudge, K. Milne, A. D. Olver, and P. Knight (eds.), The Handbook of Antenna Design, vols. 1 and 2, London, Peter Peregrinus Ltd., 1986.
Bokhari, S.A., Zurcher, J.F., Mosig, J.R. and Gardiol, F. E., "A Small Microstrip Patch Antenna with a Convenient Tuning Option," IEEE Transactions on Antennas and Propagation, vol. 44, No. 11, Nov. 1996.
"Broadband Passive Electrically Small Antennas for TV Application," presented at the Proceedings of the 1977 Antenna Applications Symposium on Apr. 27-29, 1977 at Robert Allerton Park at the University of Illinois.
Brown, A. R. and Rebeiz, G. M. "A High-Performance Integrated K-Band Diplexer," IEEE Transactions on Microwave Theory and Techniques, 47, 8, Aug. 1999.
Burnett, G. F., "Antenna Installations on Super Constellation Airborne Early Warning and Control Aircraft," The Fourth Symposium on The USAF Antenna Research and Development Program, Oct. 17-21, 1954.
Burshman, F. W. et al., "The Boeing B-52 All Flush Antenna System," The Fifth Symposium on The USAF Antenna Research and Development Program, Oct. 16-20, 1955.
Campi, M., "Design of Microstrip Linear Antennas," 1981 Antenna Applications Symposium, Sep. 23-25, 1981.
Carver, Keith R. and Mink, James W., "Microstrip Antenna Technology," IEEE Transactions on Antennas and Propagation, AP-29, Jan. 1, 1981, pp. 2-24.
Chen, "Dual Frequency Microstrip Antenna with Embedded Reactive Loading," Microwave and Optical Technology Letters, vol. 23, No. 3, Nov. 5, 1999.
Chen, "Square-Ring Microstrip Antenna with a Cross Strip for Compact Circular Polarization Operation", IEEE Transactions on Antennas and Propagation, vol. 47, No. 10, Oct. 1999.
Chen, M. H., Tung, T. X. and Yodokawa, T. "A Compact EHF/SHF Dual Frequency Antenna," IEEE International Symposium on Antennas and Propagation Digest, 4, May 7-11, 1990.
Chiba, N., Amano, T. and Iwasaki, H., "Dual-Frequency Planar Antenna for Handsets," Electronics Letters, 34, 35, Dec. 10, 1998, pp. 2362-2363.
Cohen, "NEC4 Analysis of Fractalized Monofilar Helix in a Axial Mode," Conference Proceedings vol. II for the 14th Annual Review of Prgoress in Applied Computational Electromagnetics at the Naval Postgraduate School of Montery, CA, Mar. 16-20, 1998.
Cohen, Nathan, "Fractal Element Antennas," Journal of Electronic Defense, Jul. 1997.
Cohn, S. B., "Flush Airborne Radar Antennas," The Third Symposium on The USAF Antenna Research and Development Program, Oct. 18-22, 1953.
Collier and Shnitkin, "Summary of The Monopole as a Wideband Array Antenna Element," presented at the 1993 Antenna Applications Symposium on Sep. 23, 1993.
Contreras, "Fractal Miniature Antenna" UPC Baix Llobregat Polytechnic University Project Research (Sep. 1997).

Daniel, Kumar, "Rectangular Microstrip Antennas with stub along the non-radiating edge for Dual Band Operation," IEEE Antennas and Propagation Society International Symposium 1995 Digest, vol. 4, p. 2136-2139.
Deschamps, G. et al., "Microstrip Microwave Antenna," The Third Symposium on The USAF Antenna Research and Development Program, Oct. 18-22, 1953.
Dickstein, Harold D., "Antenna System for a Ground Passive Electronic Reconnaissance Facility," The Eighth Symposium on The USAF Antenna Research and Development Program, Oct. 20-24, 1958.
DuHamel R. H. and Isbell, D. E., "Broadband Logarithmically Periodic Antenna Structures," IRE International Convention Record, 5, Part 1, Mar. 1957, pp. 119-128.
Du Plessis, "Tuning Stubs for Microstrip Patch Antennas," IEEE Antennas and Propagation Magazine, vol. 36, issue 6, pp. 52-56, 1993.
Dyson, J.D., "The Non-Planar Equiangular Spiral Antenna," The Eighth Symposium on The USAF Antenna Research and Development Program, Oct. 20-24, 1958.
Dyson, J.D., "The Equiangular Spiral Antenna," The Fifth Symposium on The USAF Antenna Research and Development Program, Oct. 16-20, 1955.
Ellis, A.R., "Airborne U-H-F Antenna Pattern Improvements," The Third Symposium on The USAF Antenna Research and Development Program, Oct. 18-22, 1953.
Esteban, J. and Rebollar, J. M., "Design and Optimization of a Compact Ka-Band Antenna Diplexer," IEEE International Symposium on Antennas and Propagation Digest, 1, Jun. 18-23, 1995, pp. 148-151.
ETSI, "Global System for Mobile Communications: Digital cellular telecommunications system (Phase 2); Mobile Station (MS) conformance specification; Conformance specification (GSM 11.10-1)," European Telecommunication Standard, Mar. 1996.
ETSI, "Global System for Mobile Communications: Digital cellular telecommunications system (Phase 2+); Abbreviations and acronyms (GSM 01.04)," GSM Technical Specification, Version 5.0.0, Mar. 1996.
ETSI, "Global System for Mobile Communications: Digital cellular telecommunications system (Phase 2); Types of Mobile Stations (MS) (GSM 02.06)," European Telecommunication Standard, 3rd ed., May 1996.
ETSI, "Global System for Mobiel Communications: Digital cellular telecommunications system (Phase 2+); radio transmission reception (GSM 05.05)," GSM Technical Specification, Version 5.2.0, Jul. 1996.
ETSI, "Global System for Mobile Communications: Digital cellular telecommunications system (Phase 2); Mobile Station (MS) conformance specification; Part 1: Conformance specification (GSM 11.10-1 version 4.21.1)," European Telecommunication Standard, 8th ed., Aug. 1998.
Fenwick, R., "A New Class of Electrically Small Antennas," Presented at the Fourteenth Annual Symposium on USAF Antenna Research and Development, presented Oct. 6-8, 1964.
Ferris, J. E. et al., "A Status report of an Azimuth and Elevation Direction Finder" The Eighteenth Symposium on The USAF Antenna Research and Development Program, Oct. 15-17, 1968.
Force, R.D., et al. "Synthesis of Multilayer Walls for Radomes of Aerospace Vehicles," The Seventeenth Symposium on The USAF Antenna Research and Development Program, Nov. 14-17, 1967.
Photos of Fractus Panel 01 product (at least as early as 1998).
Photos of Fractus MSPK product (at least as early as 1998).
Gilbert, R., Structurally-Integrated Optically-Reconfigurable Antenna Array 1995 Antenna Applications Symposium, Sep. 20-22, 1995.
Gillespie, Edmond S., "Glide Slope Antenna in the Nose Radome of the F104A and B," The Seventh Symposium on the USAF Antenna Research and Development Program, Oct. 21-25, 1957.
Gray, "Electronically Steerable Yagi-Uda Microstrip Patch Antenna," IEEE Transactions on Antennas and Propagation, vol. 46, No. 5, May 1998.
Greiser, J. W. and Brown, G. S., "A 500:1 Scale Model of Warla—A Wide Aperture Radio Location Array," presented at The Thirteenth Symposium on the USAF Antenna Research and Development Program on Oct. 14-18, 1963 at the University of Illinois Antenna Laboratory in Urbana, Illinois.
Guo, Y.X. et al., "Double U-slot rectangular patch antenna," Electronics Letters, vol. 34, No. 19, pp. 1805-1806 (Sep. 17, 1998).
Gupta, K.C. "Broadbanding Techniques for Microstrip Patch Antennas—A Review," Antenna Applications Symposium, Sep. 21-23, 1988.
Gupta, Microstrip Antenna Design, Norwood, MA, Artech House 1988.
Ali, M. et al., "A Triple-Band Internal Antenna for Mobile Hand-held Terminals," IEEE, 2002.
Deng, A T-Strip Loaded Rectangular Microstrip Patch Antenna for Dual-Frequency Operation IEEE Antennas and Propagation Society International Symposium, Aug. 1999, vol. 2, pp. 940-943.
Hagstrom, P., "Novel Ceramic Antenna Filters for GSM/DECT and GSM/PCN Network Terminals," The 8th IEEE International Symposium on Personal, Indoor, and Mobile Radio Communications, vol. 3, Sep. 1-4, 1997.
Halloran, T.W. et al. "A Dual Channel VHF Telemtry Antenna System for Re-Entry Vehicle Applications," The Eleventh Symposium on The USAF Antenna Research and Development Program, Oct. 16-20, 1961.
Hikata, M., Shibagaki, N., Asai, K., Sakiyama, K. and Sumioka, A., "New Miniature SAW Antenna Duplexer Used in GHz-Band Digital Mobile Cellular radios," 1995 IEEE Ultrasonics Symposium, 1, Nov. 7-10, 1995.
Hikita, M., Ishida, Y., Tabuchi, T. and Kurosawa, K., "Miniature SAW Antenna Duplexer for 800-MHz Portable Telephone Used in Cellular Radio Systems," IEEE Transactions on Microwave Theory and Techniques, 36, 6, Jun. 1988.
Hill, J.E. et al., "An Integrated Strip-Transmission-Line Antenna System for JBand," The Twenty-Third Symposium on The USAF Antenna Research and Development Program, Oct. 10-12, 1973.
Hofer, D.A., Kesler, O.B., and Loyet, L.L., "A Compact Multi-Polarized broadband Antenna," Proceedings of the 1989 Antenna Applications Symposium, Sep. 20-22, 1989.
Holtum, A. G., "A Dual Freuqncy Dual Polarized Microwave Antenna," The Sixteenth Symposium on The USAF Antenna Research and Development Program, Oct. 11-13, 1966.
Holzschuh, D.L., "Hardened Antennas for Atlas and Titan Missile Site Communications," The Thirteenth Symposium on The USAF Antenna Research and Development Program, Oct. 14-18, 1963.
Hong, "Compact microwave elliptic function filter using novel microstrip meander open-loop resonators" (Mar. 14, 1996).
Hong and Lancaster, Recent Advances in Microstrip Filters for Communications and Other Applications, IEEE, pp. 2/1-2/6 (1997).
Huynh, T. and Lee, K.F., "Single-layer single-patch wideband microstrip antenna," Electronics Letters, 31, 16, Aug. 3, 1995.
Hyneman, R.F., et al., "Homing Antennas for Aircraft (450-2500 MC)," The Fifth Symposium on The USAF Antenna Research and Development Program, Oct. 16-20, 1955.
IEEE, IEEE Standard Definitiosn of Terms for Antennas, IEEE Std. 145-1983, New York, IEEE, 1983.
Ikata, O., Satoh, Y., Uchishiba, H., taniguchi, H., Hirasawa, N., Hashimoto, K. and Ohmori, H., "Development of Small Antenna Duplexer Using SAW Filters for Handheld Phones," 1993 IEEE Ultrasonics Symposium, 1, Oct. 31-Nov. 3, 1993.
Ingerson, Paul G. and Mayes, Paul E., "Asymmetrical Feeders for Log-Periodic Antennas," The Seventeenth Symposium On The USAF Antenna Research and Development Program (Nov. 14-17, 1967).
Isbell, D.E., "Non-Planar Logarithmically Periodic Antenna Structures," Seventh Annual Symposium on USAF Antenna Research and Development Program, Oct. 21-25, 1957.
Isbell, D.E., "Multiple Terminal Log-Periodic Antennas," Eighth Annual Symposium on The USAF Antenna research and Development Program, Oct. 20-24, 1958.
Ishikawa, Y., Hattori, J., Andoh, M. and Nishikawa, T., "800 MHz High Power Bandpass Filter Using TM Dual Mode Dielectric Resonators," 21st European Microwave Conference, vol. 2, Sep. 9-12, 1991.
James and Hall, "Handbook of Microstrip Antennas", vol. 1, 1989.

Jones, Howard S., "Conformal and Small Antenna Designs," Proceedings of the 1981 Antenna Applications Symposium, Aug. 1981.
Kraus, John D., Antennas, Second Edition, New York, McGraw-Hill Book Company, 1988.
Kuhlman, E.A., "A Directional Flush Mounted UHF Communications Antenna for High Performance Jet Aircraft for the 225-400 MC Frequency Range," The Fifth Symposium on The USAF Antenna Research and Develpment Program, Oct. 16-20, 1955.
Kumar, G. and Gupta, K., "Directly Coupled Multiple Resonator Wide-Band Microstrip Antennas," IEEE Transactions on Antennas and Propagation, AP-29, 1, Jun. 1985, pp. 588-593.
Kumar, "Nonradiating Edges and Four Edges Gap-Coupled Multiple Resonator Broad-Band Microstrip Antenna," IEEE Transactions on Antenna and Propagation, Feb. 1985.
Kuo, Sam, "Frequency-Independent Log-Periodic Antenna Arrays With Increased Directivity and Gain," Twenty-First Annual Symposium on USAF Antenna Research and Development, Oct. 12-14, 1971.
Kurpis, G. P., The New IEEE Standard Dictionary of Electrical and Electronics Terms, Fifth Edition, New York, IEEE, 1993.
Kutter, "Fractal Antenna Design" (Honors Thesis, University of Dayton, 1996).
Lancaster, et al., "Miniature Superconducting Filters" IEEE Transactions on Microwave Theory and Techniques (Jul. 1996).
Larson, III, J. D., Ruby, R., Bradley, P. and Oshmyansky, Y., "A BAW Antenna Duplexer for the 1900 MHz PCS Band," 1999 IEEE Ultrasonics Symposium, 2, Oct. 17-20, 1999.
Lee, J.C., "Analysis of Differential Line Length Diplexers and Long-Stub Filters," The Twenty-First Symposium on the USAF Antenna Research and Development Program, Oct. 12-14, 1971.
Liu, "Dual-Frequency Planar Inverted-F Antenna," IEEE Transactions on Antennas and Propagation, vol. 45, No. 10, Oct. 1997.
D. Liu, "a Multi-branch monopole antenna for dual-band cellular applications," IEEE Antennas and Propagation society international symposium and URSI Radio science Meeting proceedings, vol. 3, pp. 1578-1581, Jul. 11-16,1999, USA.
Lo, Y. T., et al. "Theory and Experiment on Microstrip Antennas," 1978 Antenna Applications Symposium, Sep. 20-22, 1978.
Locus, Stanley S., "Antenna Design for High Performance Missile Environment," The Fifth Symposium on the USAF Antenna Research and Development Program, October 16-20, 1955.
Lu, Jui-Han & Wong, Kin-Lu, "Dual-Frequency Rectangular Microstrip Antenna with Embedded Spur Lines and Integrated Reactive Loading," Microwave & Optical Tech. Letters, 21, 4, May 20, 1999.
Lu and Wong, "Slot-loaded, Meandered rectangular microstrip antenna with compact dual-frequency operation," Electronics Letters, vol. 34, No. 11, May 28, 1998.
Lu and Wong, "Single-feed dual-frequency equilateral-triangular microstrip antenna with pair of spur lines," Electronics Letters, vol. 34, No. 12, June 11, 1998.
Lu, "Single-Feed Dual-Frequency Rectangular Microstrip Antenna," IEEE Antennas and Propagation Society International Symposium, 2000, vol. 4, pp. 2192-2195.
Lu et al., "Novel Dual-Frequency and Broad-Band Designs of Slot-Loaded Equilateral Triangular Microstrip Antennas," Microwave and Optical Technology Letters, vol. 48, No. 7 (Jul. 2000, received Jul. 27, 1998).
Maci, S. and Gentili, G. B., "Dual-Frequency Patch Antennas," IEEE Antennas and Propagation Magazine, 39, 6, Dec. 1997.
Maci et al., "Dual-band Slot-loaded patch antenna", IEE Proc.-Microw. Antennas Propag., vol. 142, No. 3, pp. 225-232 (Jun. 1995).
Manteuffel, D. et al., Design Considerations for Integrated Mobile Phone Antennas, 11th Int'l Conference on Antennas & Propagation Conference Publication No. 480, pp. 252-256 (Apr. 17-20, 2001).
Martin, W.R., "Flush VOR Antenna for C-121C Aircraft," The Second Symposium on the USAF Antenna Research and Development Program, Oct. 19-23, 1952.
Martin, R.W., et al. "An Unfurlable, High-Gain Log-Periodic Antenna for Space Use" The Seventeenth Symposium on The USAF Antenna Research and Development Program, Nov. 14-17, 1967.
May, "Aerial Magic," New Scientist, pp. 28-30 (Jan. 31, 1998).
Mayes, P.E., et al. "Multi-Arm Logarithmic Spiral Antennas," The Tenth Symposium on The USAF Antenna Research and Development Program, Oct. 3-7, 1960.
Mayes, P.E., et al. "High Gain Log-Periodic Antennas," The Tenth Symposium on The USAF Antenna Research and Development Program, Oct. 3-7, 1960.
Mayes, P., et al., "Some Broadband, Low-Profile Antennas," 1985 Antenna Applications Symposium, Sep. 18-20, 1985.
McSpadden, J. 0., Lu, Fan and Chang, Kai, "Design and Experiments of a High-Conversion-Efficiency 5.8-GHz Rectenna," IEEE Transactions on Microwave Theory and Techniques, 46, 12, part 1, Dec. 1998.
Misra and Chowdhury, "Study of Impedance and Radiation Properties of a Concentric Microstrip Triangular-Ring Antenna and Its Modeling Techniques Using FDTD Method," IEEE Transactions on Antennas and Propagation, vol. 46, No. 4, Apr. 1998.
Misra, Ita et al., "Experimental Investigations on the Impedance and Radiation Properties of a Three-Element Concentric Microstrip Antenna," Microwave and Optical Technology Letters, vol. 11, No. 2, Feb. 5, 1996.
Moheb, H., Robinson, C. And Kijesky, J., "Design & Development of Co-Polarized Ku-Band Ground Terminal System for Very Small Aperture Terminal (VSAT) Application," IEEE International Symposium on Antennas and Propagation Digest, 3, Jul. 11-16, 1999.
Munson, R. et al. "Conformal Microstrip Array for a Parabolic Dish," the Twenty-Third Symposium on the USAF Antenna Research and Development Program, October 10-12, 1973.
Munson, R., "Microstrip Phased Array Antennas," The Twenty-Second Symposium on the USAF Antenna Research and Development Program, Oct. 11-13, 1972.
Munson, R. E., "Conformal Microstrip Antennas and Microstrip Phased Arrays," IEEE Trans. Antennas Propagat., vol. AP-22, p. 74, Jan. 1974.
Mushiake, Yasuto, Self-Complementary Antennas: Principle of Self-Complementarity for Constant Impedance, London, Springer-Verlag London Limited, 1996.
Nadan, T. Le, Coupez, J. P., Toutain, S. and Person, C., "Integration of an Antenna/Fitter Device, Using a Multi-Layer, Multi-Technology Process," 28th European Microwave Conference, vol. 1, Oct. 1998.
Nagai, Kiyoshi, Mikuni, Yoshihiko and Iwasaki, Hisao, "A Mobile Radio Antenna System Having a Self-Diplexing Function," IEEE Transactions on Vehicular Technology, 28, 4, Nov. 1979.
Nakano and Vichien, "Dual-Frequency Square Patch Antenna with Rectangular Notch," Electronics Letters, vol. 25 No. 16, Aug. 3, 1989.
Nishikawa, T., Ishikawa, Y., Hattori, J. and Wakino, K. "Dielectric Receiving Filter with Sharp Stopband Using an Active Feedback Resonator Method for Cellular Base Stations," IEEE Transactions on Microwave Theory and Techniques, 37, 12, Dec. 1989.
Photos of Nokia 3210 product (1999 or earlier).
Photos of Nokia 8210 product (1999 or earlier).
Photos of Nokia 8260 product (1999 or earlier).
Photos of Nokia 8265 product (1999 or earlier).
Photos of Nokia 8810 product (1998 or earlier).
Photos of Nokia 8850 product (1999 or earlier).
Photos of Nokia 8860 product (1999 or earlier).
Omar et al., "A New Broad-band Dual-Frequency Coplanar Waveguide Fed Slot- Antenna," IEEE, 1999.
Ou, J. D. et al., "an Analysis of Annular, Annular Sector, and Circular Sector Microstrip Antennas," 1981 Antenna Applications Symposium, Sep. 23-25, 1981.
Pan, S. and Hsu, W., "Single-Feed Dual-Frequency Microstrip Antenna with Two Patches," IEEE, 1999.
Paschen, D.A. & Mayes, P.E., "Structural Stropband Elimination with the Monopole-Slot Antenna," 1982 Antenna Applications Symposium, Sep. 22-24, 1982.
Paschen, D.A., "Broadband Microstrip Matching Techniques," 1983 Antenna Applications Symposium, Sep. 21-23, 1983.
Phelan, H.R., "A Wide-Band Parallel-Connected Balun," The Eighteenth Symposium on The USAF Antenna Research and Development Program, Oct. 15-17, 1968.
Pozar, David M., Microwave Engineering, Reading, MA, Addison-Wesley, 1990.

Pribetich, "QuasiFractal Planar Microstrip Resonators for Microwave Circuits," Microwave and Optical Technology Letters, vol. 21, No. 6 (Jun. 20, 1999).
Puente, C., Romeu, J., Pous, R., Garcia, X. and Benitez, F., "Fractal Multiband Antenna Based on the Sierpinski Gasket," Electronics Letters, 32, 1, Jan. 4, 1996.
Puente, C., Romeu, J., Bartoleme, R. and Pous, R., "Perturbation of the Sierpinski Antenna to Allocate Operating Bands," Electronics Letters, 32, 24, Nov. 21, 1996.
Puente-Baliarda, "On the Behavior of the Sierpinski Multiband Fractal Antenna," IEEE Transactions on Antennas and Propagation, vol. 46, No. 4 (Apr. 1998).
Rensh, "Broadband Microstrip Antenna," Proceedings of the Moscow International Conference on Antenna Theory and Tech. 1998, vol. 28, pp. 420-423 (Sep. 22, 1998).
Photos of RIM 857 product (at least as early as 2000) and SAR report from FCC.
Photos of RIM 957 product (at least as early as 2000).
Rockwell B-1B Lancer <http://home.att.neti~jbaugher2/newb1_2.html> (last visited Feb. 17, 2010).
Rosa, J. et al., "A Wide Angle Circularly Polarized Omnidirectional Array Antenna," The Eighteenth Symposium on The USAF Antenna Research and Development Program, Oct. 15-17, 1968.
Rotman, W., "Problems Encountered in the Design of Flush-Mounted Antennas for High Speed Aircraft," The Second Symposium on the USAF Antenna Research and Development Program, Oct. 19-23, 1952.
Rowell and Murch, "A Compact PIFA Suitable for Dual-Frequency 900/1800-MHz Operation," IEEE Transactions on Antennas and Propagation, vol. 46, No. 4, Apr. 1998.
Rowell, "A Capacitating Loaded PIFA for Compact Mobile Telephone Handsets," IEEE Transactions on Antennas and Propagation, 45, 5, May 1997.
Rudge, A. W., Milne, K., Olver, A. D. And Knight P., (eds.), The Handbook of Antenna Design, vols. 1 and 2, London, Peter Peregrinus Ltd., 1986.
Rumsey, Victory H., Frequency Independent Antennas, New York, Academic Press, 1966. Stang, Abstracts of the 12th Annual Symposium (Oct. 16-19, 1962).
Sanchez-Hernandez, D. & Robertson, I. D., "Analysis and Design of a Dual-Band Circularly Polarized Microstrip Patch Antenna," IEEE Transactions on Antennas and Propagation, 43, 2, Feb. 1995. The Glen L. martin Company, "antennas for USAF B-57 Series Bombers" The Second Symposium on the USAF Antenna Research and Development Program, Oct. 19-23, 1952.
Sandlin, B.S., Terzuoli, A.J., "a Genetic Antenna Design for Improved Radiation Over Earth," Program for 1997 Antenna Applications Symposium (Allerton Conference Proceedings), Sep. 17-18, 1997.
Saunders, Simon R., Antennas and Propagation for Wireless Communication Systems, Chichester, John Wiley & Sons, Ltd., 1999.
Scharfman, W., et al. "Telemetry Antennas for High-Altitude Missiles," The Eighth Symposium on the USAF Antenna Research and Development Program, Oct. 20-24, 1958.
Schaubert, Chang and Wunsch, "Measurement of Phased Array Performance at Arbitrary Scan Angles," presented at the 1994 Antenna Applications Symposium on Sep. 21, 1994.
Seavy, J. et al., "C-Band Paste-On and Floating Ring Reflector Antennas," The Twenty-Third Symposium on the USAF Antenna Research and Development Program, Oct. 10-12, 1973.
Shenoy, A., Chalmers, H., Carpenter, E., Bonetti, R. and Wong, A., "Notebook Satcom Terminal Technology Development," Tenth International Conference on Digital Satellite Communications, May 15-19, 1995.
Shibagaki, N. Sakiyama, K. and Hikita, M., "Saw Antenna Duplexer Module Using Saw-Resonator-Coupled Filter for PCN System," 1998 IEEE Ultrasonics Symposium, 1, Oct. 5-8, 1998.
Shibagaki, N., Sakiyama, K. and Hikita, M. "Miniature Saw Antenna Duplexer Module for 1.9 GHz PCN Systems Using Saw-Resonator-Coupled Filters," 1998 IEEE Ultrasonics Symposium, 2, Jun. 7-12, 1998.
Shimoda, R.Y., "A Variable Impedance Ratio Printed Circuit Balun," 1979 Antenna Applications Symposium, Sep. 26-18, 1979.
Jaschke , H. ; Ribbe , J. ; Von Walter , S. Summons to attend oral proceedings in connection with the European patent application No. 02808265.9 dated on Jun. 25, 2010. European Patent Office—EPO, 2010.
Carpintero , F. Response to the summons to attend oral proceedings of European patent application No. 02808256.9 dated on Oct. 21, 2010. Herrero & Asociados, 2010.
Mithani , S. Amendment in response to non-final office action dated Aug. 23, 2006 of U.S. Appl. No. 11/124,768.
Mithani , S. Amendment in response to non-final office action dated Feb. 6, 2008 of U.S. Appl. No. 11/713,324.
Mithani , S. Amendment in response to non-final office action dated Oct. 1, 2008 of U.S. Appl. No. 12/055,748.
Mithani , S. Amendment in response to non-final office action dated on Dec. 28, 2007 of U.S. Appl. No. 11/124,768.
Mithani , S. Amendment in response to the office action dated Feb. 21, 2007 for U.S. Appl. No. 11/124,768.
Ho, Tan. Notice of Allowance of U.S. Appl. No. 11/124,768 dated Aug. 29, 2007. USPTO.
Ho, Tan. Notice of Allowance of U.S. Appl. No. 11/124,768 dated Apr. 7, 2008. USPTO.
Ho, Tan. Notice of Allowance of U.S. Appl. No. 11/124,768 dated on May 18, 2006. USPTO.
Ho, Tan. Notice of Allowance of U.S. Appl. No. 11/713,324 dated on May 14, 2008. USPTO.
Ho, Tan. Notice of Allowance of U.S. Appl. No. 12/055,748 dated Nov. 20, 2009. USPTO.
Ho, Tan. Notice of Allowance of U.S. Appl. No. 12/055,748 dated Aug. 12, 2009. USPTO.
Ho, Tan. Office Action of U.S. Appl. No. 11/124,768 dated on Aug. 23, 2006. USPTO.
Ho, Tan. Office Action of U.S. Appl. No. 11/124,768 dated on Dec. 28, 2007. USPTO.
Ho, Tan, Office Action of U.S. Appl. No. 11/124,768 dated on Feb. 21, 2007. USPTO.
Ho, Tan. Office Action of U.S. Appl. No. 11/713,324 dated on Feb. 6, 2008. USPTO.
Ho, Tan. Office Action of U.S. Appl. No. 12/055,748 dated on May 28, 2009. USPTO.
Ho, Tan. Office Action of U.S. Appl. No. 12/055,748 dated on Oct. 1, 2008. USPTO.
Ho, Tan. Office Action of U.S. Appl. No. 12/652,794 dated on Jun. 23, 2010. USPTO.
Mithani , S. Response to the Office Action dated May 28, 2009 of U.S. Appl. No. 12/055,748. USPTO.
Nguyen , H. Notice of Allowance of U.S. Appl. No. 10/584,442 dated Jun. 6, 2008. USPTO.
Nguyen , H. Office Action of U.S. Appl. No. 10/584,442 dated on Oct. 29, 2007. USPTO.
Robinson , R. Response to Office Action dated Oct. 29, 2007 of U.S. Appl. No. 10/584,442. Winstead.
Declaration of Jeffery D. Baxter—Including Exhibits regarding US patent 7411556 Defendants 20100730.
Dubost, G. Wideband flat dipole and short-circuit microstrip patch elements and arrays. In Handbook of microstrip antennas—Chapter 7. Peter Peregrinus Ltd. James , J. R. ; Hall , P. S. (ed.) 1989.
NA. Nokia 8260—FCC ID GMLNSW-4DX. Apr. 1999.
Rudge, A. W. The handbook of antenna design. Peter Peregrinus, 1986.
Borja, C. ; Puente , C. Iterative network models to predict the performance of Sierpinski fractal antennas and networks. Antennas and Propagation Society International Symposium, 1999.
Campos, O. Study of multiband and miniature fractal antennas. Universitat Politècnica de Catalunya, 1998.
Cristal, E. G. et al. Hairpin-line and hybrid hairpin-line/Half-wave parallel-coupled-line filers. IEEE Transactions on Microwave Theory and Techniques. Nov. 1972.
Hohlfeld, R. G. ; Cohen N. Self-similarity and the geometric requirements for frequency independence in antennae. Fractals, 1999.
Jaggard, D. L. Fractal electrodynamics and modeling. Directions in electromagnetic wave modeling, 1991.
Lee, B. T. Office action for the U.S. Appl. No. 10/181,790 dated on Aug. 27, 2004.

Lee, B. T. Office action for the U.S. Appl. No. 10/181,790 dated on Jun. 2, 2005.
Lee, B. T. Response to office action for the U.S. Appl. No. 10/181,790 dated on Aug. 27, 2004.
Lee, B.T. Office action for the U.S. Appl. No. 10/181,790 dated on Mar. 2, 2005.
Lee, Benny T. Office action for the U.S. Appl. No. 10/181,790 dated on Aug. 4, 2005.
Maiorana, D. Amendment and response to the Office Action dated on Jan. 23, 2004 of U.S. Appl. No. 10/102,568.
Mandelbrot, B. The fractal geometry of nature. Freeman and Company. 1983.
Matthaei, George L. et al. Hairpin-comb filters for HTS and other narrow-band applications. IEEE Transactions on Microwave Theory and Techniques, Aug. 1997.
Matthaei, George L. Microwave filters impedance-matching networks and coupling structures. Artech House. 1980.
Mithani, S. Response to the Office Action dated Mar. 12, 2007 of U.S. Appl. No. 11/021,597.
NA. International preliminary examination report of PCT/EP00/00411. European Patent Office (EPO). Aug. 2002.
NA. Nokia 8290. 2010.
NA. Office action for the Chinese patent application 01823716 dated on Feb. 16, 2007.
NA. Office action for the Chinese patent application 01823716 dated Sep. 21, 2007.
NA. Response to the office action dated on Feb. 16, 2007 for the Chinese patent application 01823716.
Nguyen, H. Notice of Allowance of U.S. Appl. No. 12/347,462 dated on May 18, 2009.
Nguyen, H. Office Action of U.S. Appl. No. 12/347,462 dated on Oct. 28, 2009.
Nguyen, H. Office Action of U.S. Appl. No. 10/182,635 dated Dec. 13, 2004.
Nguyen, H. Notice of Allowance of U.S. Appl. No. 11/110,052 dated on May 30, 2006.
Peitgen, H. ; Jurgens, H. ; Saupe, D. Chaos and Fractals: New frontiers of Science—pp. 8-9.
Rolan Cisneros, E. International Search Report for the PCT patent application ES99/00296. OEPM. Mar. 2001.
Sauer, J. Amendment and response to office action dated Dec. 13, 2004 of U.S. Appl. No. 10/182,635.
Sauer, J. Amendment and response to office action dated Oct. 4, 2004 of U.S. Appl. No. 10/182,635.
Sauer, J. M. Response to the office action from U.S. Appl. No. 10/181,790 dated Mar. 2, 2005.
Sauer, J. M. Response to the Office Action mailed on Jan. 26, 2006 and Advisory Action mailed on Mar. 29, 2006 for the U.S. Appl. No. 10/422,578.
Sauer, J.M. Response to the office action from U.S. Appl. No. 10/181,790 dated Jun. 2, 2005.
Soler, J. ; Romeu, J. ; Puente, C. Mod-P Sierpinski fractal multiband antenna. Antennas and Propagation Society International Symposium, 2000.
Tinker J. A. Response to the office action dated Oct. 30, 2007 of U.S. Appl. No. 11/021,597.
Wimer, M. C. Office Action for the U.S. Appl. No. 10/422,578 dated on Aug. 23, 2007.
Wimer, M. C. Office Action for the U.S. Appl. No. 10/422,578 dated on Jan. 26, 2006.
Wimer, M. C. Office Action for the U.S. Appl. No. 10/422,578 dated on Mar. 12, 2007.
Wimer, M. C. Office action for the U.S. Appl. No. 10/422,578 dated on Mar. 26, 2008.
Wimer, M. C. Office Action for the U.S. Appl. No. 11/021,597 dated on Mar. 12, 2007.
Wimer, M. C. Office Action for U.S. Appl. No. 10/422,578 dated on Jun. 23, 2005.
Wimer, M. Office action of U.S. Appl. No. 11/021,597 dated Oct. 30, 2007.
Zhang, Dawei ; Liang, G.C. ; Shih, C.F. Narrowband lumped element microstrip filters using capacitively loaded inductors. Microwave Symposium Digest, 1995.
Defendants LG Electronics Mobilecomm USA., Inc.'s answer and counterclaim to complaint. LG Electronics Mobilecomm USA., Inc. Jan. 10 2010.
Defendant Pantech Wireless, Inc.'S answer, affirmative defenses and counterclaims to Fractus SA's Amended complaint. Pantech Wireless, Inc. Jun. 4, 2009.
Defendant UTStarcom, Inc.'s answer, affirmative defenses, and counterclaims to plaintiffs amended complaint. UTStarcom, Inc. Jun. 8, 2009.
Answer, affirmative defenses and counterclaims to the amended complaint for patent infringement on behalf of Defendant Personal Communications Devices Holdings, LLC. Jul. 20, 2009.
Defendant Sanyo North America Corporation's partial answer to amended complaint for patent infringement. Sanyo North America Corporation. Jul. 20, 2009.
Kyocera Communications Inc's answer, affirmative defenses and counterclaims to plantiffs amended complaint. Kyocera Communications Inc. Jul. 21, 2009.
Kyocera Wireless Corp's answer, affirmative defenses and counterclaims to plantiffs amended complaint. Kyocera Wireless Corp. Jul. 21, 2009.
Palm Inc.'s answer, affirmative defenses and counterclaims to plaintiffs amended complaint. Palm Inc. Jul. 21, 2009.
Defendant HTC Corporation's answer and counterclaim to plaintiffs amended complaint. HTC Corporation. Sep. 25, 2009.
Defendant HTC America Inc's answer and counterclaim to plaintiffs amended complaint. HTC America Inc. Sep. 25, 2009.
Defendants Samsung Electronics Co., Ltd.'s; Samsung Electronics Research Institute's and Samsung Semiconductor Europe GmbH's answer; and Samsung Telecommunications America LLC' s answer and counterclaim to the amended complaint of plaintiff Fractus, SA. Oct. 1, 2009.
Defendants Research in Motion Ltd, and Research in Motion Corporation's answers, defenses and counterclaims to plaintiffs amended complaint. Oct. 1, 2009.
Defendants LG Electronics Inc., LG Electronics USA, Inc., and LG Electronics Mobilecomm USA Inc. answer and counterclaim to amended complaint. Oct. 1, 2009.
Defendants HTC America, Inc's first amended answer and counterclaims to plaintiffs amended complaint. Oct. 2, 2009.
Defendants Research in Motion Ltd, and Research in Motion Corporation's amended answer, defenses and counterclaims to plaintiffs amended complaint. Nov. 24, 2009.
Answer, affirmative defenses and counterclaims to the second amended complaint for patent infringement on behalf of Defendant Personal Communications Devices Holdings, LLC. Dec. 17, 2009.
Defendant HTC America, Inc's answer and counterclaims to plaintiffs second amended complaint. Dec. 21, 2009.
Defendant HTC Corporation's answer and counterclaims to plaintiffs second amended complaint. Dec. 21, 2009.
Defendant Research in Motion Ltd and Research in Motion Corporation's second answer, defenses and counterclaims to plaintiffs second amended complaint. Dec. 21, 2009.
Defendant Pantech Wireless, Inc's answer, affirmative defenses and counterclaims to Fractus SA's second amended complaint. Dec. 21, 2009.
Defendant Sanyo Electric Co. Ltd's answer to second amended complaint for patent infringement. Dec. 22, 2009.
Defendant Sanyo North America Corporation's answer to second amended complaint for patent infringement. Dec. 22, 2009.
Defendant UTStarcom, Inc's answer, affirmative defenses and counterclaims to Fractus SA's second amended complaint. Dec. 22, 2009.
Palm, Inc's answer, affirmative defenses and counterclaims to paintiffs second amended complaint. Dec. 22, 2009.
Kyocera Communications Inc's answer, affirmative defenses and counterclaims to paintiffs second amended complaint. Dec. 22, 2009.
Kyocera Wireless Corp's answer, affirmative defenses and counterclaims to paintiffs second amended complaint. Dec. 22, 2009.
Defendants Samsung Electronics Co., Ltd.'s; Samsung Electronics Research Institute's and Samsung Semiconductor Europe GmbH's answer; and Samsung Telecommunications America LLC's answer and counterclaim to the second amended complaint of plaintiff Fractus, SA. Dec. 23, 2009.

Defendants LG Electronics Inc., LG Electronics USA, Inc., and LG Electronics Mobilecomm USA Inc. answer and counterclaim to second amended complaint. Dec. 28, 2009.
Answer of the Sharp Defendants to plaintiffs second amended complaint. Dec. 29, 2009.
Amended answer of the Sharp defendants to plaintiffs second amended complaint. Feb. 24, 2010.
Defendants Samsung Electronics Co., Ltd.'s; Samsung Electronics Research Institute's and Samsung Semiconductor Europe GmbH's first amended answer; and Samsung Telecommunications America LLC's first amended answer and counterclaim to the second amended complaint of plaintiff Fractus, SA. Feb. 24, 2010.
Defendants LG Electronics Inc., LG Electronics USA, Inc., and LG Electronics Mobilecomm USA Inc. First amended answer and counterclaim to second amended complaint. Jan. 24, 2010.
Defendant HTC America, Inc.'s amended answer and counterclaim to plaintiffs second amended complaint. Feb. 24, 2010.
Defendant HTC Corporation's amended answer and counterclaim to plaintiffs second amended complaint. Feb. 24, 2010.
Defendant HTC Corporation's amended answer and counterclaim to plaintiffs second amended complaint. Feb. 25, 2010.
Defendant HTC America, Inc.'s amended answer and counterclaim to plaintiffs second amended complaint. Feb. 25, 2010.
Fractus's answer to defendant Pantech Wireless Inc. In the case of *Fractus SA* vs. *Samsung Electronics cp*. Jun. 24, 2009.
Fractus's answer to defendant UT Starcom, Inc. counterclaims. In the case of *Fractus SA* vs. *Samsung Electronics cp*. Jun. 29, 2009.
Complaint for patent infringement—Case 6:09-cv-00203. Fractus. May 5, 2009.
Civil cover sheet—Case 6:09-cv-00203. Fractus. May 5, 2009.
Amended complaint for patent infringement—Case 6:09-cv-00203. May 6, 2009.
Second amended complaint for patent infringement—Case 6:09-cv-00203. Dec. 2, 2009.
Second amended complaint for patent infringement—Case 6:09-cv-00203. Dec. 8, 2009.
Plaintiff Fractus, S. A.'s answer to defendant personal communications devices holdings, LLC's counterclaims to the Second Amended Complaint—Case 6:09-cv-00203. Jan. 4, 2010.
Plaintiff Fractus, S. A.'s answer to the counterclaims of defendants Research in Motion Ltd. And Research in Motion Corporation to the Second Amended Complaint—Case 6:09-cv-00203. Jan. 4, 2010.
Plaintiff Fractus, S. A.'s answer to counterclaims of defendant Pantech Wireless, Inc. To the Second Amended Complaint—Case 6:09-cv-00203. Jan. 4, 2010.
Plaintiff Fractus, S. A.'s answer to counterclaims of defendant Kyocera Communications, Inc's Counterclaims to the Second Amended Complaint—Case 6:09-cv-00203. Jan. 4, 2010.
Plaintiff Fractus, S. A.'s answer to defendant Kyocera Wireless Corp's Counterclaims to the Second Amended Complaint—Case 6:09-cv-00203. Jan. 4, 2010.
Plaintiff Fractus, S. A.'s answer to defendant Palm, Inc's Counterclaims to the Second Amended Complaint—Case 6:09-cv-00203. Jan. 4, 2010.
Plaintiff Fractus, S. A.'s answer to defendant UTStarcom, Inc's Counterclaims to the Second Amended Complaint—Case 6:09-cv-00203. Jan. 4, 2010.
Plaintiff Fractus, S. A.'s answer to counterclaims of defendant Samsung Telecommunications America LLC to the Second Amended Complaint—Case 6:09-cv-00203. Jan. 4, 2010.
Plaintiff Fractus, S. A.'s answer to counterclaims of defendants LG Electronics Inc., Electronics USA, Inc., and LG Electronics Mobilecomm USA, Inc. To the Second Amended Complaint—Case 6:09-cv-00203. Jan. 4, 2010.
Plaintiff Fractus, S. A.'s answer to counterclaims of defendants HTC America, Inc to the Second Amended Complaint—Case 6:09-cv-00203. Jan. 14, 2010.
Plaintiff Fractus, S. A.'s answer to amended counterclaims of defendant Samsung Telecommunications america LLC's to Fractus's Second Amended Complaint—Case 6:09-cv-00203. Apr. 1, 2010.
Plaintiff Fractus, S. A.'s answer to amended counterclaims of defendant HTC Corporation to Fractus's Second Amended Complaint—Case 6:09-cv-00203. Apr. 1, 2010.
Plaintiff Fractus, S. A.'s answer to amended counterclaims of defendant HTC America, Inc. To Fractus's Second Amended Complaint—Case 6:09-cv-00203. Apr. 1, 2010.
Plaintiff Fractus, S. A.'s answer to amended counterclaims of defendant LG Electronics Inc., LG Electronics USA, Inc., and LG Electronics Mobilecomm USA Inc's to Fractus's Second Amended Complaint—Case 6:09-cv-00203. Apr. 1, 2010.
Love, J. D. Memorandum opinion and order. Court Jan. 20, 2011.
NA. Defendant's notice of compliance regarding second amended invalidity contentions. Defendants Jan. 1, 2011.
NA. Fractus' reply to defendant's motion for reconsideration of, and objections to, magistrate Judge Love's markman order. Fractus Feb. 4, 2011.
NA. Declaration of Thomas E. Nelson—Exhibit A—Antenna photos. Defendants Feb. 3, 2011.
NA. Report and recommendation of United States magistrate judge. Court Feb. 8, 2011.
NA. Order adopting report and recommendation of magistrate judge. Court Feb. 11, 2011.
NA. Notice of compliance with motion practice orders. Fractus Feb. 14, 2011.
NA. Defendants LG Electronics Inc, LG Electronics USA, and LG Electronics Mobilecomm USA Inc's second amended answer and counterclaim to second amended complaint. Defendants Feb. 28, 2011.
NA. Reply brief in support of Defendant's motion for reconsideration of the court's ruling on the term "at least a portion" in the court's Dec. 17, 2010 claim construction order based on newly-available evidence. Defendants Feb. 25, 2011.
NA. Defendants Samsung Electronics Co Ltd (et al) second amended answer and counterclaims to the second amended complaint of plaintiff Fractus SA. Defendants Feb. 28, 2011.
NA. Defendant Pantech Wireless Inc amended answer, affirmative defenses, and counterclaims to Fractus' second amended complaint. Defendants Feb. 28, 2011.
Litigation—Invalidity Contentions—Defendants Defendants Invalidity contentions including apendix and exhibits refering Multiband Monopole. Defendants Feb. 8, 2010.
Infringement Chart—Kyocera MARBL. Patent: 7411556 Fractus Nov. 5, 2009.
Infringement Chart—Kyocera S2400. Patent: 7411556 Fractus Nov. 5, 2009.
Infringement Chart—Kyocera NEO E1100. Patent: 7411556 Fractus Nov. 5, 2009.
Infringement Chart—LG Shine CU720. Patent: 7411556 Fractus Nov. 5, 2009.
Infringement Chart—LG Rumor. Patent: 7411556 Fractus Nov. 5, 2009.
Infringement Chart—LG Voyager VX10000. Patent: 7411556 Fractus Nov. 5, 2009.
Infringement Chart—LG VX8350. Patent: 7411556 Fractus Nov. 5, 2009.
Infringement Chart—LG Vu CU920. Patent: 7411556 Fractus Nov. 5, 2009.
Infringement Chart—LG VX5400. Patent: 7411556 Fractus Nov. 5, 2009.
Infringement Chart—LG VX5500. Patent: 7411556 Fractus Nov. 5, 2009.
Infringement Chart—LG AX8600. Patent: 7411556 Fractus Nov. 5, 2009.
Infringement Chart—LG Flare LX165. Patent: 7411556 Fractus Nov. 5, 2009.
Infringement Chart—LG Aloha LX140. Patent: 7411556 Fractus Nov. 5, 2009.
Infringement Chart—LG Chocolate VX8550. Patent: 7411556 Fractus Nov. 5, 2009.
Infringement Chart—LG Muziq LX570. Patent: 7411556 Fractus Nov. 5, 2009.
Infringement Chart—LG VX9400. Patent: 7411556 Fractus Nov. 5, 2009.
Infringement Chart—LG VX8560 Chocolate 3. Patent: 7411556 Fractus Nov. 5, 2009.

Infringement Chart—LG EnV3 VX9200. Patent: 7411556 Fractus Nov. 5, 2009.
Infringement Chart—LG Lotus. Patent: 7411556 Fractus Nov. 5, 2009.
Infringement Chart—LG AX155. Patent: 7411556 Fractus Nov. 5, 2009.
Infringement Chart—LG enV Touch VX1100. Patent: 7411556 Fractus Nov. 5, 2009.
Infringement Chart—LG AX380. Patent: 7411556 Fractus Nov. 5, 2009.
Infringement Chart—LG VX8360. Patent: 7411556 Fractus Nov. 5, 2009.
Infringement Chart—Pantech Breeze C520. Patent: 7411556 Fractus Nov. 5, 2009.
Infringement Chart—Patench Duo C810. Patent: 7411556 Fractus Nov. 5, 2009.
Infringement Chart—Blackberry 8110. Patent: 7411556 Fractus Nov. 5, 2009.
Infringement Chart—Blackberry 8120. Patent: 7411556 Fractus Nov. 5, 2009.
Infringement Chart—Blackberry 8310. Patent: 7411556 Fractus Nov. 5, 2009.
Infringement Chart—Blackberry 8330. Patent: 7411556 Fractus Nov. 5, 2009.
Infringement Chart—Blackberry 8130. Patent: 7411556 Fractus Nov. 5, 2009.
Infringement Chart—Blackberry 8320. Patent: 7411556 Fractus Nov. 5, 2009.
Infringement Chart—Blackberry 8220. Patent: 7411556 Fractus Nov. 5, 2009.
Infringement Chart—Blackberry 8100. Patent: 7411556 Fractus Nov. 5, 2009.
Infringement Chart—Blackberry 8820. Patent: 7411556 Fractus Nov. 5, 2009.
Infringement Chart—Blackberry 8830. Patent: 7411556 Fractus Nov. 5, 2009.
Infringement Chart—Samsung SCH-R500. Patent: 7411556 Fractus Nov. 5, 2009.
Infringement Chart—Samsung M320. Patent: 7411556 Fractus Nov. 5, 2009.
Infringement Chart—Samsung SCH U340. Patent: 7411556 Fractus Nov. 5, 2009.
Infringement Chart—Samsung SCH U410. Patent: 7411556 Fractus Nov. 5, 2009.
Infringement Chart—Samsung SCH-R430. Patent: 7411556 Fractus Nov. 5, 2009.
Infringement Chart—Samsung SCH U700. Patent: 7411556 Fractus Nov. 5, 2009.
Infringement Chart—Samsung SCH-U940. Patent: 7411556 Fractus Nov. 5, 2009.
Infringement Chart—Samsung SCH A117. Patent: 7411556 Fractus Nov. 5, 2009.
Infringement Chart—Samsung SCH A127. Patent: 7411556 Fractus Nov. 5, 2009.
Infringement Chart—Samsung SGH T229. Patent: 7411556 Fractus Nov. 5, 2009.
Infringement Chart—Samsung SGH T439. Patent: 7411556 Fractus Nov. 5, 2009.
Infringement Chart—Samsung SGH T919. Patent: 7411556 Fractus Nov. 5, 2009.
Infringement Chart—Samsung SGH-A437. Patent: 7411556 Fractus Nov. 5, 2009.
Infringement Chart—Samsung SGH A867. Patent: 7411556 Fractus Nov. 5, 2009.
Infringement Chart—Samsung SCH-U310. Patent: 7411556 Fractus Nov. 5, 2009.
Infringement Chart—Samsung SGH-A237. Patent: 7411556 Fractus Nov. 5, 2009.
Infringement Chart—Samsung SGH-T639. Patent: 7411556 Fractus Nov. 5, 2009.
Infringement Chart—Samsung SGH-A837. Patent: 7411556 Fractus Nov. 5, 2009.
Infringement Chart—Samsung SCH-R600. Patent: 7411556 Fractus Nov. 5, 2009.
Infringement Chart—Samsung SCH-U520. Patent: 7411556 Fractus Nov. 5, 2009.
Infringement Chart—Samsung SCH-U750. Patent: 7411556 Fractus Nov. 5, 2009.
Infringement Chart—Samsung SGH-T219. Patent: 7411556 Fractus Nov. 5, 2009.
Infringement Chart—Samsung SGH-T929. Patent: 7411556 Fractus Nov. 5, 2009.
Infringement Chart—Samsung SCH-A645. Patent: 7411556 Fractus Nov. 5, 2009.
Infringement Chart—Samsung FlipShot SCH-U900. Patent: 7411556 Fractus Nov. 5, 2009.
Infringement Chart—Samsung SGH-A257. Patent: 7411556 Fractus Nov. 5, 2009.
Infringement Chart—Samsung SGH-T559. Patent: 7411556 Fractus Nov. 5, 2009.
Infringement Chart—Samsung SPH-M550. Patent: 7411556 Fractus Nov. 5, 2009.
Infringement Chart—Sanyo Katanna II. Patent: 7411556 Fractus Nov. 5, 2009.
Infringement Chart—Sanyo Katana LX. Patent: 7411556 Fractus Nov. 5, 2009.
Infringement Chart—Sharp Sidekick LX. Patent: 7411556 Fractus Nov. 5, 2009.
Infringement Chart—UTStarcom CDM7126. Patent: 7411556 Fractus Nov. 5, 2009.
Defendant's reply in suport of their motion for summary judgment of invalidity based on indefiniteness and lack of written description for certain terms Defendants Aug. 30, 2010.
NA. Expert declaration by Dr. D. Jaggard including exhibits (curriculum and datasheets from Cushcraft, Antenova, Ethertronics and Taoglas) Fractus Aug. 16, 2010.
NA. Fractus's opposition to defendants' motion for summary judgement of invalidity based on indefiniteness and lack of written description for certain terms Fractus Aug. 16, 2010.
Howe, M. Declaration of Micah Howe in support of Fractus SA opposition to defendants' motion for summary judgement of invalidity based on indefiniteness and lack of written description for certain terms Heim, Payne and Chorus LLP Aug. 16, 2010.
NA. IEEE Standard Dictionary of Electrical and Electronics. Terms IEEE Press (6th ed.) pp. 359, 688, and 878 Jan. 1, 1996.
Werner, D. H and Mittra, R. Frontiers in electromagnetics. IEEE Press. pp. 5-7 Jan. 1, 2000.
Nelson, Thomas R.; Jaggard, Dwight L. Fractals in the Imaging Sciences J. Optical Society AM. Jan. 1, 1999.
Stutzman, W.; Thiele, G. Antenna theory and design. John Wiley and Sons. pp. 18, 36 Jan. 1, 1981.
Jaggard, D. Diffraction by Bandlimited Fractal Screens. Optical Society AM Jun. 1, 1987.
Feder, J. Fractals. Plenum Press. pp. 10-11, 15-17, and 25 Jan. 1, 1988.
Fleishmann, M. ; Tildesley, DJ; Balls, RC. Fractals in the natural sciences. Royal Society of London Jan. 1, 1999.
Kritikos, H.N.; Jaggard, D.L. Recent advances in electromagnetic theory—Chapter 6 on fractal electrodynamics. Springer—Verlag. Chapter 6 Oct. 1, 1990.
Caswell, W. E. Invisible errors in dimensions calculations: geometric and systematic effects Dimensions and Entropies in Chaotic Systems Jan. 1, 1986.
NA. European Patent Convention—Article 123 European Patent Office Jan. 1, 2000.
Kyriacos, S.; Buczkowski, S. et al. A modified box-counting method Fractals—World Scientific Publishing Company Jan. 1, 1994.
Carpintero, F. Reply to the Written Opinion for the PCT patent application ES99/00296 dated on Nov. 15, 2001 Herrero & Asociados Nov. 15, 2001.
Werner, D. H. et al. Frontiers in Electromagnetics—Chapter 3—The Theory and design of fractal antenna arrays IEEE Press Series Jan. 1, 2000.

Balanis, Constantine A. Antenna theory—Analysis and design—Chapter 2—Fundamental parameters of antennas John Wiley & Sons Jan. 1, 1982.
Sauer, J. M. Preliminary amendment for the U.S. Appl. No. 10/963,080 Jones Day. Case 6:09-cv-00203-LED-JDL Dec. 10, 2004.
NA. Merriam-Webster's Collegiate Dictionary (1993) Merriam-Webster's. Case 6:09-cv-00203-LED-JDL Jan. 1, 1993.
Chen, Z. N. Broadband probe-fed L-shaped plate antenna Microwave and Optical Technology Letters Aug. 5, 2000.
NA. American Heritage College Dictionary (1997). pp. 340 and 1016 Mifflin Comp. Case 6:09-cv-00203-LED-JDL Jan. 1, 1997.
Buczkowski , Stéphane ; Kyriacos. The modified box-countig method: analysis of some characteristic paramenters. Pattern Recognition Apr. 20, 1998.
Wolin, H. A. Preliminary Amendment of U.S. Appl. No. 10/102,568 Rosenman & Colin LLP Mar. 12, 2002.
Menefee, J. Office Action for the US patent reexamination 95/001390 dated Aug. 12, 2010 USPTO Aug. 12, 2010.
Menefee, James. Office Action for the US patent reexamination 95/001389 dated on Aug. 12, 2010 USPTO Aug. 12, 2010.
Phan, T. Office Action for U.S. Appl. No. 10/102,568 dated on Jan. 23, 2004 USPTO Jan. 23, 2004.
*Fractus* vs. *Samsung et al.* Claim construction and motion for summary judgement—Markman Hearing—[Defendants] Defendants Sep. 2, 2010.
Fractus' Claim Construction Presentation—arkman Hearing—*Fractus* v. *Samsung et al.* 609-cv-00203 Sep. 2, 2010.
Love , J. Memorandum order and opinion. Court Dec. 17, 2010.
Gianvittorio, John Paul et al. Fractal antennas—a novel antenna miniturization technique and applications Antennas and Propagation Magazine, IEEE Feb. 1, 2002.
Best, Steven R. The fractal loop antenna: a comparison of fractal and non-fractal geometries Antennas and Propagation Society International Symposium, 2001. IEEE Jan. 1, 2001.
Romeu, J. et al. Fractal FSS—A novel dual-band frequency selective surface Antennas and Propagation, IEEE Transactions on Jul. 1, 2000.
Fanjul, J. International Preliminary Examination Report for application No. PCT/ES99/00296 EPO Dec. 19, 2001.
NA. Fractus's Objections to claim construction memorandum and order. Case 6:09-cv-00203. Fractus Jan. 14, 2011.
Puente, C. ; Romeu, J. ; Cardama, A. Fractal-shaped antennas Frontiers in electromagnetics—IEEE Press Jan. 1, 2000.
Love, J. Court Order. Provisional claim construction and motion for summary judgement. Provisional markman order. Court Nov. 9, 2010.
Jaggard, D.L. Rebuttal expert report of Dr. Dwight L. Jaggard (redacted version) Fractus Feb. 16, 2011.
Long, S. A. Rebuttal expert report of Dr. Stuart A. Long (redacted version) Fractus Feb. 16, 2011.
Stutzman, W.L. Rebuttal expert report of Dr. Warren L. Stutzman (redacted version) Fractus Feb. 16, 2011.
Borowski, E. J. Dictionary of Mathematics Collins—Case 6:09-cv-00203-LED-JDL Jan. 1, 1989.
Mehaute, A. Fractal Geometrics CRC Press—Case 6:09-cv-00203-LED-JDL Jan. 1, 1990.
NA. Defendants RIM, Samsung, HTC, LG and Pantech's response to plantiff Fractus SA's opening claim construction brief in Case 6:09-cv-00203-LED-JDL Defendants Jul. 30, 2010.
NA. Defendants RIM, Samsung, HTC, LG and Pantech's response to plantiff Fractus SA's opening claim construction brief in Case 6:09-cv-00203-LED-JDL—Exhibit 41—Demonstrative re: counting segments Defendants Jul. 30, 2010.
NA. Defendants RIM, Samsung, HTC, LG and Pantech's response to plantiff Fractus SA's opening claim construction brief in Case 6:09-cv-00203-LED-JDL—Exhibit 42—Demonstrative showing how straight segments can be fitted over a curved surface Defendants Jul. 30, 2010.
NA. Defendants RIM, Samsung, HTC, LG and Pantech's response to plantiff Fractus SA's opening claim construction brief in "Case 6:09-cv-00203-LED-JDL"—Exhibit 1—Chart of Agreed Terms and Disputed Terms Defendants Jul. 30, 2010.
NA. Defendants RIM, Samsung, HTC, LG and Pantech's response to plantiff Fractus SA's opening claim construction brief in "Case 6:09-cv-00203-LED-JDL"—Exhibit 2—Family Tree of Asserted Patents Defendants Jul. 30, 2010.
NA. Response of defendants Kyocera Communications, Inc; Palm Inc. and UTStarcom, Inc. To plantiff Fractus SA's opening claim construction brief in "Case 6:09-cv-00203-LED-JDL" Defendants Jul. 30, 2010.
NA. Claims for the EP patent 00909089. Herrero y Asociados Jan. 28, 2005.
NA. The American Heritage College Dictionary—p. 684, 1060 Houghton Mifflin Comp.—3d ed.—Case 6:09cv-00203-LED-JDL Jan. 1, 1997.
NA. The American Heritage Dictionary of the English Language Houghton Mifflin Company—4th ed.—Case 6:09cv-00203-LED-JDL Jan. 1, 2000.
Walker, B.D. Response office action for the U.S. Appl. No. 11/179,250 Howison & Arnott—Case 6:09cv-00203-LED-JDL Jul. 12, 2005.
Walker, B. Preliminary amendment for the U.S. Appl. No. 11/780,932 dated on Jul. 20, 2007 Howison & Arnott—Case 6:09-cv-00203-LED-JDL Jul. 20, 2007.
Theiler, J. Estimating fractal dimension J. Opt. Soc. Am. A. Case 6:09-cv-00203-LED-JDL Jun. 1, 1990.
Moore, S. Response to Office Action dated Feb. 7, 2006 of U.S. Appl. No. 11/033,788 Jenkens & Gilchrist Jun. 1, 2006.
Stutzman, W.L. ; Thiele, G.A. Antenna theory and design John Wiley and Sons. pp. 8-9, 43-48, 210-219 Jan. 1, 1998.
Rich, Barnett. Review of Elementary Mathematics 2d ed.1997 McGraw-Hill—Case 6:09-cv-00203-LED-JDL Jan. 1, 1997.
Sclater, N.; Markus, J. McGraw-Hill Electronics Dictionary McGraw-Hill Jan. 1, 1997.
Johnson, R. Antenna engineering handbook (3rd. edition)—pp. 14-1-14-5 McGraw-Hill Jan. 1, 1993.
Dictionary of Scientific & Technical Terms (6th Ed., 2002) p. 1489 McGraw-Hill Jan. 1, 2002.
Parker, S. McGraw-Hill Dictionary of Scientific and Technical Terms (5th ed. 1994) McGraw-Hill—Case 6:09cv-00203-LED-JDL Jan. 1, 1994.
NA. The American Heritage Dictionary—pag 817 , 961 Morris-William—(Second College edition)—Case 6:09cv-00203-LED-JDL Jan. 1, 1982.
Henderson West, B. The Prentice-Hall encyclopedia of mathematics Prentice-Hall Jan. 1, 1982.
West, B.H. et al. The Prentice-Hall Encyclopedia of Mathematics (1982) Prentice-Hall—Case 6:09-cv-00203-LED-JDL Jan. 1, 1982.
NA. IEEE Standard Definitions of Terms for Antennas, IEEE Std. 145-1993 (1993) The Institute of Electrical and Electronics Engineers—Case 6:09-cv-00203-LED-JDL Mar. 18, 1993.
Borja, C. Antenas fractales microstrip Universitat Politècnica de Catalunya Jul. 1, 1997.
Phan, T. Notice of allowance of U.S. Appl. No. 10/963,080 dated Sep. 1, 2005. USPTO Sep. 1, 2005.
Phan, T. Notice of allowance of U.S. Appl. No. 11/102,390 dated Jul. 6, 2006. USPTO Jul. 6, 2006.
Phan, T. Notice of allowance of U.S. Appl. No. 11/179,257 dated Oct. 19, 2006 USPTO Jan. 19, 2006.
Phan, T. Office Action for U.S. Appl. No. 11/550,256 dated on Jan. 15, 2008 USPTO Jan. 15, 2008.
Wimer, M. Notice of allowance of U.S. Appl. No. 10/822,933 dated on Oct. 18, 2007 USPTO Oct. 18, 2007.
Collier, C. P. Geometry for teachers Waveland Press, Inc. Jan. 1, 1984.
Mandelbrot, B.B. Opinions (Benoit B. Mandelbrot) World Scientific Publishing Company—Case 6:09-cv-00203-LED-JDL Jan. 1, 1993.
Werner, D.H.; Werner, P.L.; Ferrare, A.J. Frequency independent features of self-similar fractal antennas Antennas and Propagation Society International Symposium, 1996. AP-S. Digest Jul. 21, 1996.
Foroutan-pour, K.; Dutilleul, P.; Smith, D.L. Advances in the implementation of the box-counting method of fractal dimension estimation Applied Mathematics and Computation; Elsevier Mar. 1, 1999.
Graf, R. Modern dictionary of electronics Butterworth-Heinemann (6th Ed.) Jan. 1, 1984.

NA. Collins Dictionary—Pag608. Collins Jan. 1, 1979.
NA. Int'l Electro-Technical Commission IEV No. 712-01-04—Electropedia: the world's online electrotechnical vocabulary Electropedia—Commission Electrotechnique Internationale—http://www.electropedia.org Apr. 1, 1998.
NA. Webster's New Collegiate Dictionary G & C Merriam Co. Jan. 1, 1981.
NA. IEEE Standard dictionary of electrical and electronics terms IEEE Standard (6th ed.) Jan. 1, 1996.
Sawaya, K.; Ishizone, T.; Mushiake, Y. A simplified Expression of Dyadic Green's Function for a Conduction Half Sheet vol. AP-29, No. 5 (Sep. 1981) IEEE Transactions on Antennas & Propagation Sep. 1, 1981.
Pozar, D.; Newman, E. Analysis of a Monopole Mounted near or at the Edge of a Half-Plane IEEE Transactions on Antennas and Propagation Mar. 1, 1981.
Johnson, R. Antenna engineering handbook—pp. 4-26-4-33 Mc Graw Hill—(3rd Ed.) Jan. 1, 1993.
NA. The American Heritage Dictionary—pag 311, 1208 New College ed. (2nd ed.) Jan. 1, 1982.
NA. The American Century Dictionary Oxford University Press Jan. 1, 1995.
Rademacher, H.; Toeplitz, O. The Enjoyment of Math Princeton Science Library Jan. 1, 1957.
NA. The Random House Dictionary Random House Jan. 1, 1984.
Pressley, A. Elementary Differential Geometry Springer Jan. 1, 2000.
Peitgen & D. Saupe, H. The science of fractal images Springer-Verlag Jan. 1, 1988.
Peitgen et al, H O. Chaos and fractals: new frontiers of science. Pags. 22-26, 62-66, 94-105, 212-219, 229-243 Springer-Verlag Jan. 1, 1992.
Nguyen, H. Notice of Allowance of U.S. Appl. No. 10/182,635 dated on Apr. 4, 2005 USPTO Apr. 11, 2005.
Request for Inter partes reexamination of US patent No. 7411556-95/000,600 dated on Dec. 3, 2010—Exhibits HTC Dec. 3, 2010.
Request for Inter partes reexamination of US patent No. 7411556-95/000590 dated on Dec. 16, 2010—Exhibits Kyocera Dec. 16, 2010.
Request for inter partes reexamination of US patent No. 7411556-95/001462 dated on Oct. 1, 2010—Exhibits Samsung Oct. 1, 2010.
Vinoy, K. J. et al. Hilbert curve fractal antenna: a small resonant antenna for VHF/UHF applications. Microwave and Optical Technology Letters. Pag 215-219 Mar. 1, 2001.
NA. Amendments and Review of CN patent application No. 01823716.9 of OA dated Feb. 16, 2007. Patent and Trademanrk Office, China Council for the Promotion of International Trade Patent and Trademanrk Office, China Council for the Promotion of International Trade Aug. 21, 2007.
Feng, Liu. Office Action of CN patent application 018237169 dated Feb. 16, 2007 The State Intelletual Property Office of the People's Republic of China Feb. 16, 2007.
NA. Response to Second OA of CN patent application No. 01823716.9 dated Sep. 21, 2007 CCPIT Patent and Trademark Law Office Dec. 3, 2007.
Feng, Liu. Second Office Action of CN patent application 018237169 dated Sep. 21, 2007 The State Intellectual Property Office of the People's Republic of China Sep. 21, 2007.
NA. FCC—United States table of frequency allocations. 377-538 Federal Communications Commission Oct. 1, 1999.
NA. United States Table of Frequency allocations—The Radio Spectrum United States Department of Commerce Mar. 1, 1996.
Buczkowski, Stéphane ; Kyriacos, Soula; Nekka, Fahima; Cartilier, Louis. The modified box-countig method: analysis of some characteristic paramenters. 411-418(8) Pattern Recognition Apr. 20, 1998.
Kyriacos, S. ; Buczkowski , S. et al. A modified box-counting method. 321-324 Fractals—World Scientific Publishing Company Jan. 1, 1994.
Mehaute, A. Fractal Geometrics. 3-35 CRC Press—Case 6:09-cv-00203-LED-JDL Jan. 1, 1990.
Barnsley, M. Fractals Eveywhere Academic Press Professional Jan. 1, 1993.
Shafer, G. Probability and Finance John Wiley & Sons Jan. 1, 2001.
Parron, J.; Rius, J.; Romeu, J. Study of the Koch fractal monopole in the frequency domain Fractalcoms May 30, 2002.
Bach Andersen , J. et al., On closely coupled dipoles in a random field, Antennas and Wireless Propagation Letters, IEEE, Dec. 1, 2006.
Balanis, Constantine A., Antenna Theory—Analysis and design—Chapter 10, Hamilton Printing, Jan. 1, 1982.
Bhaysar, Samir A., *Fractus S.A.* v. *Samsung Electronics Co., Ltd. et al.*, 6:09-cv-00203 and *Fractus S.A.* v. *LG Electronics Mobilecomm U.S.A., Inc. et al.*, 6-09-cv-00205 disclosure of material information to the USPTO, Baker Botts LLP, Oct. 28, 2009.
Rudge, A.W. et al., The handbook of antenna design, IEE Eletromagnetic Waves Series; Peter Peregrinus Ltd.; 2nd ed., Jan. 1, 1986.
Sauer, Joseph M., Response to the Office Action dated Oct. 4, 2004 for the U.S. Appl. No. 10/422,578 Jones Day, Jan. 6, 2005.
Sauer, Joseph M., Response to the Office Action dated Apr. 7, 2005 for the U.S. Appl. No. 10/422,578, Jones Day, May 31, 2005.
Sauer, Joseph M., Request for Continued Examination for U.S. Appl. No. 10/422,578 with response to the office action dated on Apr. 7, 2005 and the advisory action dated on Jun. 23, 2005, Jones Day, Aug. 8, 2005.
Wimer, Michael C., Office Action for U.S. Appl. No. 10/422,578 dated on Oct. 4, 2004, USPTO, Oct. 4, 2004.
Wimer, Michael, Office Action for U.S. Appl. No. 10/422,578 dated on Apr. 7, 2005, USPTO, Apr. 7, 2005.
Wimer, M. C., Office Action for the U.S. Appl. No. 10/422,578 dated on Aug. 24, 2005, USPTO, Aug. 24, 2005.
Wimer, Michael C., Advisory Action before the filing of an Appeal Brief for U.S. Appl. No. 10/422,578, USPTO, Jun. 23, 2005.
NA, Defendant HTC Corporation's First amended answer and counterclaim to plaintiffs amended complaint, Defendants, Oct. 2, 2009.
NA, European Search Report of patent application No. 10180818 dated Dec. 13, 2010, European Patent Office, Dec. 13, 2010.
Paschen, D.A.; Olson, S. A crossed-slot antenna with an infinite balun feed. Antenna Applications Symposium, 1995. Sep. 20, 1995.
McCormick, J. A Low-profile electrically small VHF antenna. 15th Annual Symposium on the USAF antenna reserach and development program Oct. 12, 1965.
Watson, T.; Friesser, J. A phase shift direction finding technique. Annual Symposium on the USAF antenna research and development program Oct. 21, 1957.
Zhang, S. Huff, G.; Bernhard, T. Antenna efficiency and gain of two new compact microstrip antennas. Antenna Applications symposium, 2001 Sep. 19, 2001.
Meier, K.; Burkhard, M.; Schmid, T. et al Broadband calibration of E-field probes in Lossy Media. IEEE Transactions on Microwave Theory and Techniques Oct. 1, 1996.
NA Defendants' Motion to Clarify Claim Construction—Document 854. Defendants Apr. 18, 2011.
Jones, Michael E. Defendants' opposition to Fractus SA objections to the Court's Mar. 9, 2011 Order—Document 780. Baker Botts, LLP Mar. 31, 2011.
Nokia Mobile Phones Exhibit 9: Internal Photographs FCC ID: LJPNPW-1NB. Federal Communication Commission—FCC, Feb. 15, 2001.
Naik, A.; Bathnagar, P.S. Experimental study on stacked ring coupled triangular microstrip antenna Antenna Applications Symposium, 1994.
Stutzman , W.L. Expert report of Dr. Warren L. Stutzman (redacted)—expert witness retained by Fractus. Fractus, Feb. 23, 2011.
Jaggard, D.L. Expert report of Dwight L. Jaggard (redacted)—expert witness retained by Fractus. Fractus, Feb. 23, 2011.
Long, S. Expert report of Stuart Long (redacted)—expert witness retained by Fractus. Fractus, Feb. 23, 2011.
Lyon, J.; Rassweiler, G.; Chen, C. Ferrite-loading effects on helical and spiral antennas. 15th Annual Symposium on the USAF antenna reserach and development program, Oct. 12, 1965.
Graff, B. Form 731 Corrections: GMLNSW-4DX M. Flom Associates—MFA, Apr. 24, 2000.
Jaggard, D.L. Fractal electrodynamics and modeling. Directions in electromagnetic wave modeling Jan. 1, 1991.
NA Fractus SA's opening claim construction brief—Exhibit 2—Parties' Agreed Constructions. Fractus Jul. 16, 2010.

NA Fractus SA's opening claim construction brief—Letter Fractus—Case 6:09-cv-00203-LED-JDL Jul. 16, 2010.
NA Fractus SA's Opening Claim Construction Brief with Parties' Proposed and Agreed Constructions in the case of *Fractus SA* v. *Samsung Electornics Co. Ltd. et al.* Fractus—Case 6:09-cv-00203-LED-JDL Jul. 16, 2010.
NA Fractus SA's opening claim construction brief,—Exhibit 1—Parties' Proposed Constructions—Case 6:09-cv-00203-LED-JDL Fractus, Jul. 16, 2010.
Howe, Micah J. Fractus, S.A.'s objections to the Court's Mar. 9, 2011, Order—Document 768. Susman Godfrey LLP Mar. 25, 2011.
Howe, M. Fractus's Response to Defendants' Motion to Clarify Claim Construction—Document 887. Susman and Godfrey Apr. 25, 2011.
NA Fractus's sur-reply to defendants' motion for reconsideration of the court's Dec. 17, 2010 claim construction order based on newly-available evidence—Document 666. Fractus Mar. 8, 2011.
Behncke, M. Fractus's surreply to defendants' Motion for Summary Judgment re publication dates of three references—Document 876. Susman Godfrey LLP Apr. 20, 2011.
Cristal, E.G. et al Hairpin-line and hybrid hairpin-line/Half-wave parallel-coupled-line filers. Microwave Theory and Techniques, IEEE Transactions on Nov. 1, 1972.
NA Infringement Chart—Kyocera MARBL. Fractus Nov. 5, 2009.
NA Infringement Chart—Kyocera NEO E1100. Fractus Nov. 5, 2009.
NA Infringement Chart—Kyocera S2400. Fractus Nov. 5, 2009.
NA Infringement Chart—LG Aloha LX140. Fractus Nov. 5, 2009.
NA Infringement Chart—LG AX155. Fractus Nov. 5, 2009.
NA Infringement Chart—LG AX380. Fractus Nov. 5, 2009.
NA Infringement Chart—LG AX8600. Fractus Nov. 5, 2009.
NA Infringement Chart—LG Chocolate VX8550. Fractus Nov. 5, 2009.
NA Infringement Chart—LG enV Touch VX1100. Fractus Nov. 5, 2009.
NA Infringement Chart—LG EnV3 VX9200. Fractus Nov. 5, 2009.
NA Infringement Chart—LG Flare LX165. Fractus Nov. 5, 2009.
NA Infringement Chart—LG Lotus. Fractus Nov. 5, 2009.
NA Infringement Chart—LG MUZIQ LX570. Fractus Nov. 5, 2009.
NA Infringement Chart—LG Rumor. Fractus Nov. 5, 2009.
NA Infringement Chart—LG Shine CU720. Fractus Nov. 5, 2009.
NA Infringement Chart—LG Voyager VX10000. Fractus Nov. 5, 2009.
NA Infringement Chart—LG VU CU920. Fractus Nov. 5, 2009.
NA Infringement Chart—LG VX5400. Fractus Nov. 5, 2009.
NA Infringement Chart—LG VX5500. Fractus Nov. 5, 2009.
NA Infringement Chart—LG VX8350. Fractus Nov. 5, 2009.
NA Infringement Chart—LG VX8360. Fractus Nov. 5, 2009.
NA Infringement Chart—LG VX8560 Chocolate 3. Fractus Nov. 5, 2009.
NA Infringement Chart—LG VX9400. Fractus Nov. 5, 2009.
NA Infringement Chart—Pantech Breeze C520. Fractus Nov. 5, 2009.
NA Infringement Chart—Pantech DUO C810. Fractus Nov. 5, 2009.
NA Infringement Chart—RIM Blackberry 8110. Fractus Nov. 5, 2009.
NA. Infringement Chart—RIM Blackberry 8120. Fractus Nov. 5, 2009.
NA. Infringement Chart—RIM Blackberry 8130. Fractus Nov. 5, 2009.
NA. Infringement Chart—RIM Blackberry 8220. Fractus Nov. 5, 2009.
NA. Infringement Chart—RIM Blackberry 8310. Fractus Nov. 5, 2009.
NA. Infringement Chart—RIM Blackberry 8320. Fractus Nov. 5, 2009.
NA. Infringement Chart—RIM Blackberry 8330. Fractus Nov. 5, 2009.
NA. Infringement Chart—RIM Blackberry 8820. Fractus Nov. 5, 2009.
NA. Infringement Chart—RIM Blackberry 8830. Fractus Nov. 5, 2009.
NA. Infringement Chart—RIM Blackberry Pearl 8100. Fractus Nov. 5, 2009.
NA. Infringement Chart—Samsung FlipShot SCH-U900. Fractus Nov. 5, 2009.
NA. Infringement Chart—Samsung M320. Fractus Nov. 5, 2009.
NA. Infringement Chart—Samsung SCH A127. Fractus Nov. 5, 2009.
NA. Infringement Chart—Samsung SCH U340. Fractus Nov. 5, 2009.
NA. Infringement Chart—Samsung SCH U410. Fractus Nov. 5, 2009.
NA. Infringement Chart—Samsung SCH U700. Fractus Nov. 5, 2009.
NA. Infringement Chart—Samsung SCH-A645. Fractus Nov. 5, 2009.
NA. Infringement Chart—Samsung SCH-R430. Fractus Nov. 5, 2009.
NA. Infringement Chart—Samsung SCH-R500. Fractus Nov. 5, 2009.
NA. Infringement Chart—Samsung SCH-R600. Fractus Nov. 5, 2009.
NA. Infringement Chart—Samsung SCH-U310. Fractus Nov. 5, 2009.
NA. Infringement Chart—Samsung SCH-U520. Fractus Nov. 5, 2009.
NA. Infringement Chart—Samsung SCH-U750. Fractus Nov. 5, 2009.
NA. Infringement Chart—Samsung SCH-U940. Fractus Nov. 5, 2009.
NA. Infringement Chart—Samsung SGH A117. Fractus Nov. 5, 2009.
NA. Infringement Chart—Samsung SGH A437. Fractus Nov. 5, 2009.
NA. Infringement Chart—Samsung SGH A867. Fractus Nov. 5, 2009.
NA. Infringement Chart—Samsung SGH T229. Fractus Nov. 5, 2009.
NA. Infringement Chart—Samsung SGH T439. Fractus Nov. 5, 2009.
NA. Infringement Chart—Samsung SGH T919. Fractus Nov. 5, 2009.
NA. Infringement Chart—Samsung SGH-A237. Fractus Nov. 5, 2009.
NA. Infringement Chart—Samsung SGH-A257. Fractus Nov. 5, 2009.
NA. Infringement Chart—Samsung SGH-A837. Fractus Nov. 5, 2009.
NA. Infringement Chart—Samsung SGH-T219. Fractus Nov. 5, 2009.
NA. Infringement Chart—Samsung SGH-T559. Fractus Nov. 5, 2009.
NA. Infringement Chart—Samsung SGH-T639. Fractus Nov. 5, 2009.
NA. Infringement Chart—Samsung SGH-T929. Fractus Nov. 5, 2009.
NA. Infringement Chart—Samsung SPH-M550. Fractus Nov. 5, 2009.
NA. Infringement Chart—Sanyo Katana II. Fractus Nov. 5, 2009.
NA. Infringement Chart—Sanyo Katana LX. Fractus Nov. 5, 2009.
NA. Infringement Chart—UTStarcom CDM7126. Fractus Nov. 5, 2009.
Borja, C.; Puente, C. Iterative network models to predict the performance of Sierpinski fractal antennas and networks, Antennas and Propagation Society International Symposium, 1999. IEEE Jul. 11, 1999.
NA. Joint Motion to Dismiss Claims and Counterclaims re '850 and '822—Document 843. Defendants Apr. 15, 2011.
Ewing, A Letter and Engineering Test Report of FCC ID: GMLNPW-3 Test and Certification Center—TCC Dec. 19, 2001.
NA. Letter from Baker Botts to Howison & Arnott LLP including exhibits. Baker Botts Aug. 5, 2010.

NA. Letter from Baker Botts to Kenyon & Kenyon LLP, Winstead PC and Howison & Arnott LLP including exhibits. Baker Botts, Oct. 28, 2009.
Posio, E. Letter to FCC—About GMLNPW-3 complies with ANSI/IEEE C95.1-1992 Standard for Safety Levels. Nokia Mobile Phones, Dec. 7, 2001.
Salow, S. Letter to FCC—About LJPNPW-1 NB complies with ANSI/IEEE C95.1-1992 Standard for Safety Levels. Nokia Mobile Phones, Feb. 26, 2001.
Flom, M. Letter to FCC—Application form 731 and Engineering Test Report by Nokia Mobile Phones for FCC ID: LJPNPW-1NB M. Flom Associates—MFA, Mar. 12, 2001.
NA Letter to FCC—Application form 731 and Engineering Test Report by Nokia Mobile Phones for FCC ID: LJPNSW-6NX M. Flom Associates, Apr. 1, 1999.
Flom, M. Letter to FCC—Communication of replacing employee M. Flom Associates, May 23, 2000.
Posio, E. Letter to FCC—Compliance Statement of GMLNPW-3 Nokia Mobile Phones Dec. 7, 2001.
Posio, E. Letter to FCC—Electronic Serial No. for FCC ID: GMLNPW-3 Nokia Mobile Phones Dec. 7, 2001.
Posio, E. Letter to FCC—Electronic Serial No. for FCC ID: GMLNSW-4DX Nokia Mobile Phones Feb. 7, 2000.
Salow, S. Letter to FCC—FCC ID LJPNPW-1 NB complies with OET Bulletin No. 53 as referenced in Section 22.915 of the Commissions rules and with EIA/TIA/IS-54-B Nokia Mobile Phones Feb. 26, 2001.
Myrskog, M Letter to FCC—Letter that will authorize the appointment of Morton Flom Eng and/or Flomassociates Inc to act as their Agent in all FCC matters Nokia Mobile Phones Sep. 14, 2000.
Flom, M. Letter to FCC—Nokia SAR Information M. Flom Associates—MFA May 19, 2000.
Posio, E. Letter to FCC—Request for confidentiality of the information accompanying the application of FCC ID: GMLNPW-3 Nokia Mobile Phones Dec. 7, 2001.
Posio, E. Letter to FCC—Request for confidentiality on the information accompanying the application of FCC ID: GMLNSW-4DX Nokia Mobile Phones Feb. 7, 2000.
Graff, W. Letter to FCC—Test Report GMLNSW-4DX M. Flom Associates—MFA Mar. 17, 2000.
Posio, E. Letter to FCC about GMLNSW-4DX complies with ANSI/IEEE C95.1-1992 Standard for Safety Levels Nokia Mobile Phones Mar. 7, 2000.
Wikka, K. Letter to FCC that will authorize the appointment of Morton Flom Eng and/or Flomassociates Inc to act as their Agent in all FCC matters Nokia Mobile Phones Aug. 5, 1999.
Tribble, M. L. Letter to John D. Love—Document 715—Permission to file a summary judgment motion of no indefiniteness on the issues wher the Court's Report and Recommendation already has held that the claim term is not indefinite Susman Godfrey Mar. 18, 2011.
Tribble, M.L. Letter to John D. Love—Document 716—Permission to file a partial summary judgement motion on infringement. Susman Godfrey, LLP Mar. 18, 2011.
Sirola, Neil P. Letter to John D. Love—Document 721—Permission to file a motion for summary judgment of invalidity of the following 7 asserted claims from the MLV, patent family . . . Baker Botts, LLP Mar. 18, 2011.
Flom, M. Letter to modify the Emission Designator M. Flom Associates—MFA Mar. 30, 2001.
Love, J. Minute Entry re Hearing on Apr. 21, 2011—Document 890 United States Distric Court for the Eastern Distric of Texas—Tyler Division Apr. 27, 2011.
Nokia Nokia MBD-11 Mobile Holder—SAR Specification Nokia Mar. 1, 2002.
NA Nokia. Antenna Photos—FCC ID: GMLNPW-3 Federal Communications Commission—FCC Feb. 19, 2002.
Ho, T. Notice of Allowance of U.S. Appl. No. 12/652,974 dated on Feb. 17, 2011 USPTO Feb. 17, 2011.
NA OET Exhibits List for FCC ID: GMLNSW-4DX Office of Engineering and Technology—FCC Sep. 8, 2000.
NA OET Exhibits list for FCC ID: LJPNPW-1NB Federal Communications Commission—FCC May 3, 2001.
NA OET Exhibits list for FCC ID: LJPNPW-6NX Federal Communications Commission—FCC Jul. 8, 1999.
Menefee, James Office Action for the U.S. Appl. No. 95/001,389 dated on Aug. 12, 2010 USPTO Aug. 12, 2010.
Lee, B.T. Office action for the U.S. Appl. No. 10/181,790 dated on Aug. 27, 2004 USPTO Aug. 27, 2004.
Lee, B.T. Office action for the U.S. Appl. No. 10/181,790 dated on Jun. 2, 2005 USPTO Jun. 2, 2005.
Ho, T. Office Action of U.S. Appl. No. 12/652,974 dated Jun. 23, 2010 USPTO Jun. 23, 2010.
Menefee, J. Office Action of U.S. Appl. No. 95/000,590 and U.S. Appl. No. 95/001,462 dated on May 6, 2011 USPTO May 6, 2011.
NA Order—Document 670 Court Mar. 9, 2011.
Davis, Leonard Order—Document 783 United States District Judge Apr. 1, 2011.
Love, J. D. Order—Document 868 United States Magristrate Judge Apr. 19, 2011.
NA Plaintiff Fractus SA's answer to amended counterclaims of defendant Pantech Wireless Inc to Fractus's second amended complaint—Document 696 Fractus Mar. 15, 2011.
NA Plaintiff Fractus SA's answer to second amended counterclaims of defendant HTC Corporation to Fractus's second amended complaint—Document 678 Fractus Mar. 14, 2011.
NA Plaintiff Fractus SA's answer to second amended counterclaims of defendant HTC to Fractus's second amended complaint—Document 680 Fractus Mar. 14, 2011.
NA Plaintiff Fractus SA's answer to second amended counterclaims of defendant LG Electronics to Fractus's second amended complaint—Document 694 Fractus Mar. 15, 2011.
NA Plaintiff Fractus SA's answer to second amended counterclaims of defendant Samsung to Fractus's second amended complaint—Document 695 Fractus Mar. 15, 2011.
Salow, S. Request for confidentiality of the information accompanyinh the application of FCC ID: LJPNPW-1NB M. Flom Associates—MFA Feb. 26, 2001.
Le, B. T. Response to office action for the U.S. Appl. No. 10/181,790 dated on Aug. 27, 2004 USPTO Dec. 8, 2004.
Shoaib, M. Response to the Office Action dated on Jun. 23, 2010 of U.S. Appl. No. 12/652,974 Winstead Dec. 20, 2010.
Sterne, R.G. Response to the Office Action for the U.S. Appl. No. 95/001,390 dated on Aug. 19, 2010 Sterne, Kessler, Goldstein & Fox PLLC Nov. 19, 2010.
NA SAR—Evaluation—DASY3 Dipole ValidationKit—Type: D1900V2—Serial: 511 Schimd and Partner Engineering AG Feb. 13, 2001.
NA SAR—Evaluation—DASY3 Dipole ValidationKit—Type: D835V2—Serial: 405 Schmid and Partner Engineering AG Feb. 13, 2001.
NA Second amended complaint for patent infringement—Case 6:09-cv-00203—Document 222 Fractus Dec. 2, 2009.
Hohlfeld, R.G.; Cohen N. Self-similarity and the geometric requirements for frequency independence in antennae Fractals Jan. 17, 1999.
NA Stipulation of Dismissal of all Claims and Counterclaims re '850 and '822—Document 841 Defendants Apr. 15, 2011.
Campos, O. Study of multiband and miniature fractal antennas Universitat Politecnica de Catalunya Jan. 1, 1998.
IEEE Standards Uncertainty System Check (Dipole Validation)—IEEE P1528 Schmid and Partner Engineering AG Jan. 1, 2003.
NA Webster's New Collegiate Dictionary G&C Merriam Co. Jan. 1, 1981.
NA Declaration of Jeffery D. Baxter—Including Exhibits: J, K, L, M ,N ,O, P, Q, R, S, T, U, Z, AA, KK, LL, WW, BBB, EEE, GGG, HHH, III, KKK, MMM, NNN, OOO, PPP, QQQ, TTT, UUU, VVV, WWW, YYY, ZZZ, AAAA, BBBB Defendants Jul. 30, 2010.
Document 415—P.R. 4-3 joint daim construction statement, dated on Jun. 14, 2010.
Document 429—Declaration of Jeffery D. Baxter- Including Exhibits: J, K, L, M ,N ,O, P, Q, R, S, T, U, Z, AA, KK, LL, dated on Jul. 30, 2010.
Document 452—Defendants reply in support of their motion for summary judgment of invalidity based on indefiniteness and lack of written description for certain terms with exhibits WW, BBB, EEE, GGG, HHH, III, KKK, MMM, NNN, OOO, PPP, Q, dated on Aug. 30, 2010.
Document 641—Defendant HTC America, Inc's second amended answer and counterclaim to plaintiffs second amended complaint, dated on Feb. 25, 2011.
Document 642—Defendant HTC Corporation's second amended answer and counterclaim to plaintiffs second amended complaint, dated on Feb. 25, 2011.
Document 889—Reply in support of defendants' motion to clarify claim construction, dated on Apr. 27, 2011.
Document 893—Fractus SA's surreply to defendant's motion to clarify claim construction, Apr. 29, 2011.
Document 900—Order, dated on Apr. 29, 2011.
Document 901—Report and recommendation of United States Magistrate Judge, dated on May 2, 2011.
Document 902—Fractus SA's objections to defendants' prior art notice, dated on May 2, 2011.
Document 915—Defendants' response to plaintiffs objections to defendants notice of prior art, dated on May 5, 2011.
Document 933—Defendants' motion for reconsideration of, and objections to, the May 2, 2011 report and recommendation darifying daim construction, dated on May 9, 2011.
Document 939—Fractus's response to defendants' motion for reconsideration of and objections to the May 2, 2011, report and recommendations clarifying daim construction, dated on May 10, 2011.
Document 968—Order, dated on May 13, 2011.
Document 971—Order, dated on May 13, 2011.
Internal Photos—FCC ID: GMLNPW-3 , Federal Communications Commission , Dec. 19, 2001.
Andersen, J.B. The handbook of antenna design—Low—and medium-gain microwave antennas. Rudge , A.W. et al—IEE Eletromagnetic Waves Series; Peter Peregrinus Ltd. (2nd ed.). vols. 1 and 2. Pag 526-543. 1986.
Inter partes reexamination of US patent 7411556-95/001462, 95/001590—Third party requester's comments to patent owner's reply of Aug. 8, 2011, dated on Sep. 7, 2011.
Decision sua sponte to merge reexamination proceedings of US patent 7411556-95/000590-95/001462—dated on May 5, 2011.
Response to the Office Action dated May 6, 2011 of US patent US7411556-95/001462-95/000590-, dated on Aug. 6, 2011.
Notice of allowance of U.S. Appl. No. 12/652,974 dated on Aug. 10, 2011.
Action dosing prosecution for US patent 7411556-95/001462, dated on Dec. 14, 2011.
Patent owner's response to Action Closing Prosecution for US patent 7411556-95/001462, 95/000590, dated on Jan. 17, 2012.
Third party requester's comments to patent owner's reply of Jan. 7, 2012 for US patent 7411556-95/0001462, dated on Feb. 16, 2012.
Oral and videotaped deposition of Dr. Stuart Long—vol. 1, dated on Mar. 11, 2011.
Oral and videotaped deposition of Dr. Stuart Long—vol. 2, dated on Mar. 13, 2011.
Oral and videotaped deposition of Dr. Stuart Long—vol. 3, dated on Mar. 14, 2011.
Oral and videotaped deposition of Dr. Warren L. Stutzman—vol. 1, dated on Mar. 3, 2011.
Oral and videotaped deposition of Dr. Warren L. Stutzman—vol. 2, dated on Mar. 4, 2011.
The oral and videotaped deposition of Dwight Jaggard—vol. 1, dated on Mar. 8, 2011.
The oral and videotaped deposition of Dwight Jaggard—vol. 2, dated on Mar. 9, 2011.
The oral and videotaped deposition of Dwight Jaggard—vol. 3, dated on Mar. 10, 2011.
Transcript of pretrial hearing before the Honorable Leonard Davis, US District Judge—2:00 PM, dated on May 16, 2011.
Transcript of jury trial before the Honorable Leonard Davis US District Judge—8:00 AM, dated on May 17, 2011.
Transcript of jury trial before the Honorable Leonard Davis, US District Judge—1:10 PM, dated on May 17, 2011.
Transcript of jury trial before the Honorable Leonard Davis—8:45 AM, dated on May 18, 2011.
Transcript of jury trial before the Honorable Leonard Davis—1:00 PM, dated on May 18, 2011.
Transcript of jury trial before the Honorable Leonard Davis—8:45 AM, dated on May 19, 2011.
Transcript of jury trial before the Honorable Leonard Davis—1:00 PM, dated on May 19, 2011.
Transcript of jury trial before the Honorable Leonard Davis—12:30 PM, dated on May 20, 2011.
Transcript of jury trial before the Honorable Leonard Davis—8:30 AM, dated on May 20, 2011.
Transcript of jury trial before the Honorable Leonard Davis—8:55 AM, dated on May 23, 2011.
Demonstratives presented by Dr. Steven Best during trial, dated on May 19, 2011.
Dr. Stuart Long infringement analysis presented during trial, dated on May 18, 2011.
Borja, C., Fractal microstrip antennas: Antenas fractales microstrip, Universitat Politecnica de Catalunya, 1997.
Campos, O., Multiband and miniature fractal antennas study: Estudi d'antenes fractal multibanda i en miniatura, Universitat Politecnica de Catalunya, 1998.
Verdura, O., Miniature fractal antenna: Antena fractal miniatura, Universitat Politecnica de Catalunya, 1997.
Carver, K R. et al., Microstrip antenna technology, in "Microstrip antennas" to D.M. Pozar; IEEE Antennas and Propagation Society, 1995, pp. 3-26.
Munson, R.E., Conformal microstrip communication antenna, Symposium on USAF antenna Research and Development, 23th, Oct. 1973.
US95/001462, 95/000590—Third party requesters notice of appeal for US patent 7411556, dated on Apr. 12, 2012.
US95/001462, 95/000590—Reply to Third Party Requesters notice of appeal filed on Apr. 12, 2012 for US patent 7411556, dated on May 31, 2012.
U.S. Appl. No. 12/652,974—Notice of allowance dated on May 21, 2012.
U.S. Appl. No. 13/029,382—Notice of allowance dated on May 10, 2012.
Lu, Jui-Han; Tang, Chia-Luan; Wong, Kin-Lu, Single-feed slotted equilateral triangular microstrip antenna for circular polarization, IEEE Transactions on Antennas and Propagation, Jul. 1999.
US95/001462-US95/000590—Inter partes reexamination certificate for US7411556.
U.S. Appl. No. 13/556,626—Office action dated Nov. 6, 2012.
US95/001462, 95/000590—Right of appeal notice for US patent 7411556, dated on Mar. 12, 2012.
Document 1082—Joint motion to dismiss HTC, dated Sep. 13, 2011.
Document 1088—Samsung's motion to determine intervening rights in view of new Federal Circuit case law or, in the alternative, to stay the case pending the outcome of reexamination, dated Oct. 19, 2011.
Document 1092—Samsung's reply in support of its motion to determine intervening rights in view of new Federal Circuit case law or, in the alternative, to stay the case pending the outcome of reexamination, dated Nov. 14, 2011.
Document 1091—Fractus's response to Samsung's motion to determine intervening rights or to stay the case pending the outcome of reexamination, dated Nov. 2, 2011.
Document 1083—Order- Final consent judgement HTC, dated Sep. 15, 2011.
US95/001413-US95/000593-US95/000598—Action Closing Prosecution dated on Apr. 20, 2012 for US patent 7148850, dated Apr. 20, 2012.

MULTI-BAND MONOPOLE ANTENNAS FOR MOBILE COMMUNICATIONS DEVICES

This patent application is a continuation of U.S. patent application Ser. No. 10/584,442, filed on Jul. 18, 2006 now U.S. Pat. No. 7,423,592 as a national stage filing of PCT/EP2005/000880 filed on Jan. 28, 2005. PCT/EP2005/000880 is a continuation-in-part of PCT/EP2002/014706 Dec. 22, 2002. U.S. patent application Ser. No. 10/584,442 claims priority from, and incorporates by reference the entire disclosure of U.S. Provisional Patent Application No. 60/540,450, filed on Jan. 30, 2004. U.S. patent application Ser. No. 10/584,442, International Patent Application PCT/EP2005/000880, and U.S. Provisional Patent Application No. 60/540,450 are incorporated herein by reference.

This invention relates generally to the field of multi-band monopole internal and external antennas. More specifically, multi-band monopole antennas are provided that are particularly well-suited for use in mobile communications devices, such as Personal Digital Assistants, cellular telephones, and pagers.

BACKGROUND

Multi-band antenna structures for use in a mobile communications device are known in this art. For example, one type of antenna structure that is commonly utilized as an internally-mounted antenna for a mobile communication device is known as an "inverted-F" antenna. When mounted inside a mobile communications device, an antenna is often subject to problematic amounts of electromagnetic interference from other metallic objects within the mobile communications device, particularly from the ground plane. An inverted-F antenna has been shown to perform adequately as an internally mounted antenna, compared to other known antenna structures. Inverted-F antennas, however, are typically bandwidth-limited, and thus may not be well suited for bandwidth intensive applications. An example of an antenna structure that is used as an externally mounted antenna for a mobile communication device is known as a space-filling or grid dimension antenna. External mounting reduces the amount of electromagnetic interference from other metal objects within the mobile communication device.

SUMMARY

Antennas for use in mobile communication devices are disclosed. The antennas disclosed can include a substrate with a base, a top, a front side and a back side; a first conductor can be located on the first side of the antenna substrate; and a second conductor can be located on the second side of the antenna substrate. The conductors can have single or multiple branches. If a conductor is a single branch it can, for example, be a spiral conductor or a conducting plate. If a conductor has multiple branches, each branch can be set up to receive a different frequency band. A conductor with multiple branches can have a linear branch and a space-filling or grid dimension branch. A conducting plate can act as a parasitic reflector plane to tune or partially tune the resonant frequency of another conductor. The first and second conductors can be electrically connected.

DETAILED DESCRIPTION

Figure 1:
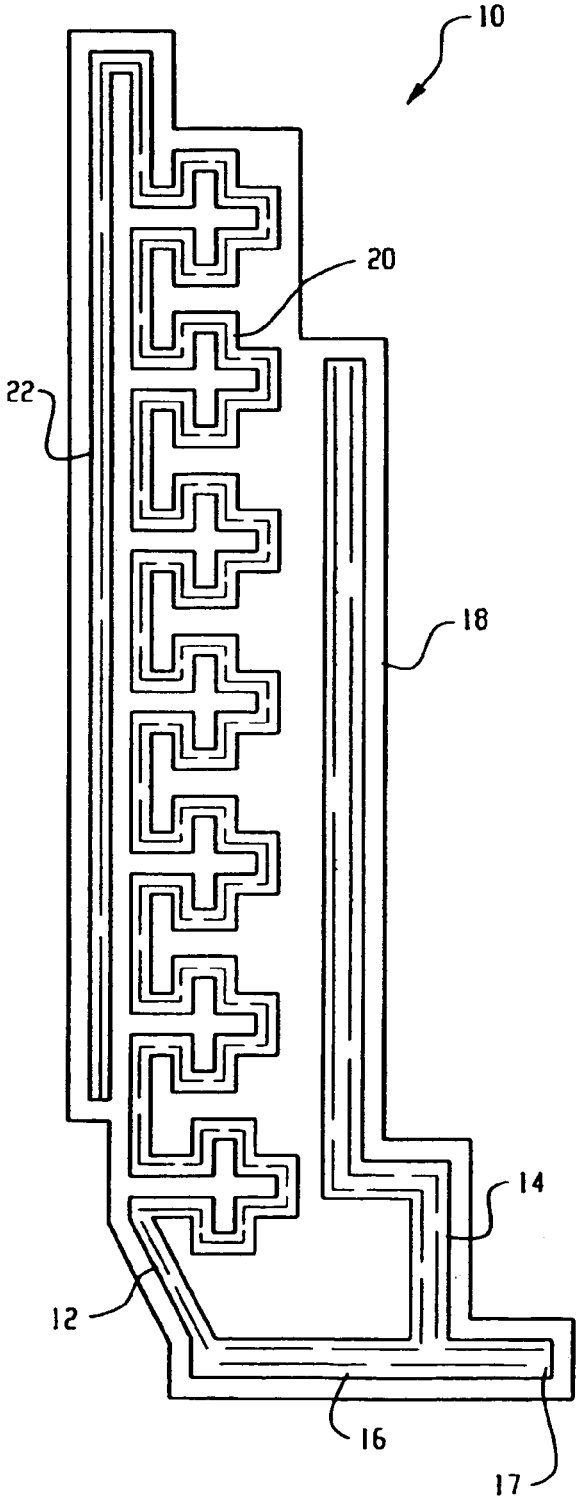
FIG. 1 is a top view of an exemplary multi-band monopole antenna for a mobile communications device.

Referring now to the drawing figures, FIG. 1 is a top view of an exemplary multi-band monopole antenna 10 for a mobile communications device. The multi-band monopole antenna 10 includes a first radiating arm 12 and a second radiating arm 14 that are both coupled to a feeding port 17 through a common conductor 16. The antenna 10 also includes a substrate material 18 on which the antenna structure 12, 14, 16 is fabricated, such as a dielectric substrate, a flex-film substrate, or some other type of suitable substrate material. The antenna structure 12, 14, 16 is preferably patterned from a conductive material, such as a metallic thick-film paste that is printed and cured on the substrate material 18, but may alternatively be fabricated using other known fabrication techniques.

The first radiating arm 12 includes a meandering section 20 and an extended section 22. The meandering section 20 is coupled to and extends away from the common conductor 16. The extended section 22 is contiguous with the meandering section 20 and extends from the end of the meandering section 20 back towards the common conductor 16. In the illustrated embodiment, the meandering section 20 of the first radiating arm 12 is formed into a geometric shape known as a space-filling curve, in order to reduce the overall size of the antenna 10. A space-filling curve is characterized by at least ten segments which are connected in such a way that each segment forms an angle with its adjacent segments, that is, no pair of adjacent segments define a larger straight segment. It should be understood, however, that the meandering section 20 may include other space-filling curves than that shown in FIG. 1, or may optionally be arranged in an alternative meandering geometry. FIGS. 2-6, for example, illustrate antenna structures having meandering sections formed from several alternative geometries. The use of shape-filling curves to form antenna structures is described in greater detail in the co-owned PCT Application WO 01/54225, entitled Space-Filling Miniature Antennas, which is hereby incorporated into the present application by reference.

The second radiating arm 14 includes three linear portions. As viewed in FIG. 1, the first linear portion extends in a vertical direction away from the common conductor 16. The second linear portion extends horizontally from the end of the first linear portion towards the first radiating arm. The third linear portion extends vertically from the end of the second linear portion in the same direction as the first linear portion and adjacent to the meandering section 20 of the first radiating arm 14.

Figure 10:
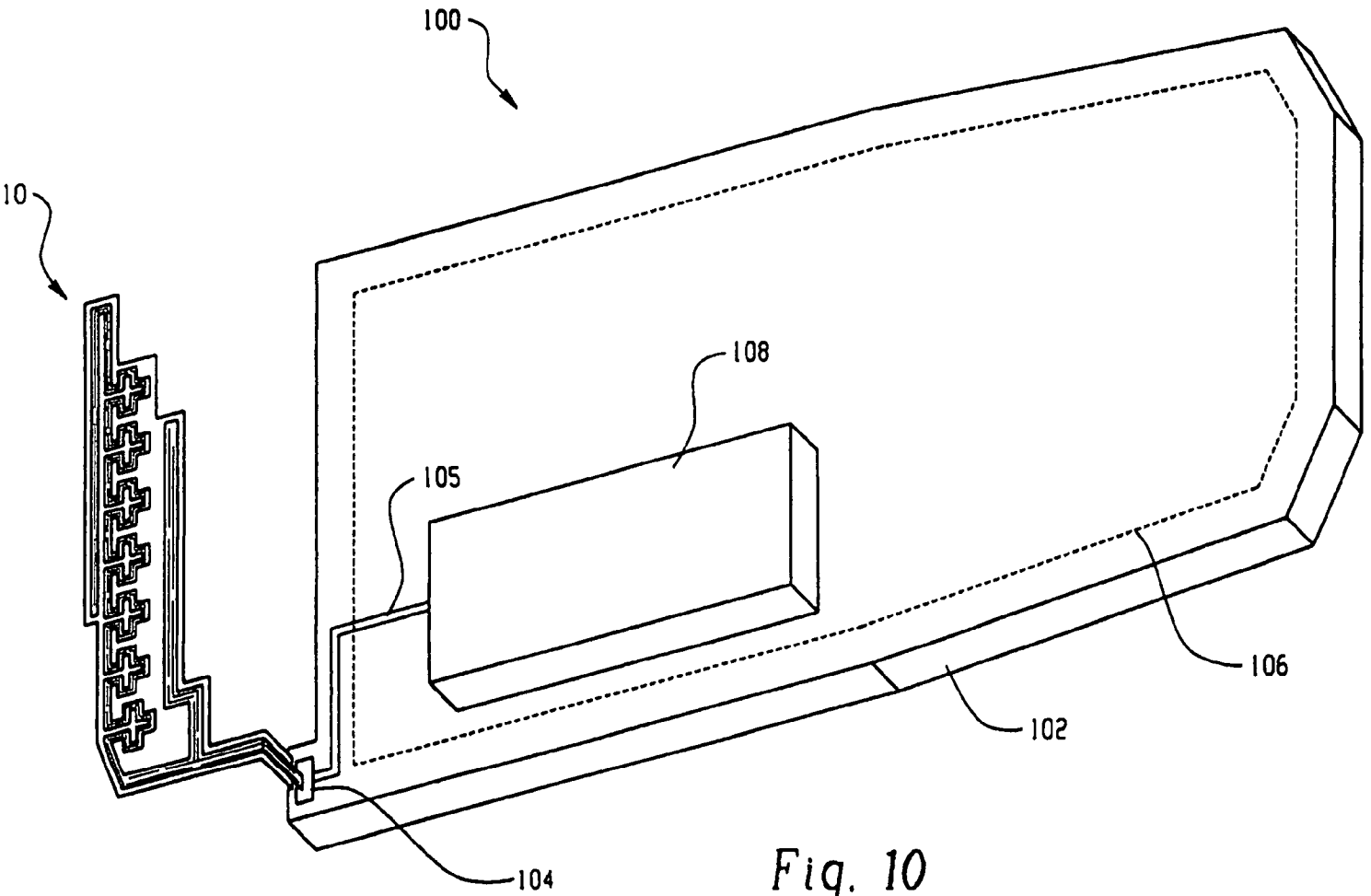
FIG. 10 is a top view of the exemplary multi-band monopole antenna of FIG. 1 coupled to a circuit board for a mobile communications device.

As noted above, the common conductor 16 of the antenna 10 couples the feeding port 17 to the first and second radiating arms 12, 14. The common conductor 16 extends horizontally (as viewed in FIG. 1) beyond the second radiating arm 14, and may be folded in a perpendicular direction (perpendicularly into the page), as shown in FIG. 10, in order to couple the feeding port 17 to communications circuitry in a mobile communications device.

Operationally, the first and second radiating arms 12, 14 are each tuned to a different frequency band or bands, resulting in a dual-band or multi-band antenna. The antenna 10 may be tuned to the desired dual-band operating frequencies of a mobile communications device by pre-selecting the total conductor length of each of the radiating arms 12, 14. For example, in the illustrated embodiment, the first radiating arm 12 may be tuned to operate in a lower frequency band or groups of bands, such as PDC (800 MHz), CDMA (800 MHz), GSM (850 MHz), GSM (900 MHz), GPS, or some other desired frequency band. Similarly, the second radiating arm 14 may be tuned to operate in a higher frequency band or group of bands, such as GPS, PDC (1500 MHz), GSM (1800 MHz), Korean PCS, CDMA/PCS (1900 MHz), CDMA2000/UMTS, IEEE 802.11 (2.4 GHz), IEEE 802.16 (Wi-MAX), or some other desired frequency band. It should be understood that, in some embodiments, the lower frequency band of the first radiating arm 12 may overlap the higher frequency band of the second radiating arm 14, resulting in a single broader band. It should also be understood that the multi-band antenna 10 may be expanded to include further frequency bands by adding additional radiating arms. For example, a third radiating arm could be added to the antenna 10 to form a tri-band antenna.

Figure 2:
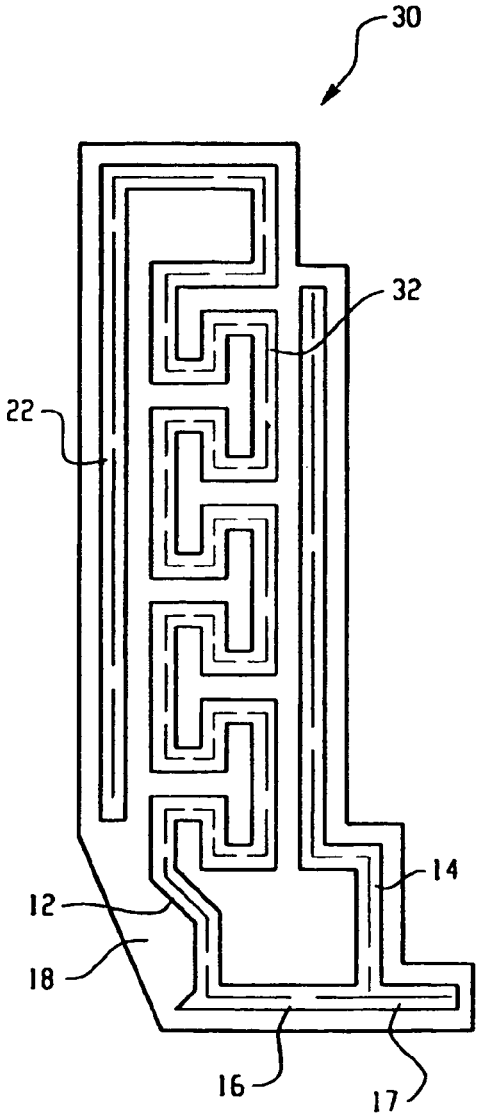
FIG. 2 is a top view of an exemplary multi-band monopole antenna including one alternative space-filling geometry.

FIG. 2 is a top view of an exemplary multi-band monopole antenna 30 including one alternative meandering geometry. The antenna 30 shown in FIG. 2 is similar to the multi-band antenna 10 shown in FIG. 1, except the meandering section 32 in the first radiating arm 12 includes a different curve than that shown in FIG. 1.

FIGS. 3-9 illustrate several alternative multi-band monopole antenna configurations 50, 70, 80, 90, 93, 95, 97. Similar to the antennas 10, 30 shown in FIGS. 1 and 2, the multi-band monopole antenna 50 illustrated in FIG. 3 includes a common conductor 52 coupled to a first radiating arm 54 and a second radiating arm 56. The common conductor 52 includes a feeding port 62 on a linear portion of the common conductor 52 that extends horizontally (as viewed in FIG. 3) away from the radiating arms 54, 56, and that may be folded in a perpendicular direction (perpendicularly into the page) in order to couple the feeding port 62 to communications circuitry in a mobile communications device.

The first radiating arm 54 includes a meandering section 58 and an extended section 60. The meandering section 58 is coupled to and extends away from the common conductor 52. The extended section 60 is contiguous with the meandering section 58 and extends from the end of the meandering section 58 in an arcing path back towards the common conductor 52.

The second radiating arm 56 includes three linear portions. As viewed in FIG. 3, the first linear portion extends diagonally away from the common conductor 52. The second linear portion extends horizontally from the end of the first linear portion towards the first radiating arm. The third linear portion extends vertically from the end of the second linear portion away from the common conductor 52 and adjacent to the meandering section 58 of the first radiating arm 54.

Figure 3:
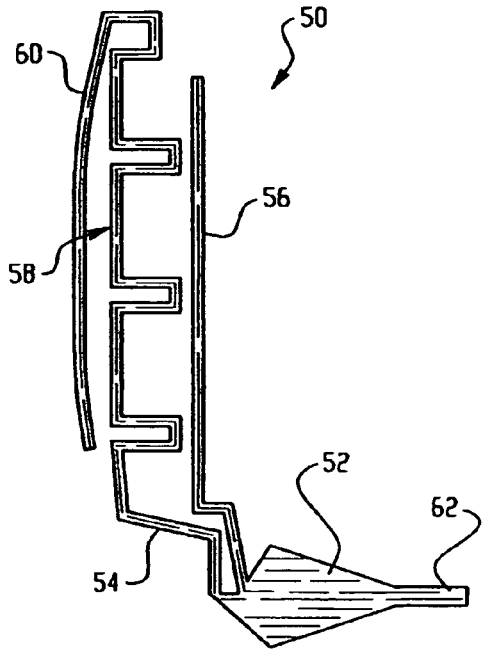
FIGS. 3-9 illustrate several alternative multi-band monopole antenna configurations.
Figure 4:
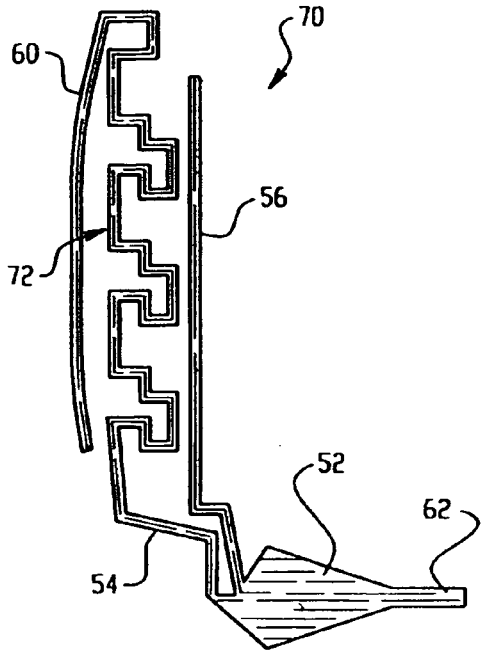
Figure 5:
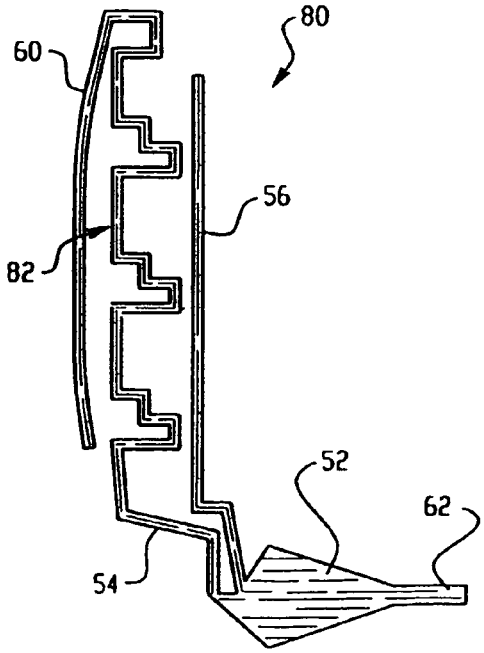
Figure 6:
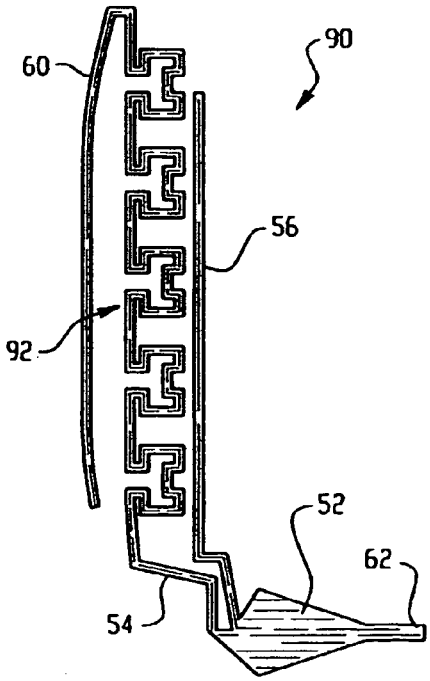

The multi-band monopole antennas 70, 80, 90 illustrated in FIGS. 4-6 are similar to the antenna 50 shown in FIG. 3, except each includes a differently-patterned meandering portion 72, 82, 92 in the first radiating arm 54. For example, the meandering portion 92 of the multi-band antenna 90 shown in FIG. 6 meets the definition of a space-filling curve, as described above. The meandering portions 58, 72, 82 illustrated in FIGS. 3-5, however, each include differently-shaped periodic curves that do not meet the requirements of a space-filling curve.

Figure 9:
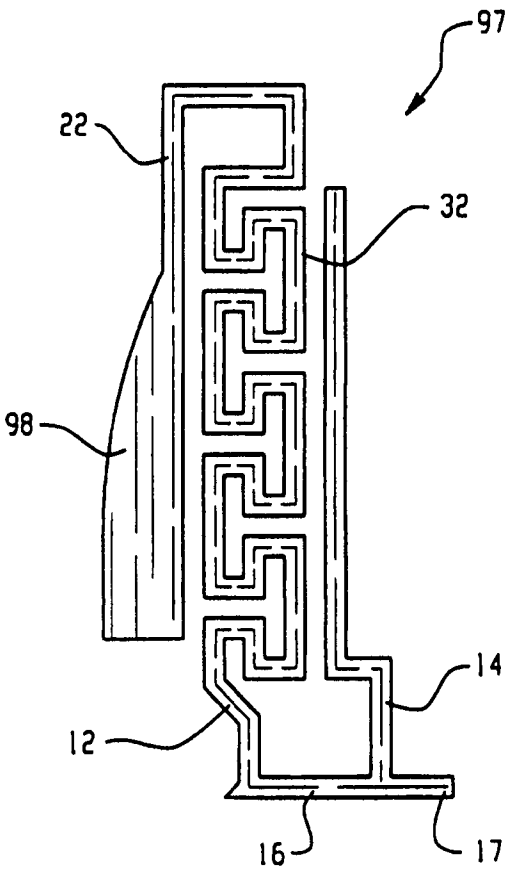
Figure 8:
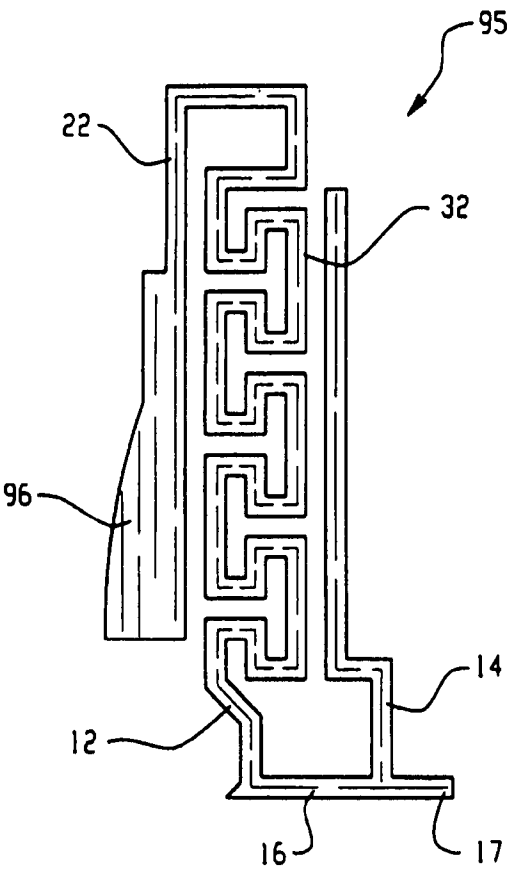
Figure 7:
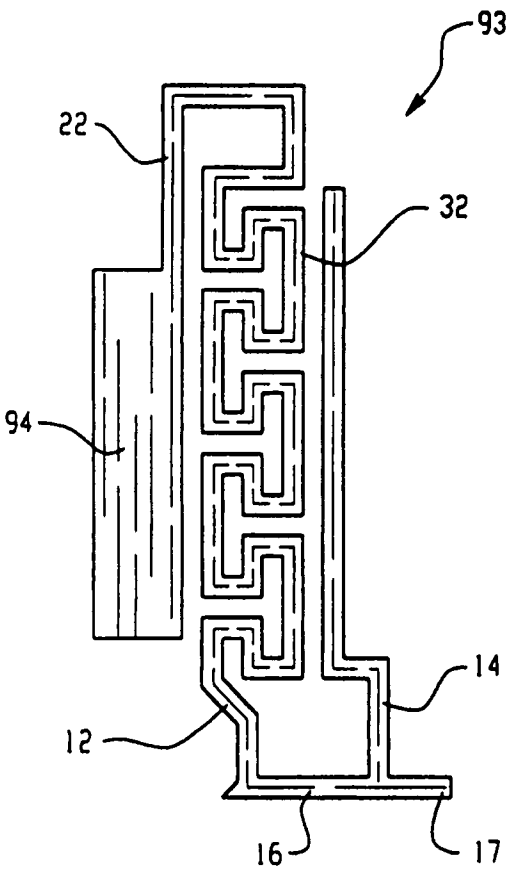

The multi-band monopole antennas 93, 95, 97 illustrated in FIGS. 7-9 are similar to the antenna 30 shown in FIG. 2, except in each of FIGS. 7-9 the expanded portion 22 of the first radiating arm 12 includes an additional area 94, 96, 98. In FIG. 7, the expanded portion 22 of the first radiating arm 12 includes a polygonal portion 94. In FIGS. 8 and 9, the expanded portion 22 of the first radiating arm 12 includes a portion 96, 98 with an arcuate longitudinal edge.

FIG. 10 is a top view 100 of the exemplary multi-band monopole antenna 10 of FIG. 1 coupled to the circuit board 102 of a mobile communications device. The circuit board 102 includes a feeding point 104 and a ground plane 106. The ground plane 106 may, for example, be located on one of the surfaces of the circuit board 102, or may be one layer of a multi-layer printed circuit board. The feeding point 104 may, for example, be a metallic bonding pad that is coupled to circuit traces 105 on one or more layers of the circuit board 102. Also illustrated, is communication circuitry 108 that is coupled to the feeding point 104. The communication circuitry 108 may, for example, be a multi-band transceiver circuit that is coupled to the feeding point 104 through circuit traces 105 on the circuit board.

In order to reduce electromagnetic interference or electromagnetic coupling from the ground plane 106, the antenna 10 is mounted within the mobile communications device such that 50% or less of the projection of the antenna footprint on the plane of the circuit board 102 intersects the metalization of the ground plane 106. In the illustrated embodiment 100, the antenna 10 is mounted above the circuit board 102. That is, the circuit board 102 is mounted in a first plane and the antenna 10 is mounted in a second plane within the mobile communications device. In addition, the antenna 10 is laterally offset from an edge of the circuit board 102, such that, in this embodiment 100, the projection of the antenna footprint on the plane of the circuit board 102 does not intersect any of the metalization of the ground plane 106.

In order to further reduce electromagnetic interference or electromagnetic coupling from the ground plane 106, the feeding point 104 is located at a position on the circuit board 102 adjacent to a corner of the ground plane 106. The antenna 10 is preferably coupled to the feeding point 104 by folding a portion of the common conductor 16 perpendicularly towards the plane of the circuit board 102 and coupling the feeding port 17 of the antenna 10 to the feeding point 104 of the circuit board 102. The feeding port 17 of the antenna 10 may, for example, be coupled to the feeding point 104 using a commercially available connector, by bonding the feeding port 17 directly to the feeding point 104, or by some other suitable coupling means, such as for example a built-in or surface-mounted spring contact. In other embodiments, however, the feeding port 17 of the antenna 10 may be coupled to the feeding point 104 by some means other than folding the common conductor 16.

Figure 11:
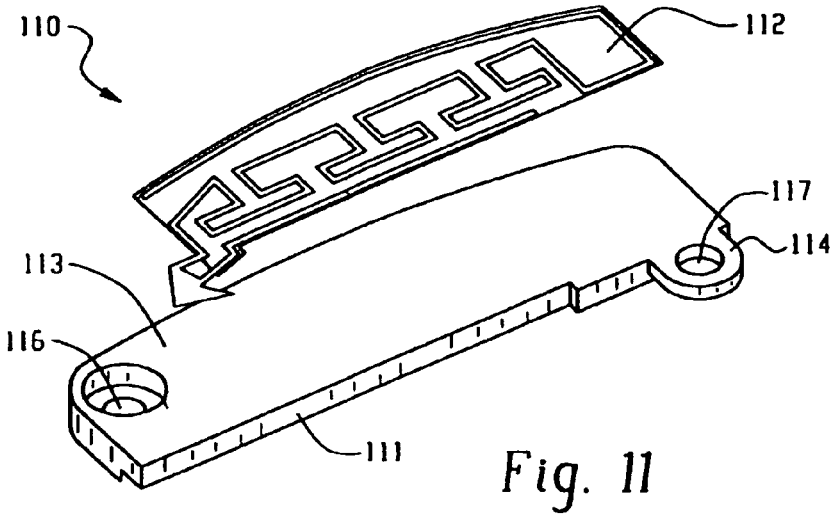
FIG. 11 shows an exemplary mounting structure for securing a multi-band monopole antenna within a mobile communications device.

FIG. 11 shows an exemplary mounting structure 111 for securing a multi-band monopole antenna 112 within a mobile communications device. The illustrated embodiment 110 employs a multi-band monopole antenna 112 having a meandering section similar to that shown in FIG. 2. It should be understood, however, that alternative multi-band monopole antenna configurations, as described in FIGS. 1-9, could also be used.

The mounting structure 111 includes a flat surface 113 and at least one protruding section 114. The antenna 112 is secured to the flat surface 113 of the mounting structure 111, preferably using an adhesive material. For example, the antenna 112 may be fabricated on a flex-film substrate having a peel-type adhesive on the surface opposite the antenna structure. Once the antenna 112 is secured to the mounting structure 111, the mounting structure 111 is positioned in a mobile communications device with the protruding section 114 extending over the circuit board. The mounting structure 111 and antenna 112 may then be secured to the circuit board and to the housing of the mobile communications device using one or more apertures 116, 117 within the mounting structure 111.

Figure 12:
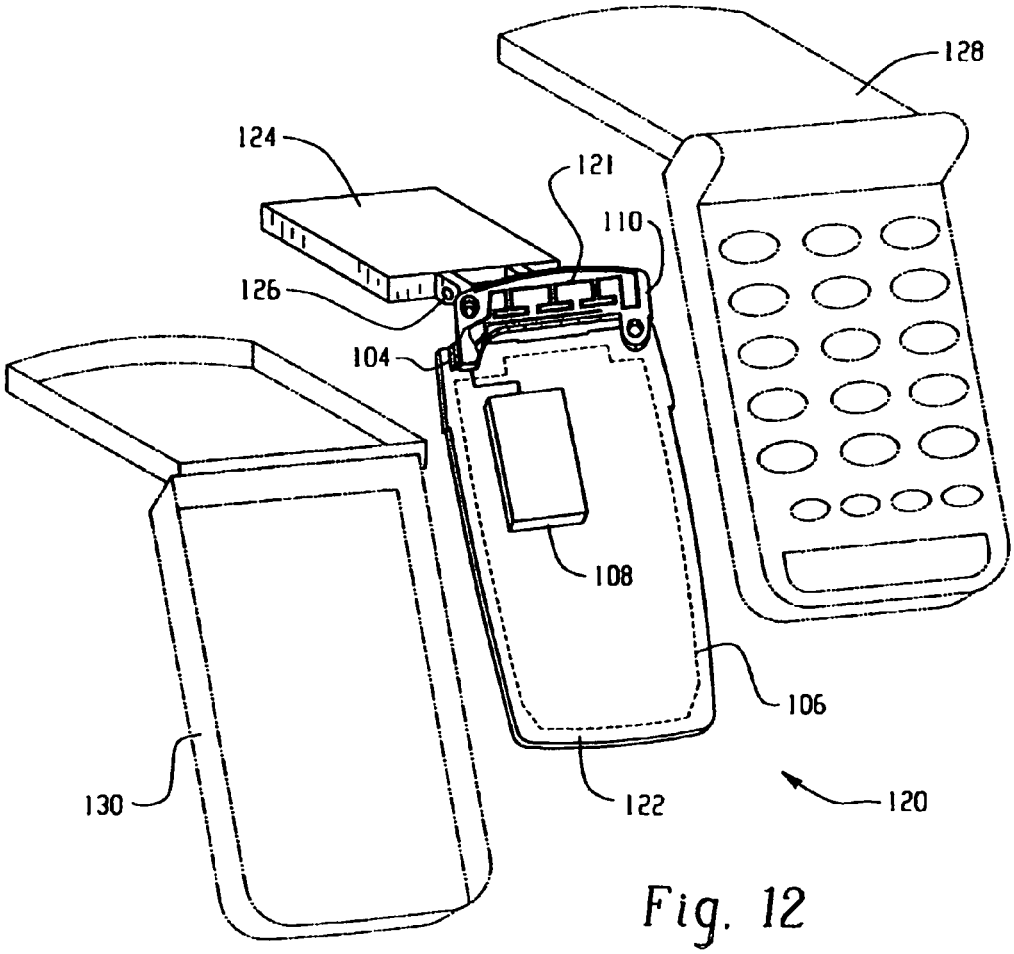
FIG. 12 is an exploded view of an exemplary clamshell-type cellular telephone having a multi-band monopole antenna.

FIG. 12 is an exploded view of an exemplary clamshell-type cellular telephone 120 having a multi-band monopole antenna 121. The cellular telephone 120 includes a lower circuit board 122, an upper circuit board 124, and the multi-band antenna 121 secured to a mounting structure 110. Also illustrated are an upper and a lower housing 128, 130 that join to enclose the circuit boards 122, 124 and antenna 121. The illustrated multi-band monopole antenna 121 is similar to the multi-band antenna 30 shown in FIG. 2. It should be understood, however, that alternative antenna configurations, as describe above with reference to FIGS. 1-9, could also be used.

The lower circuit board 122 is similar to the circuit board 102 described above with reference to FIG. 10, and includes a ground plane 106, a feeding point 104, and communications circuitry 108. The multi-band antenna 121 is secured to a mounting structure 110 and coupled to the lower circuit board 122, as described above with reference to FIGS. 10 and 11. The lower circuit board 122 is then connected to the upper circuit board 124 with a hinge 126, enabling the upper and lower circuit boards 122, 124 to be folded together in a manner typical for clamshell-type cellular phones. In order to further reduce electromagnetic interference from the upper and lower circuit boards 122, 124, the multi-band antenna 121 is preferably mounted on the lower circuit board 122 adjacent to the hinge 126.

Figure 13:
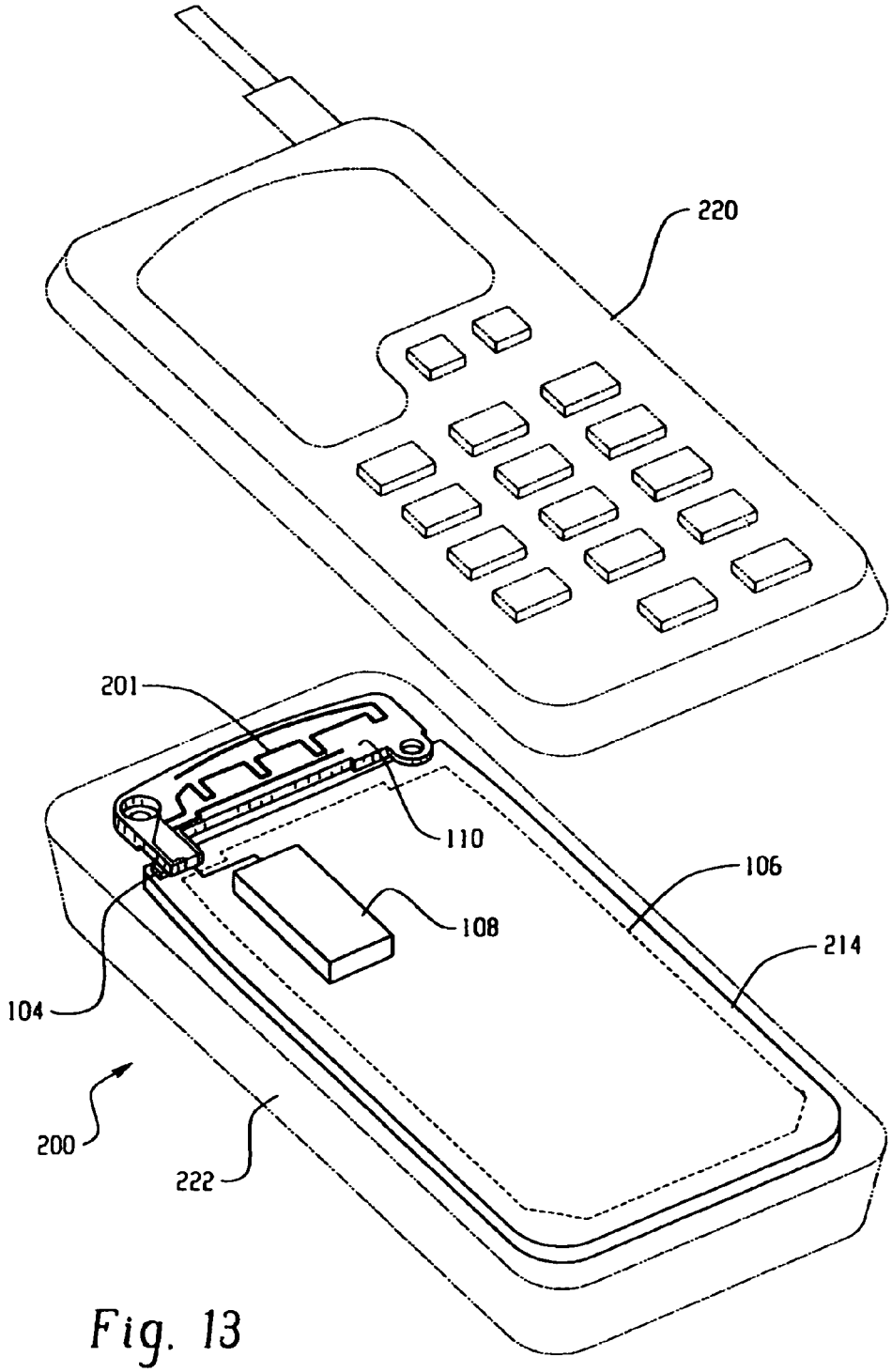
FIG. 13 is an exploded view of an exemplary candy-bar-style cellular telephone having a multi-band monopole antenna.

FIG. 13 is an exploded view of an exemplary candy-bar-type cellular telephone 200 having a multi-band monopole antenna 201. The cellular telephone 200 includes the multi-band monopole antenna 201 secured to a mounting structure 110, a circuit board 214, and an upper and lower housing 220, 222. The circuit board 214 is similar to the circuit board 102 described above with reference to FIG. 10, and includes a ground plane 106, a feeding point 104, and communications circuitry 108. The illustrated antenna 201 is similar to the multi-band monopole antenna shown in FIG. 3, however alternative antenna configurations, as described above with reference to FIGS. 1-9, could also be used.

The multi-band antenna 201 is secured to the mounting structure 110 and coupled to the circuit board 214 as described above with reference to FIGS. 10 and 11. The upper and lower housings 220, 222 are then joined to enclose the antenna 212 and circuit board 214.

Figure 14:
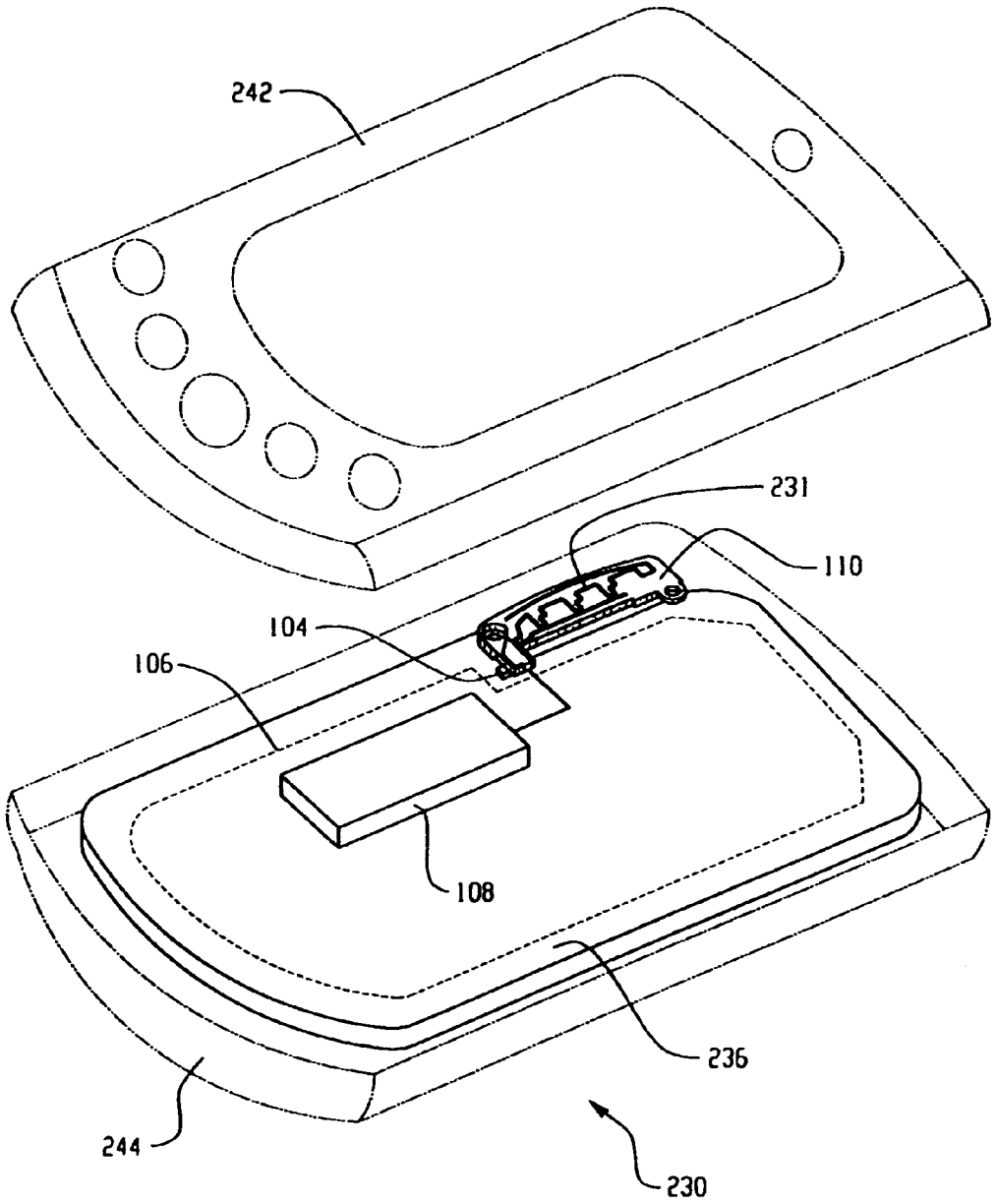
FIG. 14 is an exploded view of an exemplary personal digital assistant (PDA) having a multi-band monopole antenna.

FIG. 14 is an exploded view of an exemplary personal digital assistant (PDA) or gaming device 230 having a multi-band monopole antenna 231. The PDA 230 includes the multi-band monopole antenna 231 secured to a mounting structure 110, a circuit board 236, and an upper and lower housing 242, 244. Although shaped differently, the PDA circuit board 236 is similar to the circuit board 102 described above with reference to FIG. 10, and includes a ground plane 106, a feeding point 104, and communications circuitry 108. The illustrated antenna 231 is similar to the multi-band monopole antenna shown in FIG. 5, however alternative antenna configurations, as described above with reference to FIGS. 1-9, could also be used. As discussed above with respect to FIG. 10, preferably 50% or less of the antenna footprint on the plane of the circuit board 236 intersects the metalization of the ground plane.

The multi-band antenna 231 is secured to the mounting structure 110 and coupled to the circuit board 214 as described above with reference to FIGS. 10 and 11. In slight contrast to FIG. 10, however, the PDA circuit board 236 defines an L-shaped slot along an edge of the circuit board 236 into which the antenna 231 and mounting structure 110 are secured in order to conserve space within the PDA 230. The upper and lower housings 242, 244 are then joined together to enclose the antenna 231 and circuit board 236.

Figure 15:
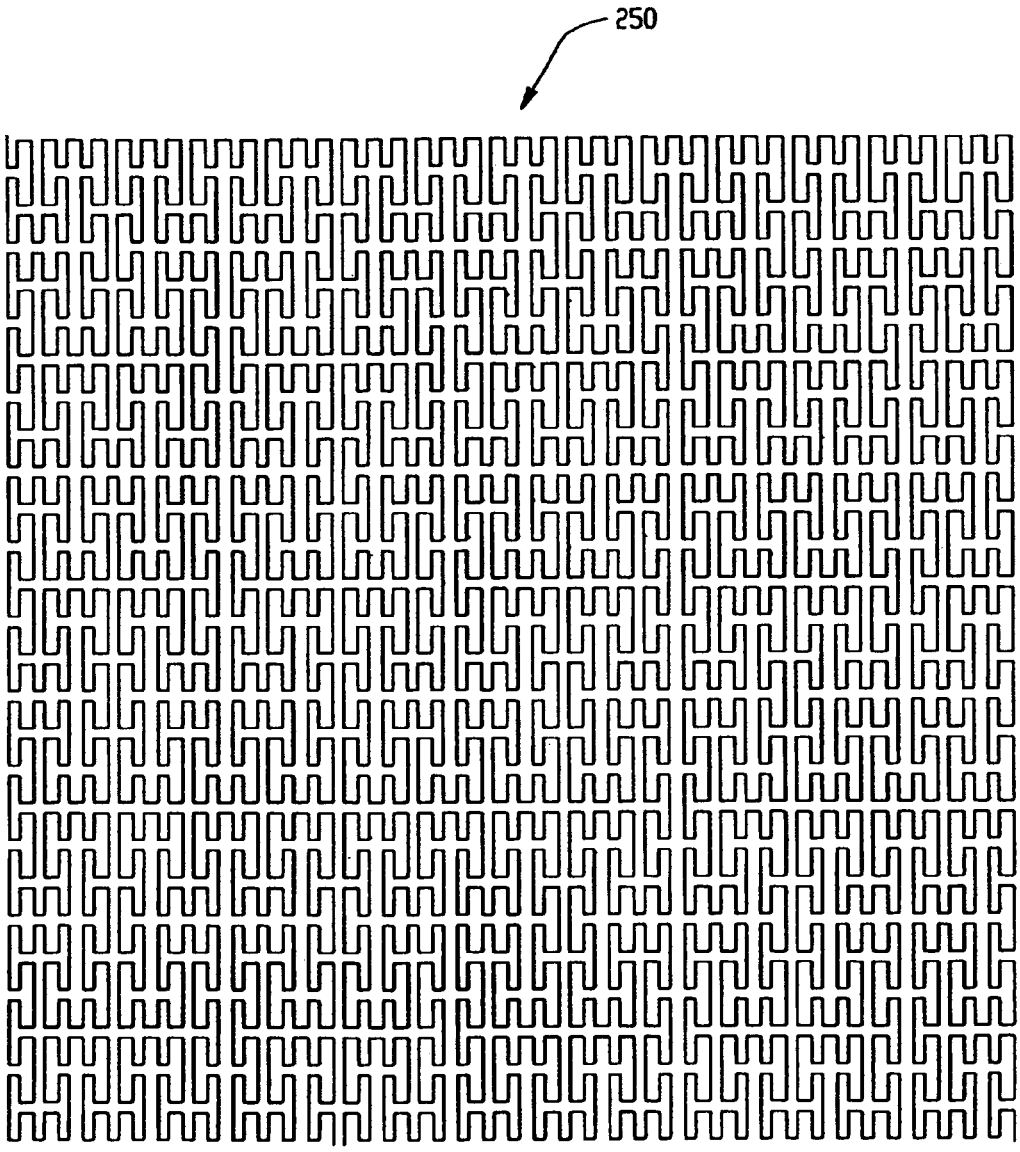
FIG. 15 shows one example of a space-filling curve.

An example of a space-filling curve 250 is shown in FIG. 15. As mentioned above, space-filling means a curve formed from a line that includes at least ten segments, with each segment forming an angle with an adjacent segment. When used in an antenna, each segment in a space-filling curve 250 should be shorter than one-tenth of the free-space operating wavelength of the antenna.

In addition to space-filling curves, the curves described herein can also be grid dimension curves. Examples of grid dimension curves are shown in FIGS. 16 to 19. The grid dimension of a curve may be calculated as follows. A first grid having square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid should include at least twenty-five cells, and the second grid should include four times the number of cells as the first grid. Thus, the length (L2) of each square cell in the second grid should be one-half the length (L1) of each square cell in the first grid. The grid dimension ($D_g$) may then be calculated with the following equation:

$$D_g = -\frac{\log(N2) - \log(N1)}{\log(L2) - \log(L1)}$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

Figure 16:
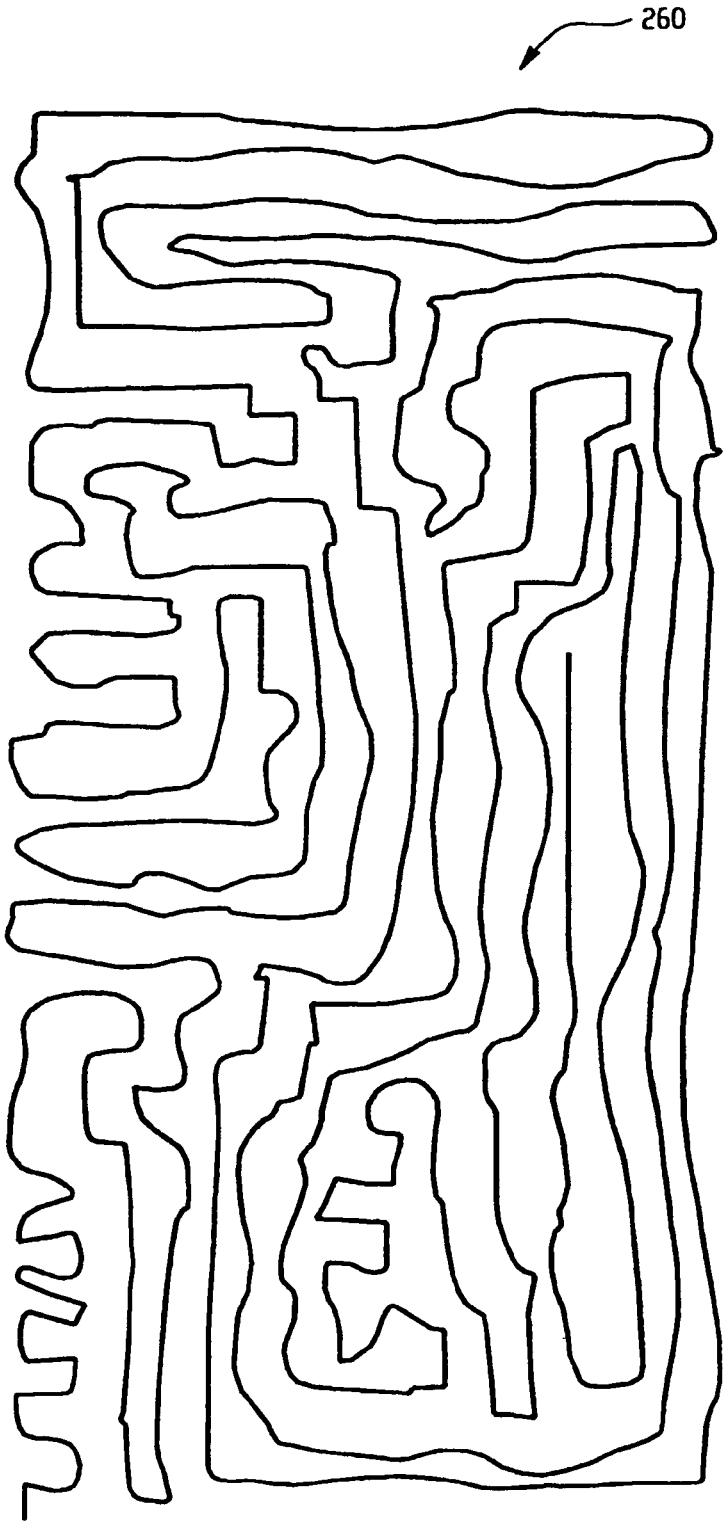
FIGS. 16-19 illustrate an exemplary two-dimensional antenna geometry forming a grid dimension curve.
Figure 17:
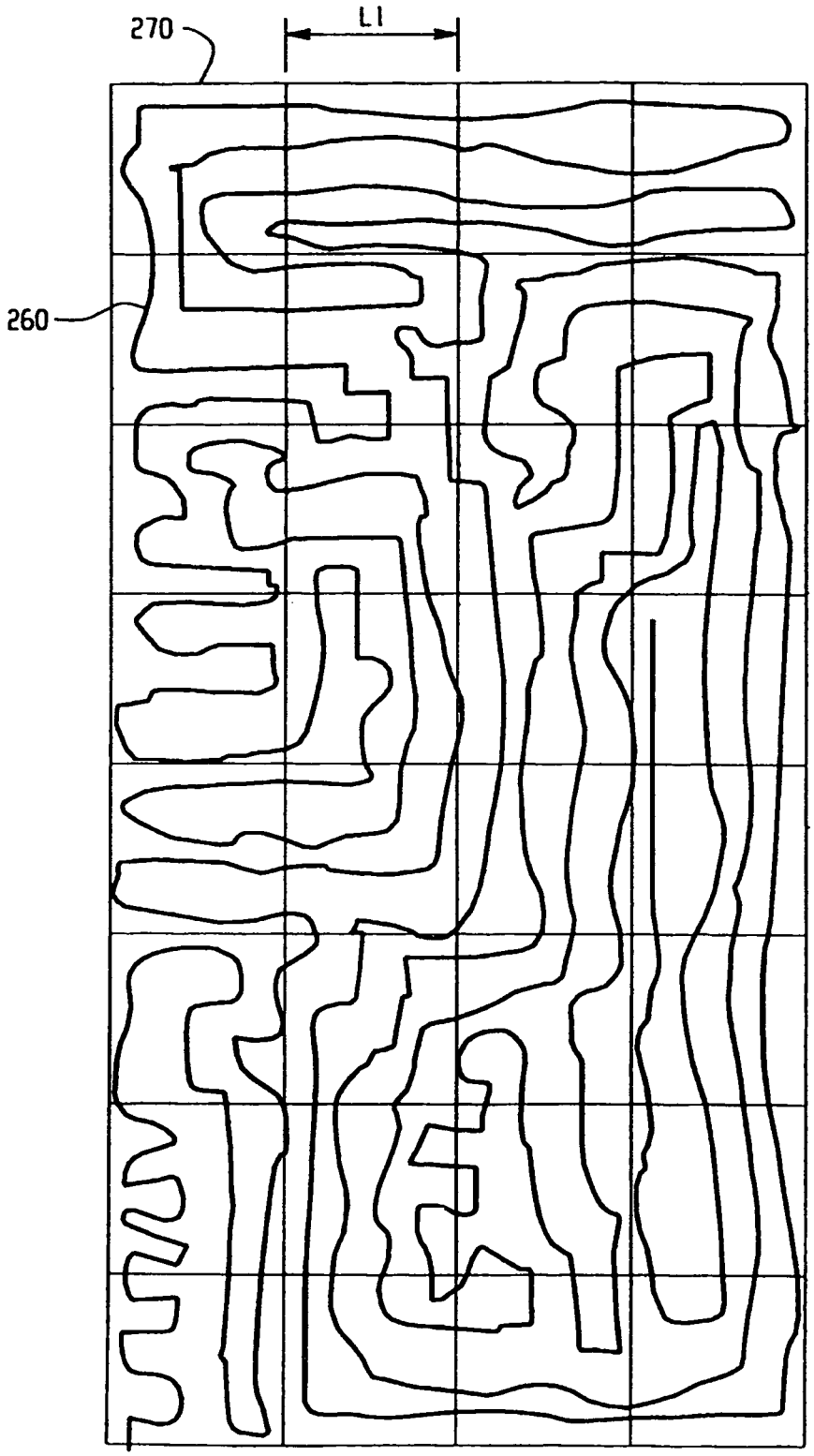
Figure 18:
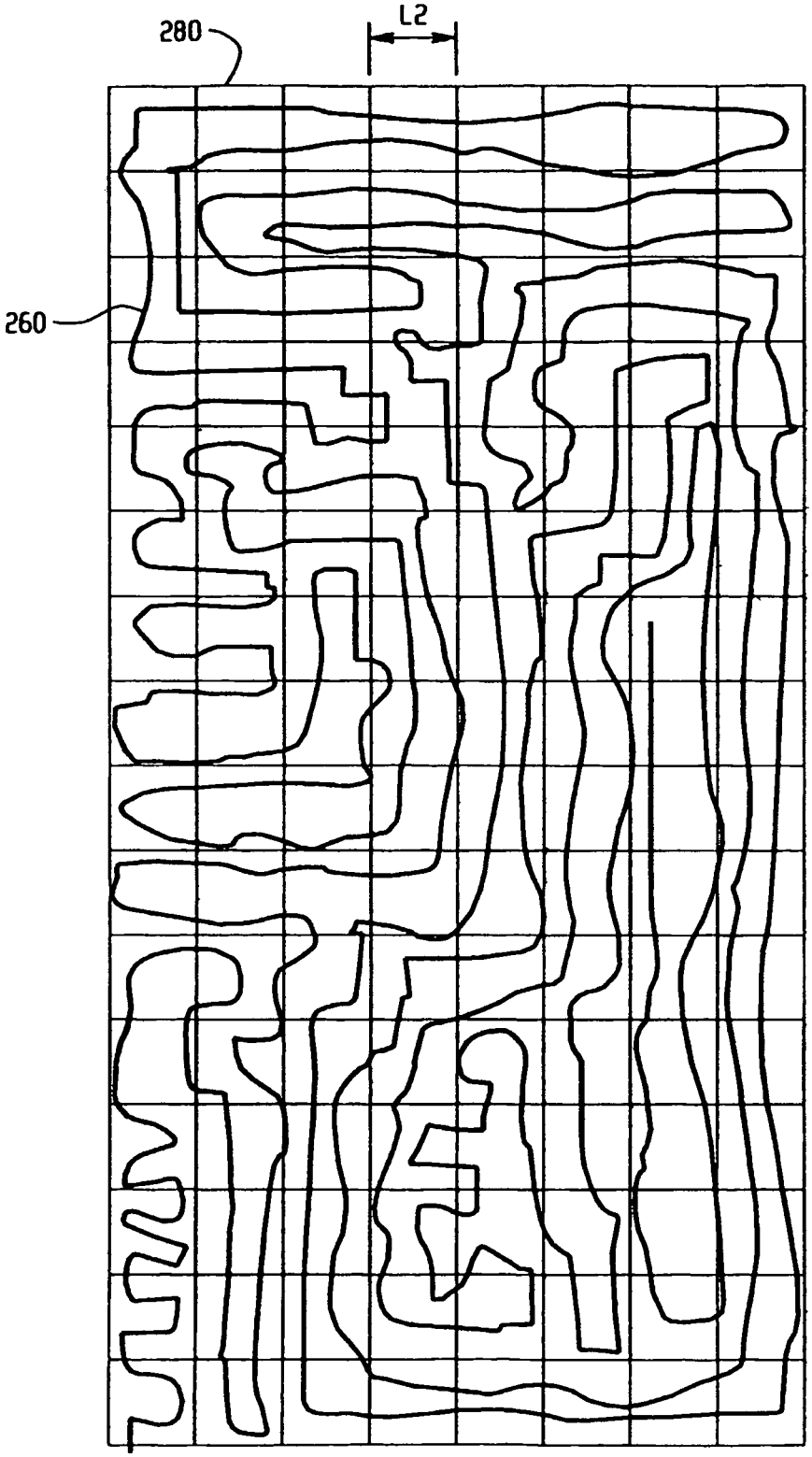

FIG. 16 shows an exemplary two-dimensional antenna 260 forming a grid dimension curve with a grid dimension of approximately two (2). FIG. 17 shows the antenna 260 of FIG. 16 enclosed in a first grid 270 having thirty-two (32) square cells, each with length L1. FIG. 18 shows the same antenna 260 enclosed in a second grid 280 having one hundred twenty-eight (128) square cells, each with a length L2. The length (L1) of each square cell in the first grid 270 is twice the length (L2) of each square cell in the second grid 280 (L2=2×L1). An examination of FIGS. 17 and 18 reveals that at least a portion of the antenna 260 is enclosed within every square cell in both the first and second grids 270, 280. Therefore, the value of N1 in the above grid dimension ($D_g$) equation is thirty-two (32) (i.e., the total number of cells in the first grid 270), and the value of N2 is one hundred twenty-eight (128) (i.e., the total number of cells in the second grid 280). Using the above equation, the grid dimension of the antenna 260 may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 19:
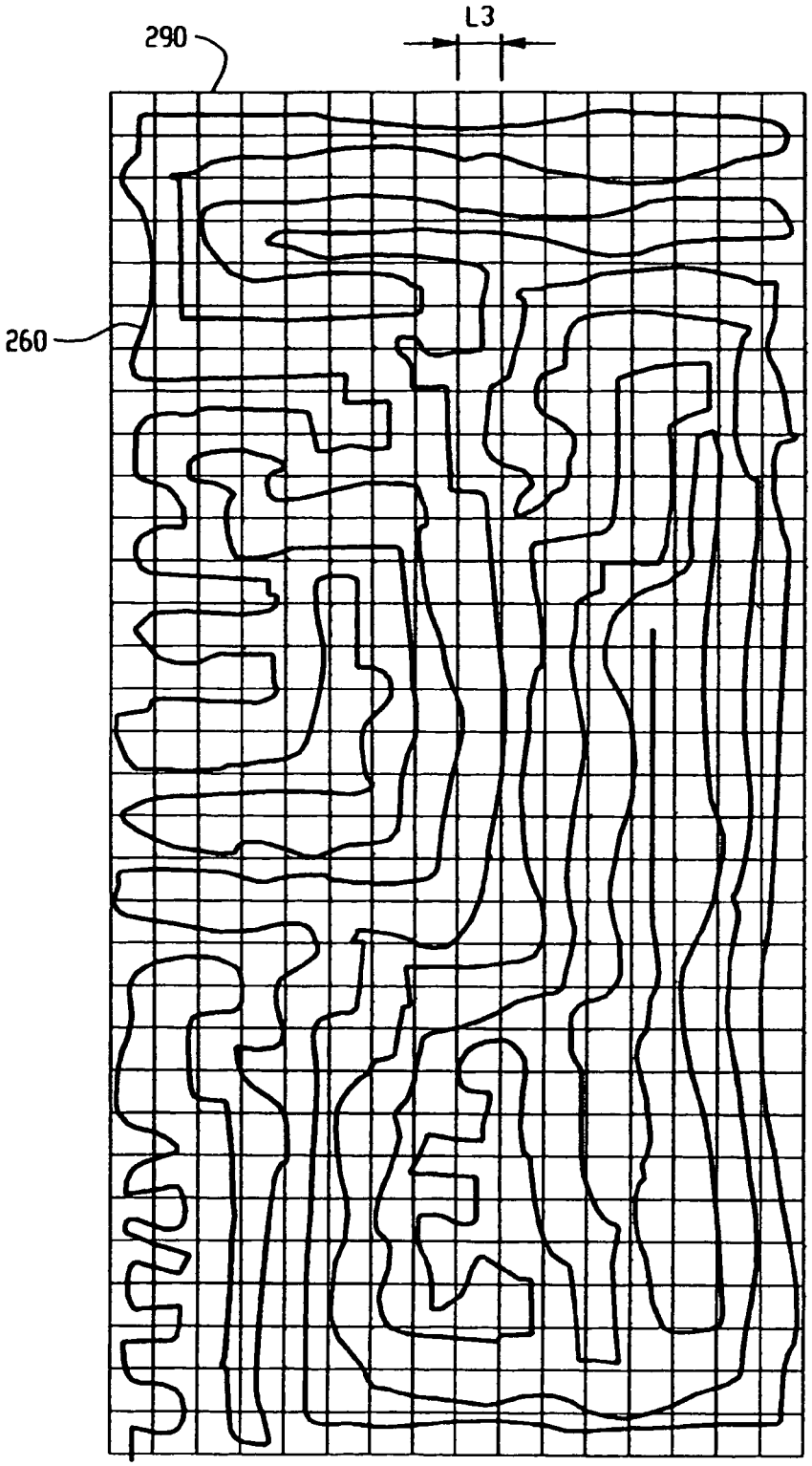

For example, FIG. 19 shows the same antenna 260 enclosed in a third grid 290 with five hundred twelve (512) square cells, each having a length L3. The length (L3) of the cells in the third grid 290 is one half the length (L2) of the cells in the second grid 280, shown in FIG. 18. As noted above, a portion of the antenna 260 is enclosed within every square cell in the second grid 280, thus the value of N for the second grid 280 is one hundred twenty-eight (128). An examination of FIG. 19, however, reveals that the antenna 260 is enclosed within only five hundred nine (509) of the five hundred twelve (512) cells in the third grid 290. Therefore, the value of N for the third grid 290 is five hundred nine (509). Using FIGS. 18 and 19, a more accurate value for the grid dimension ($D_g$) of the antenna 260 may be calculated as follows:

$$D_g = -\frac{\log(509) - \log(128)}{\log(2 \times L2) - \log(L2)} \approx 1.9915$$

The multi-band monopole antennas disclosed herein also include multiple conductor, double-sided, double-surface antenna arrangements. These multiple conductor, double-sided, double-surface antenna arrangements include all the aspects of the multi-band monopole antennas discussed above including, but not limited to, the physical properties of the substrate and conductive materials. In such double-sided, double-surface antenna arrangements, conductors are located on different surfaces of an antenna substrate. Each of the conductors can have the same or different geometry. Conductors on different sides of an antenna substrate can be physically, electrically connected or they may not be connected. Conductors on different sides of an antenna substrate can be connected by a coupling mechanism, e.g., an internal passage or via containing a conductor or an external conductor. Options for conductors include, but are not limited to, conductors with space-filling or grid dimension curves as discussed above, conductors with multiple arms as discussed above, and conducting plates that acts as parasitic reflector planes to tune the resonant frequency of a second band of another conductor.

Figure 20A:
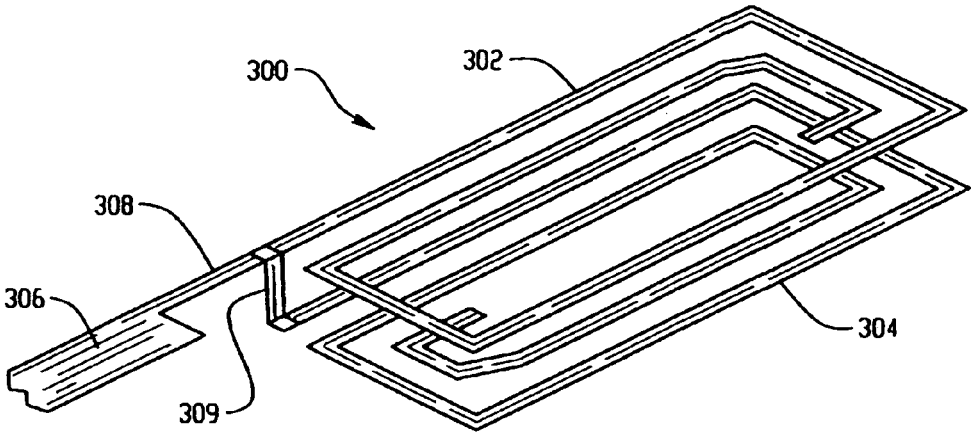
FIG. 20*a* is a perspective view of a double-sided, double-surface antenna with two spiral conductors in the absence of a substrate.
Figure 20B:
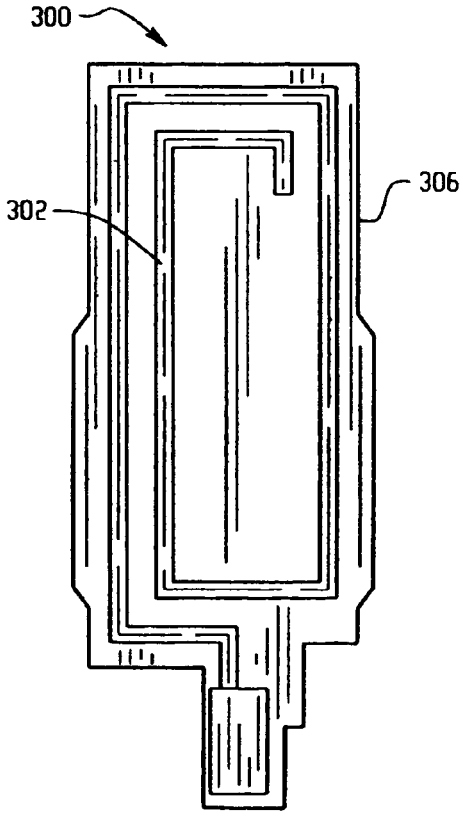
FIG. 20*b* is a front view of a double-sided, double-surface antenna with two spiral conductors with a substrate.
Figure 20C:
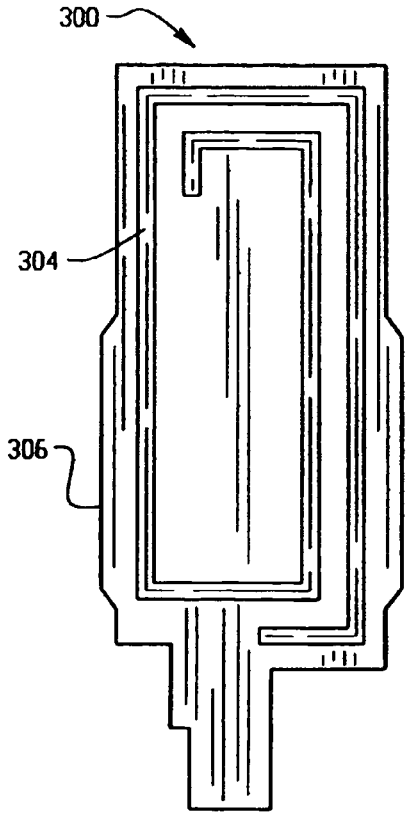
FIG. 20*c* is a back view of a double-sided, double-surface antenna with two spiral conductors with a substrate.

FIGS. 20*a*, 20*b* and 20*c* show an example of a double-sided, double-surface antenna 300 with two spiral conductors (302 and 304). FIG. 20*a* is a perspective view of the conductors of the double-sided, double-surface antenna 200. An antenna substrate, may be included between the spiral conductors 302 and 304. Suitable antenna substrate materials are well known and may include, for example, plastic, FR4, teflon, Arlon®, Rogers®, and fiberglass. FIGS. 20*b* and 20*c* are views of the front and back of the double-sided, double-surface antenna 300 including a substrate 306. Referring to FIGS. 20*a*, 20*b*, and 20*c*, spiral conductor 302 may be located on the front face of antenna substrate 306 and spiral conductor 304 may be located on the back face of antenna substrate 306. Spiral conductor 302 is connected to a feeding port 308 and spiral conductor 302 is connected to spiral conductor 304 by connector 309. Connector 309 electrically connects spiral connectors 302 and 304 and passes through an internal passage of the antenna substrate 306.

Figure 21A:
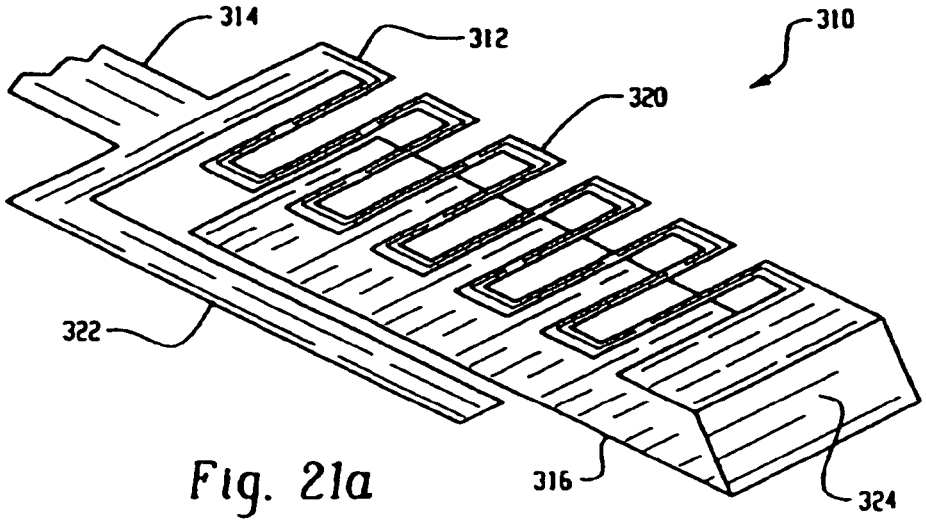
FIG. 21*a* is a perspective view of a double-sided, double-surface antenna with a dual branched conductor and a conducting plate in the absence of a substrate.
Figure 21B:
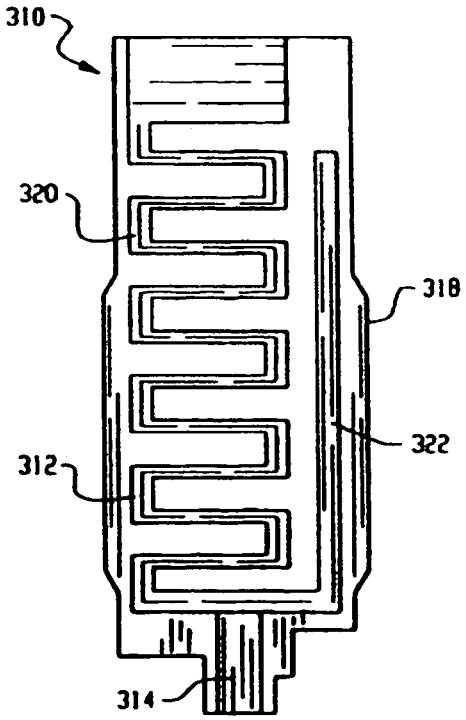
FIG. 21*b* is a front view of a double-sided, double-surface antenna with a dual branched conductor and a conducting plate with a substrate.
Figure 21C:
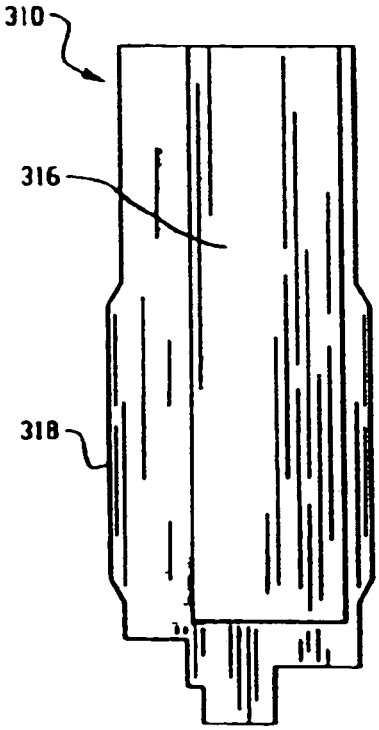
FIG. 21*c* is a back view of a double-sided, double-surface antenna with a dual branched conductor and a conducting plate with a substrate.

FIGS. 21*a*, 21*b* and 21*c* show an example of a double-sided, double-surface antenna 310 with a dual branched antenna 312, a feeding port 314, and a conducting plate 316. FIG. 21*a* is a perspective view of the conductors of the double-sided, double surface antenna 310. Similar to double-sided, double-surface antenna 300, an antenna substrate may be located between the dual branched antenna 312 and the conducting plate 316. FIGS. 21*b* and 21*c* are views of the front and back of the double-sided, double surface antenna 310 including a substrate 318. The dual branched antenna 312 comprises two conductors: a space-filling or grid dimension section 320 and a linear section 322 (further examples of dual and multi-band antennas are discussed above).

Conducting plate 316 can either be an extension of the space-filling or grid dimension section 320 of the dual branched antenna 312 if electrically connected to space-filling or grid dimension section 320 or a parasitic plane reflector if not electrically connected to space-filling or grid dimension section 320. If the plane 324 is used to represent a conductor electrically connecting the end of the space-filling or grid dimension section 320 of the dual branched antenna 312 to the conducting plate 316, then the conducting plate acts as an extension of the space-filling or grid dimension section 320 of the dual branched antenna 312 and will also provide some of the tuning properties of a parasitic plane reflector. If the plane 324 is not a conductor connecting the end of the space-filling or grid dimension section 320 to the conducting plate 316, then the conducting plate acts as a parasitic plane reflector. Conductors connecting the space-filling or grid-dimension section 320 to the conducting plate 316 can be any type of electrical connection and the electrical connection can occur at any points along their common length. The electrical connection also can be located in any orientation such as, for example, over the substrate surface or through an internal passage of the substrate.

Figure 22A:
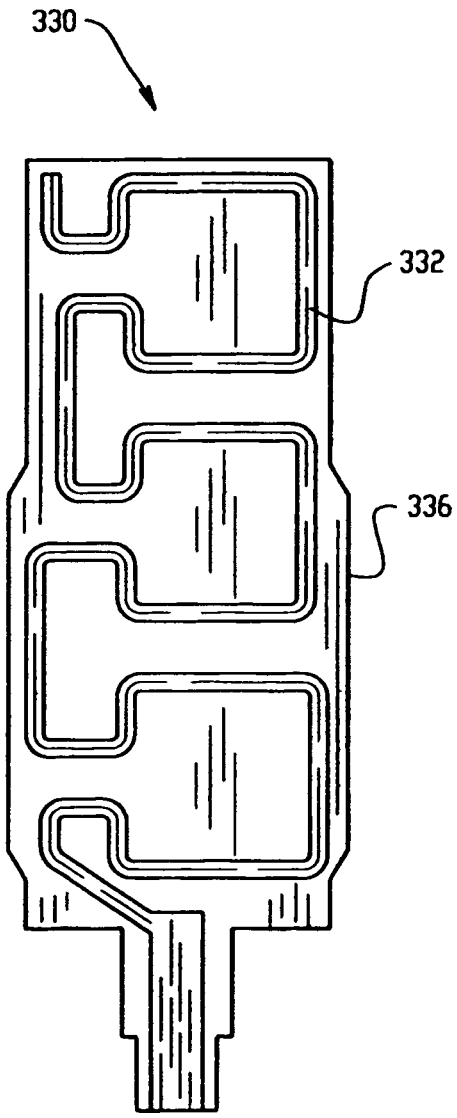
FIG. 22*a* is a front view of a Rogers-type double-sided, double-surface antenna showing a Hilbert-like space-filling conductor.
Figure 22B:
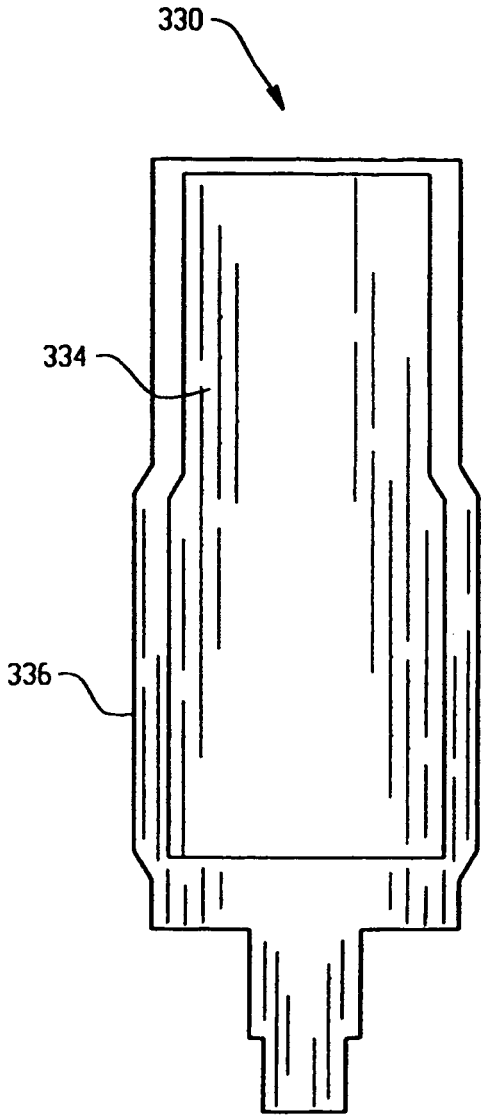
FIG. 22*b* is a back view of a Rogers-type double-sided, double-surface antenna showing a parasitic plate reflector.

Another antenna example is shown in FIGS. 22*a* and 22*b*. The antenna shown in FIGS. 22*a* and 22*b* is an example of a double-sided, double-surface antenna 330 with a conductor 332 and reflector 334 located on an antenna substrate 336. Antenna 330 is a Rogers-type antenna. The conductor 332 of antenna 330 has a Hilbert-like space-filling antenna that is located on the front face of substrate 336. The reflector 334, which is located on the back face of substrate 336, acts as a parasitic plane reflector that helps to tune the resonant frequency of the conductor 332 located on the front face of substrate 336.

Figure 23A:
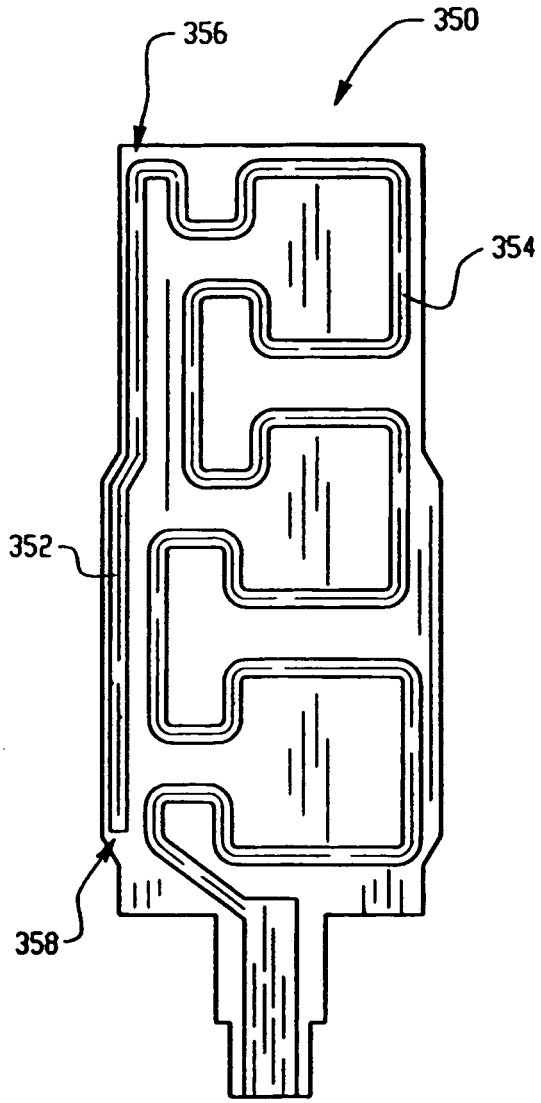
FIG. 23*a* is a front view of a double-sided, double-surface antenna showing a modified Hilbert-like space-filling conductor.
Figure 23B:
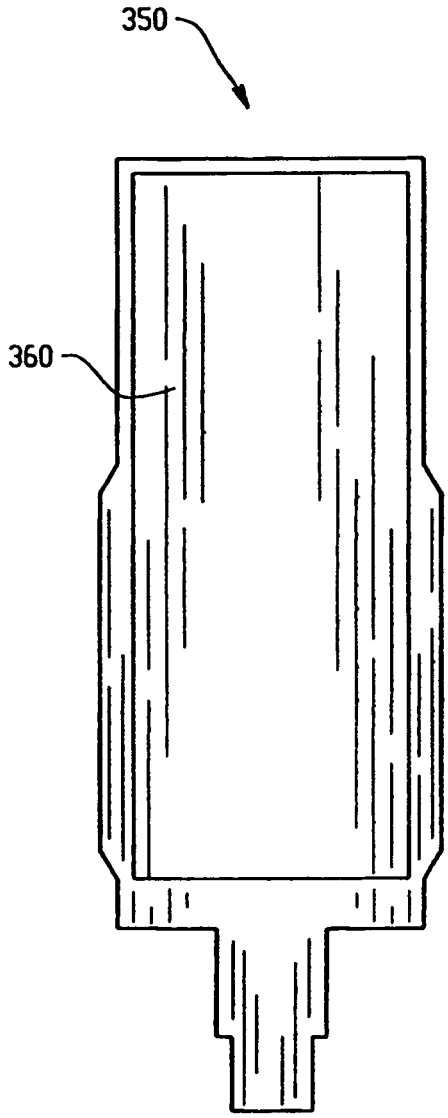
FIG. 23*b* is a back view of a double-sided, double-surface antenna showing a parasitic plate reflector.

FIGS. 23*a* and 23*b* show another example of a double-sided, double-surface antenna 350. Antenna 350 is a modification of antenna 310 shown in FIGS. 21*a*, 21*b* and 21*c*. The first difference between antenna 350 and antenna 310 is that linear section 320 of antenna 310, i.e., linear section 352 of antenna 350, is now connected to the Hilbert-like space-filling section 354 of antenna 350 at the distal end 356 of the Hilbert-like space-filling section 354 rather than at the proximal end 358. The Hilbert-like space filling section 354 of antenna 350 can, for example, be tuned to the GSM900 frequency band and the modification to linear section 352 could help to reduce the resonant frequency of the GSM900 band. The second difference between antenna 350 and antenna 310 is that a conducting plate 360 has been added to the back face of the antenna substrate to create a parasitic plane reflector. The linear portion 352 of antenna 350 can, for example, be tuned to the GSM1800 band and the parasitic plane reflector could help tune the frequency of the GSM1800 band.

Many modifications to the antennas described above are possible. For example, the linear portions of antennas 310 or 350 could be lengthened or shortened or the electrical connection relationship with a space-filling or grid dimension conductor can be adjusted. For further example, the space-filling or grid dimension portions of antennas 310, 330 or 350 could have various curves removed or replaced by solid conductor portions. The space-filling or grid dimension portions of these antennas can also adopt any of the configurations defined above. By way of an additional example, conductor plates/parasitic plane reflectors of antennas 310, 330 or 350 can be decreased in width or height or both. Further, the shape of a conductor plate/parasitic plane reflector could be modified in other ways, such as by removing various portions of the conductor/reflector or simply creating differing shapes.

Figure 24:
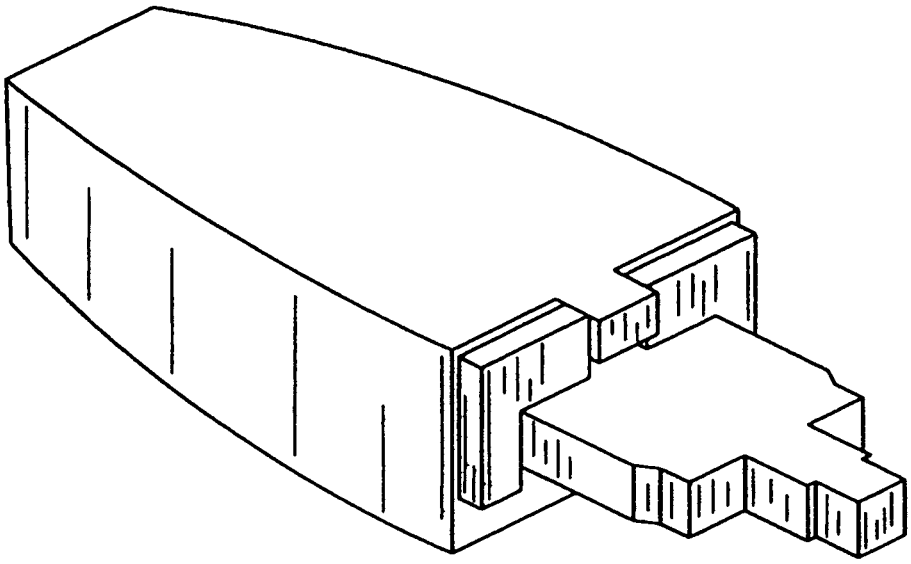
FIG. 24 is an example of an external antenna housing that might be fitted with one of the described antennas.

FIG. 24 shows an example of an antenna housing that any one of the antennas described above could be fitted within. Such an antenna housing could be affixed, for example, to a candy bar type mobile communication device, to a clam-shell type mobile communication device, to a gaming device, or to a PDA.

This written description uses examples to disclose the invention, including the best mode, and also to enable a person skilled in the art to make and use the invention. The patentable scope of the invention is defined by the claims, and may include other examples that occur to those skilled in the art. Such other examples, which may be available either before or after the application filing date, are intended to be within the scope of the claims if they have structural elements that do not differ from the literal language of the claims, or if they include equivalent structural elements with insubstantial differences from the literal language of the claims.

What is claimed is:

1. A mobile communication device, comprising:
- a device housing;
- a printed circuit board, the printed circuit board comprising:
  - a ground plane layer;
  - a feeding point;
- a communication circuitry, the communication circuitry being mounted on the printed circuit board;
- wherein the communication circuitry is coupled to the feeding point and to the ground plane layer;
- a multi-band antenna capable of operating at multiple frequency bands, the multi-band antenna including an antenna element;
- wherein the antenna element operates in cooperation with the ground plane layer;
- the antenna element comprising:
  - a common conductor;
  - a first radiating arm connected to the common conductor;
  - a second radiating arm connected to the common conductor;
- wherein the common conductor includes a feeding port, the feeding port being coupled to the feeding point;
- wherein at least a portion of the first radiating arm and at least a portion of the second radiating arm are arranged on different planes;
- wherein the first radiating arm is at least partially shaped according to a grid-dimension curve; and
- wherein the printed circuit board, the communication circuitry, and the multi-band antenna are arranged inside the device housing.

2. The mobile communication device according to claim 1, wherein the first radiating arm comprises a first plurality of segments;
- wherein each segment of the first plurality of segments is smaller than 1/10 of a lowest operating free-space wavelength of the multi-band antenna;
- wherein the segments are spatially arranged such that each pair of adjacent segments forms a corner; and
- wherein no two adjacent and connected segments form another longer straight segment;
- and wherein none of said segments intersect with another segment other than to form a closed loop.

3. The mobile communication device according to claim 2, wherein the first plurality of segments comprises at least one curved segment.

4. The mobile communication device according to claim 2, wherein the first plurality of segments comprises at least ten segments.

5. The mobile communication device according to claim 2, wherein the second radiating arm comprises a second plurality of segments;

wherein each segment of the second plurality of segments is smaller than 1/10 of a lowest operating free-space wavelength of the multi-band antenna;

wherein the segments are spatially arranged such that each pair of adjacent segments forms a corner; and wherein no two adjacent and connected segments form another longer straight segment;

and wherein none of said segments intersect with another segment other than to form a closed loop.

6. The mobile communication device according to claim 5, wherein the first plurality of segments comprises more segments than the second plurality of segments.

7. The mobile communication device according to claim 1, wherein the grid-dimension curve has a grid dimension larger than 1.3.

8. The mobile communication device according to claim 1, wherein the grid-dimension curve has a grid dimension larger than 1.5.

9. The mobile communication device according to claim 1, wherein the second radiating arm is at least partially shaped according to a second grid-dimension curve.

10. The mobile communication device according to claim 9, wherein the grid-dimension curve and the second grid-dimension curve have different lengths.

11. The mobile communication device according to claim 9, wherein the grid-dimension curve and the second grid-dimension curve have different grid dimensions.

12. The mobile communication device according to claim 1, wherein an orthogonal projection of a footprint of the antenna element on a plane of the printed circuit board overlaps the ground plane layer in less than 50% of an area of said footprint.

13. The mobile communication device according to claim 1, comprising:

a dielectric mounting structure having a plurality of surfaces;

wherein at least a portion of the first radiating arm is arranged on a first surface of said plurality of surfaces; and wherein at least a portion of the second radiating arm is arranged on a second surface of said plurality of surfaces, the second surface being different from the first surface.

14. The mobile communication device according to claim 13, wherein the first surface and the second surface are opposite surfaces of the dielectric mounting structure.

15. A mobile communication device, comprising:

a device housing;

a printed circuit board, the printed circuit board comprising:

a ground plane layer;

a feeding point;

a communication circuitry, the communication circuitry being mounted on the printed circuit board;

wherein the communication circuitry is coupled to the feeding point and to the ground plane layer;

a multi-band antenna capable of operating at multiple frequency bands, the multi-band antenna including an antenna element;

wherein the antenna element is coupled to the feeding point and operates in cooperation with the ground plane layer; the antenna element comprising:

a first conductor, the first conductor comprising a first radiating arm having a grid-dimension section shaped according to a grid-dimension curve;

a second conductor arranged at a predetermined distance from the first conductor and electromagnetically coupled to the first conductor, the second conductor comprising a planar section; and wherein the printed circuit board, the communication circuitry, and the multi-band antenna are arranged inside the device housing.

16. The mobile communication device according to claim 15, wherein the first conductor and the second conductor are electrically connected.

17. The mobile communication device according to claim 16, wherein the antenna element comprises a connecting portion that connects the first radiating arm and the planar section.

18. The mobile communication device according to claim 17, wherein a width of the grid-dimension section is smaller than a width of the planar section.

19. The mobile communication device according to claim 15, wherein the grid-dimension curve features a grid dimension larger than 1.3.

20. The mobile communication device according to claim 15, wherein the grid-dimension curve comprises at least ten connected segments;

wherein said segments are each smaller than 1/10 of a lowest operating free-space wavelength of the multi-band antenna;

wherein the segments are spatially arranged such that no two adjacent and connected segments form another longer straight segment;

wherein none of said segments intersect with another segment other than to form a closed loop;

wherein each pair of adjacent segments forms a corner; and wherein any portion of the grid-dimension curve that is periodic along a fixed straight direction of space is defined by a non-periodic curve that includes at least ten connected segments in which no two adjacent and connected segments define a straight longer segment.

21. The mobile communication device according to claim 15, wherein the multi-band antenna comprises:

a dielectric mounting structure having a plurality of surfaces;

wherein at least a portion of the first radiating arm is arranged on a first surface of said plurality of surfaces; and wherein at least a portion of the second conductor is arranged on a second surface of said plurality of surfaces, the second surface being different from the first surface.

22. The mobile communication device according to claim 21, wherein the grid-dimension section is arranged on the first surface; and wherein the planar section is arranged on the second surface.

23. The mobile communication device according to claim 21, wherein the first surface and the second surface are two opposite surfaces of the dielectric mounting structure.

24. The mobile communication device according to claim 21, wherein the first surface and the second surface are substantially parallel.

25. The mobile communication device according to claim 15, wherein the antenna element further comprises:

a common conductor;

a second radiating arm connected to the common conductor; and wherein the first radiating arm is connected to the common conductor.

26. The mobile communication device according to claim 25, wherein the second radiating arm comprises a substantially straight section.

27. The mobile communication device according to claim 25, wherein the second radiating arm comprises a second grid-dimension section, the second grid-dimension section being shaped according to a second grid-dimension curve.

28. The mobile communication device according to claim 25, wherein the second radiating arm and the grid-dimension section of the first radiating arm lie on a common surface.

29. The mobile communication device according to claim 25, wherein the grid-dimension section of the first radiating arm extends away from the common conductor along a first direction; and wherein the second radiating arm extends away from the common conductor along a second direction, the second direction being substantially parallel to the first direction.

30. The mobile communication device according to claim 29, wherein the antenna element comprises a connecting portion that connects the grid-dimension section and the planar section; and wherein the planar section extends away from the connection portion along a direction substantially opposite to the first direction.

31. A mobile communication device, comprising:

a device housing;

a printed circuit board, the printed circuit board comprising:

a ground plane layer;

a feeding point;

a communication circuitry, the communication circuitry being mounted on the printed circuit board;

wherein the communication circuitry is coupled to the feeding point and to the ground plane layer;

a multi-band antenna capable of operating at multiple frequency bands, the multi-band antenna including:

a dielectric mounting structure having a plurality of surfaces;

an antenna element, the antenna element being coupled to the feeding point and operating in cooperation with the ground plane layer;

wherein the antenna element comprises a first radiating arm arranged on two or more surfaces of the plurality of surfaces of the dielectric mounting structure;

the first radiating arm comprising:

a first section shaped according to a grid-dimension curve;

a second section connected to the grid-dimension section, the second section having a width different from a width of the first section; and wherein the printed circuit board, the communication circuitry, and the multi-band antenna are arranged inside the device housing.

32. The mobile communication device according to claim 31, wherein the first section is arranged on a first surface of said plurality of surfaces; and wherein the second section is arranged on a second surface of said plurality of surfaces, the second surface being different from the first surface.

33. The mobile communication device according to claim 32, wherein the first surface and the second surface are opposite surfaces of the dielectric mounting structure.

34. The mobile communication device according to claim 33, wherein the first surface and the second surface are substantially parallel surfaces spaced by a predetermined distance.

35. The mobile communication device according to claim 31, wherein the first section extends along a first direction and the second section extends along a second direction, the second direction being different from the first direction.

36. The mobile communication device according to claim 35, wherein the second direction is substantially opposite to the first direction.

37. The mobile communication device according to claim 31, wherein the antenna element further comprises:

a common conductor;

a second radiating arm;

wherein each of the first radiating arm and the second radiating arm is connected to the common conductor; and wherein the second radiating arm is arranged on at least one surface of the plurality of surfaces of the dielectric mounting structure.

38. The mobile communication device according to claim 37, wherein said at least one surface is one of the two or more surfaces on which the first radiating arm is arranged.

39. The mobile communication device according to claim 38, wherein the first section of the first radiating arm is arranged on said at least one surface, so that said first section and the second radiating arm are on a common surface of the plurality of surfaces of the dielectric mounting structure.

40. The mobile communication device according to claim 37, wherein the second radiating arm has a uniform width.

41. The mobile communication device according to claim 31, wherein an orthogonal projection of a footprint of the antenna element on a plane of the printed circuit board overlaps the ground plane layer in less than 50% of an area of said footprint.

42. The mobile communication device according to claim 37, wherein the second radiating arm comprises a plurality of segments.

43. The mobile communication device according to claim 37, wherein the second radiating arm is shaped according to a second grid-dimension curve.

44. The mobile communication device according to claim 37, wherein the first section of the first radiating arm is connected to the common conductor and extends away from the common conductor along a first direction;

wherein the second section of the first radiating arm is connected to the first section and extends along a second direction; and wherein the second radiating arm extends away from the common conductor along a direction substantially opposite to the second direction.

45. The mobile communication device according to claim 31, wherein the mobile communication device operates as one of a personal digital assistant and a cellular telephone.

* * * * *